US007857693B1

(12) United States Patent
Johnson et al.

(10) Patent No.: US 7,857,693 B1
(45) Date of Patent: Dec. 28, 2010

(54) MULTI-SPIN POKER GAMING SYSTEM WITH PREDETERMINED GAME OUTCOMES

(75) Inventors: Nicholas Johnson, Stanford, CA (US); Bryan D. Wolf, Reno, NV (US)

(73) Assignee: IGT, Reno, NV (US)

( * ) Notice: Subject to any disclaimer, the term of this patent is extended or adjusted under 35 U.S.C. 154(b) by 862 days.

(21) Appl. No.: 11/764,603

(22) Filed: Jun. 18, 2007

Related U.S. Application Data

(60) Provisional application No. 60/805,293, filed on Jun. 20, 2006.

(51) Int. Cl.
*A63F 9/24* (2006.01)

(52) U.S. Cl. ..... 463/13; 463/25; 463/30; 463/43

(58) Field of Classification Search ..... 463/13
See application file for complete search history.

(56) References Cited

U.S. PATENT DOCUMENTS 2,228,180 A 1/1941 Pauli
2,474,573 A 6/1949 Cohen
3,589,729 A 6/1971 Girard
3,628,259 A 12/1971 Kahn
4,156,976 A 6/1979 Mikun
4,157,829 A 6/1979 Goldman et al.
4,332,389 A 6/1982 Loyd et al.
4,335,809 A 6/1982 Wain
4,339,798 A 7/1982 Hedges et al.
4,365,810 A 12/1982 Richardson
4,373,726 A 2/1983 Churchill et al.
4,448,419 A 5/1984 Telnaes
4,455,025 A 6/1984 Itkis
4,467,424 A 8/1984 Hedges et al.
4,494,197 A 1/1985 Troy et al.
4,527,798 A 7/1985 Siekierski et al.
4,582,324 A 4/1986 Koza et al.

(Continued)

FOREIGN PATENT DOCUMENTS

WO WO 02097749 12/2002

OTHER PUBLICATIONS

Diamonopoly Advertisement by International Gamco, Inc. published 2002.

(Continued)

*Primary Examiner*—Dmitry Suhol
*Assistant Examiner*—Malina K Rustemeyer
(74) *Attorney, Agent, or Firm*—K&L Gates LLP

(57) ABSTRACT

A gaming system which provides a predetermined outcome to a player. The gaming device a plurality of playing cards in a plurality of playing card positions to form an initial primary poker hand. The gaming device enables the player to select one or more of the initially dealt playing cards in the primary poker hand to hold or to discard, wherein the held playing cards in the primary hand are also held in one, more or each of a plurality of simultaneously played poker hands. The gaming device evaluates the set of held playing cards and determines, possibly utilizing at least one stored table of solutions, the appropriate playing cards to generate in the appropriate playing card positions to form a plurality of poker hands with a total combined payout equal to the selected predetermined game outcome value.

49 Claims, 32 Drawing Sheets

| | Poker Game Outcomes Used | | | | | | | | | | Distribution | | | | | | | | | |
|---|---|---|---|---|---|---|---|---|---|---|---|---|---|---|---|---|---|---|---|---|
| Win Amount | Lose (0) | Jacks or Better (1) | Two Pair (1) | Three of a Kind (3) | Straight (7) | Flush (7) | Full House (7) | Four of a Kind (40) | Straight Flush (200) | Royal Flush (250) | Lose (0) | Jacks or Better (1) | Two Pair (1) | Three of a Kind (3) | Straight (7) | Flush (7) | Full House (7) | Four of a Kind (40) | Straight Flush (200) | Royal Flush (250) |
| 0 | Yes | | | | | | | | | | 9 | | | | | | | | | |
| 1 | Yes | Yes | | | | | | | | | 8 | 1 | | | | | | | | |
| 1 | Yes | | Yes | | | | | | | | 8 | | 1 | | | | | | | |
| 2 | Yes | Yes | | | | | | | | | 7 | 2 | | | | | | | | |
| 2 | Yes | | Yes | | | | | | | | 7 | | 2 | | | | | | | |
| 2 | Yes | Yes | Yes | | | | | | | | 7 | 1 | 1 | | | | | | | |
| ... | ... | ... | ... | ... | ... | ... | ... | ... | ... | ... | ... | ... | ... | ... | ... | ... | ... | ... | ... | ... |
| 5 | | Yes | | | | | | | | | 4 | 5 | | | | | | | | |
| 5 | | | Yes | | | | | | | | 4 | | 5 | | | | | | | |
| 5 | Yes | | Yes | Yes | | | | | | | 6 | | 2 | 1 | | | | | | |
| 5 | Yes | Yes | | Yes | | | | | | | 6 | 2 | | 1 | | | | | | |
| 5 | Yes | Yes | Yes | Yes | | | | | | | 6 | 1 | 1 | 1 | | | | | | |
| 5 | | Yes | Yes | | | | | | | | 4 | 4 | 1 | | | | | | | |
| | | | | | | | | | | | 4 | 3 | 2 | | | | | | | |
| | | | | | | | | | | | 4 | 2 | 3 | | | | | | | |
| | | | | | | | | | | | 4 | 1 | 4 | | | | | | | |
| ... | ... | ... | ... | ... | ... | ... | ... | ... | ... | ... | ... | ... | ... | ... | ... | ... | ... | ... | ... | ... |
| 7 | Yes | | | | Yes | | | | | | 8 | | | | 1 | | | | | |
| 7 | Yes | | | | | Yes | | | | | 8 | | | | | 1 | | | | |
| 7 | Yes | | | | | | Yes | | | | 8 | | | | | | 1 | | | |
| 7 | | Yes | | Yes | | | | | | | 4 | 4 | | 1 | | | | | | |
| 7 | | | Yes | Yes | | | | | | | 4 | | 4 | 1 | | | | | | |
| 7 | | Yes | Yes | Yes | | | | | | | 4 | 2 | 2 | 1 | | | | | | |
| | | | | | | | | | | | 4 | 1 | 3 | 1 | | | | | | |
| | | | | | | | | | | | 4 | 3 | 1 | 1 | | | | | | |
| 7 | Yes | Yes | | Yes | | | | | | | 6 | 1 | | 2 | | | | | | |
| 7 | Yes | | Yes | Yes | | | | | | | 6 | | 1 | 2 | | | | | | |
| ... | ... | ... | ... | ... | ... | ... | ... | ... | ... | ... | ... | ... | ... | ... | ... | ... | ... | ... | ... | ... |
| 35 | | | | | | Yes | | | | | 4 | | | | | 5 | | | | |
| ... | ... | ... | ... | ... | ... | ... | ... | ... | ... | ... | ... | ... | ... | ... | ... | ... | ... | ... | ... | ... |
| 87 | | Yes | | Yes | | | | Yes | | | 4 | 1 | | 2 | | | | 2 | | |
| 87 | | | Yes | Yes | | | | Yes | | | 4 | | 1 | 2 | | | | 2 | | |
| 1800 | | | | | | | | | Yes | | | | | | | | | | 9 | |
| 2250 | | | | | | | | | | Yes | | | | | | | | | | 9 |

U.S. PATENT DOCUMENTS

| | | | |
|---|---|---|---|
| 4,624,462 | A | 11/1986 | Itkis |
| 4,636,951 | A | 1/1987 | Harlick |
| 4,652,998 | A | 3/1987 | Koza et al. |
| 4,669,730 | A | 6/1987 | Small |
| 4,689,742 | A | 8/1987 | Troy et al. |
| 4,798,387 | A | 1/1989 | Richardson |
| 4,805,907 | A | 2/1989 | Hagiwara |
| 4,815,741 | A | 3/1989 | Small |
| 4,817,951 | A | 4/1989 | Crouch et al. |
| 4,842,278 | A | 6/1989 | Markowicz |
| 4,848,771 | A | 7/1989 | Richardson |
| 4,856,787 | A | 8/1989 | Itkis |
| 4,861,041 | A | 8/1989 | Jones et al. |
| 4,880,237 | A | 11/1989 | Kishishita |
| 4,882,473 | A | 11/1989 | Bergeron et al. |
| 4,982,337 | A | 1/1991 | Burr et al. |
| 5,007,649 | A | 4/1991 | Richardson |
| 5,011,159 | A | 4/1991 | Fortunato et al. |
| 5,042,809 | A | 8/1991 | Richardson |
| 5,042,818 | A | 8/1991 | Weingardt |
| 5,092,598 | A | 3/1992 | Kamille |
| 5,100,137 | A | 3/1992 | Fulton |
| 5,118,109 | A | 6/1992 | Gumina |
| 5,119,295 | A | 6/1992 | Kapur |
| 5,154,429 | A | 10/1992 | LeVasseur |
| 5,158,293 | A | 10/1992 | Mullins |
| 5,165,693 | A | 11/1992 | Handlon, Sr. |
| 5,167,413 | A | 12/1992 | Fulton |
| 5,223,698 | A | 6/1993 | Kapur |
| 5,224,706 | A | 7/1993 | Bridgeman et al. |
| 5,265,874 | A | 11/1993 | Dickinson et al. |
| 5,265,882 | A | 11/1993 | Malek |
| 5,275,400 | A | 1/1994 | Weingardt et al. |
| 5,276,312 | A | 1/1994 | McCarthy |
| 5,280,915 | A | 1/1994 | Grossman |
| 5,282,620 | A | 2/1994 | Keesee |
| 5,288,081 | A | 2/1994 | Breeding |
| 5,294,120 | A | 3/1994 | Schultz |
| 5,294,128 | A | 3/1994 | Marquez |
| 5,297,802 | A | 3/1994 | Pocock et al. |
| 5,303,929 | A | 4/1994 | Sandeen |
| 5,320,356 | A | 6/1994 | Cauda |
| 5,324,035 | A | 6/1994 | Morris et al. |
| 5,326,104 | A | 7/1994 | Pease et al. |
| 5,328,189 | A | 7/1994 | Malek |
| 5,332,219 | A | 7/1994 | Marnell et al. |
| 5,348,299 | A | 9/1994 | Clapper, Jr. |
| 5,351,970 | A | 10/1994 | Fioretti |
| 5,356,140 | A | 10/1994 | Dabrowski et al. |
| 5,377,975 | A | 1/1995 | Clapper, Jr. |
| 5,377,993 | A | 1/1995 | Josephs |
| 5,393,061 | A | 2/1995 | Manship et al. |
| 5,398,932 | A | 3/1995 | Eberhardt et al. |
| 5,401,023 | A | 3/1995 | Wood |
| 5,407,199 | A | 4/1995 | Gumina |
| 5,417,430 | A | 5/1995 | Breeding |
| 5,452,899 | A | 9/1995 | Skratulia et al. |
| 5,476,259 | A | 12/1995 | Weingardt |
| 5,486,005 | A | 1/1996 | Neal |
| 5,487,544 | A | 1/1996 | Clapper, Jr. |
| 5,489,101 | A | 2/1996 | Moody |
| 5,496,038 | A | 3/1996 | Kangsanaraks |
| 5,511,781 | A | 4/1996 | Wood et al. |
| 5,531,448 | A | 7/1996 | Moody |
| 5,536,008 | A | 7/1996 | Clapper, Jr. |
| 5,542,669 | A | 8/1996 | Charron et al. |
| 5,544,892 | A | 8/1996 | Breeding |
| 5,562,284 | A | 10/1996 | Stevens |
| 5,564,701 | A | 10/1996 | Dettor |
| 5,570,885 | A | 11/1996 | Ornstein |
| 5,573,249 | A | 11/1996 | Johnson |
| 5,577,731 | A | 11/1996 | Jones |
| 5,580,053 | A | 12/1996 | Crouch |
| 5,580,311 | A | 12/1996 | Haste, III |
| 5,584,486 | A | 12/1996 | Franklin |
| 5,593,161 | A | 1/1997 | Boylan et al. |
| 5,595,538 | A | 1/1997 | Haste, III |
| 5,609,337 | A | 3/1997 | Clapper, Jr. |
| 5,628,684 | A | 5/1997 | Bouedec |
| 5,630,753 | A | 5/1997 | Fuchs |
| 5,630,754 | A | 5/1997 | Rebane |
| 5,639,092 | A | 6/1997 | Macaisa |
| 5,645,485 | A | 7/1997 | Clapper, Jr. |
| 5,657,899 | A | 8/1997 | Stoken |
| 5,664,781 | A | 9/1997 | Feola |
| 5,674,128 | A | 10/1997 | Holch et al. |
| 5,678,001 | A | 10/1997 | Nagel et al. |
| 5,697,843 | A | 12/1997 | Manship et al. |
| 5,707,285 | A | 1/1998 | Place et al. |
| 5,711,715 | A | 1/1998 | Ringo et al. |
| 5,718,431 | A | 2/1998 | Ornstein |
| 5,720,483 | A | 2/1998 | Trinh |
| 5,722,891 | A | 3/1998 | Inoue |
| 5,725,428 | A | 3/1998 | Achmuller |
| 5,732,950 | A | 3/1998 | Moody |
| 5,735,432 | A | 4/1998 | Stoken et al. |
| 5,743,530 | A | 4/1998 | Sklad et al. |
| 5,749,784 | A | 5/1998 | Clapper, Jr. |
| 5,775,692 | A | 7/1998 | Watts et al. |
| 5,779,545 | A | 7/1998 | Berg et al. |
| 5,779,547 | A | 7/1998 | SoRelle et al. |
| 5,791,987 | A | 8/1998 | Chen et al. |
| 5,800,269 | A | 9/1998 | Holch et al. |
| 5,810,664 | A | 9/1998 | Clapper, Jr. |
| 5,813,911 | A | 9/1998 | Margolin |
| 5,816,915 | A | 10/1998 | Kadlic |
| 5,816,916 | A | 10/1998 | Moody |
| 5,823,873 | A | 10/1998 | Moody |
| 5,823,874 | A | 10/1998 | Adams |
| 5,830,067 | A | 11/1998 | Graves et al. |
| 5,839,955 | A | 11/1998 | Mangano et al. |
| 5,848,932 | A | 12/1998 | Adams |
| 5,855,515 | A | 1/1999 | Pease et al. |
| 5,868,618 | A | 2/1999 | Netley et al. |
| 5,868,619 | A | 2/1999 | Wood et al. |
| 5,871,398 | A | 2/1999 | Schneier et al. |
| 5,876,283 | A | 3/1999 | Parra et al. |
| 5,879,233 | A | 3/1999 | Stupero |
| 5,882,258 | A | 3/1999 | Kelly et al. |
| 5,882,259 | A | 3/1999 | Holmes, Jr. et al. |
| 5,882,260 | A | 3/1999 | Marks et al. |
| 5,909,875 | A | 6/1999 | Weingardt |
| 5,915,588 | A | 6/1999 | Stoken et al. |
| 5,928,082 | A | 7/1999 | Clapper, Jr. |
| 5,934,675 | A | 8/1999 | Handelman et al. |
| 5,941,771 | A | 8/1999 | Haste, III |
| 5,944,606 | A | 8/1999 | Gerow |
| 5,949,042 | A | 9/1999 | Dietz, II et al. |
| 5,954,335 | A | 9/1999 | Moody |
| 5,954,582 | A | 9/1999 | Zach |
| 5,971,849 | A | 10/1999 | Falciglia |
| 5,976,016 | A | 11/1999 | Moody et al. |
| 5,980,385 | A | 11/1999 | Clapper, Jr. |
| 5,984,779 | A | 11/1999 | Bridgeman et al. |
| 6,007,066 | A | 12/1999 | Moody |
| 6,007,424 | A | 12/1999 | Evers et al. |
| 6,012,720 | A | 1/2000 | Webb |
| 6,012,981 | A | 1/2000 | Fujioka et al. |
| 6,012,984 | A | 1/2000 | Roseman |
| 6,017,032 | A | 1/2000 | Grippo et al. |
| 6,024,640 | A | 2/2000 | Walker et al. |
| 6,045,129 | A | 4/2000 | Cooper et al. |
| 6,050,568 | A | 4/2000 | Hachquet |
| 6,056,289 | A | 5/2000 | Clapper, Jr. |

6,062,980 A 5/2000 Luciano
6,062,981 A 5/2000 Luciano, Jr.
6,079,710 A 6/2000 Brown
6,089,982 A 7/2000 Holch et al.
6,089,985 A 7/2000 Morath et al.
6,093,100 A 7/2000 Singer et al.
6,098,985 A 8/2000 Moody
6,102,400 A 8/2000 Scott et al.
6,120,024 A 9/2000 Lind
6,120,378 A 9/2000 Moody et al.
6,126,541 A 10/2000 Fuchs
6,126,542 A 10/2000 Fier
6,132,311 A 10/2000 Williams
6,135,882 A 10/2000 Kadlic
6,135,883 A 10/2000 Hachquet
6,146,271 A 11/2000 Kadlic
6,146,272 A 11/2000 Walker et al.
6,149,156 A 11/2000 Feola
6,149,521 A 11/2000 Sanduski
6,155,925 A 12/2000 Giobbi et al.
6,159,095 A 12/2000 Frohm et al.
6,168,521 B1 1/2001 Luciano et al.
6,174,233 B1 1/2001 Sunaga et al.
6,176,781 B1 1/2001 Walker et al.
6,183,361 B1 2/2001 Cummings et al.
6,190,255 B1 2/2001 Thomas et al.
6,196,547 B1 3/2001 Pascal et al.
6,203,429 B1 3/2001 Demar et al.
6,210,275 B1 4/2001 Olsen
6,210,276 B1 4/2001 Mullins
6,217,448 B1 4/2001 Olsen
6,220,959 B1 4/2001 Holmes, Jr. et al.
6,220,961 B1 4/2001 Keane et al.
6,241,606 B1 6/2001 Riendeau et al.
6,254,480 B1 7/2001 Zach
6,273,820 B1 8/2001 Haste, III
6,280,325 B1 8/2001 Fisk
6,280,328 B1 8/2001 Holch et al.
6,302,791 B1 10/2001 Frohm et al.
6,306,038 B1 10/2001 Graves et al.
6,309,298 B1 10/2001 Gerow
6,311,978 B1 11/2001 Moody
6,312,334 B1 11/2001 Yoseloff
6,315,289 B1 11/2001 Sakamoto et al.
6,315,291 B1 11/2001 Moody
6,322,445 B1 11/2001 Miller
6,325,716 B1 12/2001 Walker et al.
6,334,613 B1 1/2002 Yoseloff
6,342,007 B1 1/2002 Wood et al.
6,358,150 B1 3/2002 Mir et al.
6,358,151 B1 3/2002 Enzminger et al.
6,364,313 B1 4/2002 Moody
6,368,218 B2 4/2002 Angell, Jr.
6,386,977 B1 5/2002 Hole
6,402,614 B1 6/2002 Schneier et al.
6,419,578 B1 7/2002 Moody et al.
6,419,583 B1 7/2002 Crumby et al.
6,425,824 B1 7/2002 Baerlocher et al.
6,447,395 B1 9/2002 Stevens
6,450,885 B2 9/2002 Schneier et al.
6,454,648 B1 9/2002 Kelly et al.
RE37,885 E 10/2002 Acres et al.
6,471,591 B1 10/2002 Crumby
6,475,086 B2 11/2002 Zach
6,508,711 B1 1/2003 Ono
6,517,074 B1 2/2003 Moody et al.
6,524,184 B1 2/2003 Lind et al.
6,524,185 B2 2/2003 Lind
6,527,638 B1 3/2003 Walker et al.
6,533,664 B1 3/2003 Crumby
6,537,150 B1 3/2003 Luciano et al.
6,561,898 B2 5/2003 Moody
6,568,680 B1 5/2003 Moody et al.
6,569,017 B2 5/2003 Enzminger et al.
6,599,187 B2 7/2003 Gerow
6,607,439 B2 8/2003 Schneier et al.
6,609,974 B2 8/2003 Mead et al.
6,612,927 B1 9/2003 Slomiany et al.
6,619,660 B2 9/2003 Schaefer et al.
6,652,377 B1 11/2003 Moody
6,656,040 B1 12/2003 Brosnan et al.
6,656,044 B1 12/2003 Lewis
6,672,959 B2 1/2004 Moody et al.
6,676,126 B1 1/2004 Walker et al.
6,685,562 B1 2/2004 Rantanen
6,695,695 B2 2/2004 Angel
6,729,961 B1 5/2004 Millerschone
6,733,385 B1 5/2004 Enzminger et al.
6,749,500 B1 6/2004 Nelson et al.
6,964,418 B2 11/2005 Moody
6,988,946 B2 1/2006 Michaelson et al.
7,007,953 B1 3/2006 Cabot
2002/0010013 A1 1/2002 Walker et al.
2002/0039917 A1 4/2002 Armstrong et al.
2002/0077173 A1 6/2002 Luciano et al.
2002/0077174 A1 6/2002 Luciano et al.
2002/0082070 A1 6/2002 Macke et al.
2002/0082071 A1 6/2002 Riendeau et al.
2002/0082085 A1 6/2002 Osterer
2002/0090986 A1 7/2002 Cote et al.
2002/0094871 A1 7/2002 Luciano et al.
2002/0098882 A1 7/2002 Lind et al.
2002/0098883 A1 7/2002 Packes, Jr. et al.
2002/0111207 A1 8/2002 Lind et al.
2002/0111214 A1 8/2002 Lind et al.
2002/0113369 A1 8/2002 Weingardt
2002/0132661 A1 9/2002 Lind et al.
2002/0132666 A1 9/2002 Lind et al.
2002/0196342 A1 12/2002 Walker et al.
2003/0060257 A1 3/2003 Katz et al.
2003/0060261 A1 3/2003 Katz et al.
2003/0060276 A1 3/2003 Walker et al.
2003/0100371 A1 5/2003 Gatto et al.
2003/0100372 A1 5/2003 Gatto et al.
2003/0125101 A1 7/2003 Campo
2003/0181231 A1 9/2003 Vancura et al.
2003/0190943 A1 10/2003 Walker et al.
2003/0211884 A1 11/2003 Gauselmann
2003/0224854 A1 12/2003 Joao
2004/0014515 A1 1/2004 Tracy et al.
2004/0036212 A1 2/2004 Walker et al.
2004/0038723 A1 2/2004 Schneier et al.
2006/0066051 A1 3/2006 Nicely
2006/0178183 A1 8/2006 Van Asdale
2006/0264255 A1 11/2006 Borissov

OTHER PUBLICATIONS

Electronic Pull Tabs Advertisement by 21st Century Gaming, published prior to 2002.
Instant Winner Advertisement by Williams/WMS Gaming, published prior to 2002.
Lucky Times California Lottery Newsletter published 1996.
Spin Poker Deluxe Video Poker Advertisement, written by Action Gaming, published in 2006.
Spin Poker Game Summary, written by Gambling Guide II Dado, available prior to Jun. 2006.
The Truth About Spin Poker article written by Dan Paymar, published on Nov. 8, 2001.

Hand #1

Hand #2

Hand #3

Hand #4

Hand #5

Hand #6

Hand #7

Hand #8

Hand #9

FIG. 5

| | Poker Hand Seed (120) | Poker Hand Determined by Associated Poker Hand Seed (122) | |
|---|---|---|---|
| 120a | 1,028,113 | 3H JC 6D QH 9S | 122a |
| 120b | 58,449 | AD AH 3C KH QH | 122b |
| | ... | ... | |
| 120c | 2097814389 | QC QH 2D 3S 8C | 122c |
| 120d | 1107371101 | JC JH QH KH 2C | 122d |
| | ... | ... | |
| 120e | 15200681 | 9D 10D JD QD KD | 122e |
| 120f | 220921901 | 10D JD QD KD AD | 122f |

FIG. 7

| Poker Game Outcome | Payout Amount |
|---|---|
| Royal Flush | 250 |
| Straight Flush | 200 |
| Four-of-a-kind | 40 |
| Full House | 7 |
| Flush | 7 |
| Straight | 7 |
| Three-of-a-kind | 3 |
| Two Pair | 1 |
| Pair of Jacks or Better | 1 |
| Lose | 0 |

FIG. 8

| Win Amount | Poker Game Outcomes Used | | | | | | | | | | Distribution | | | | | | | | | |
|---|---|---|---|---|---|---|---|---|---|---|---|---|---|---|---|---|---|---|---|---|
| | Lose (0) | Jacks or Better (1) | Two Pair (1) | Three of a Kind (3) | Straight (7) | Flush (7) | Full House (7) | Four of a Kind (40) | Straight Flush (200) | Royal Flush (250) | Lose (0) | Jacks or Better (1) | Two Pair (1) | Three of a Kind (3) | Straight (7) | Flush (7) | Full House (7) | Four of a Kind (40) | Straight Flush (200) | Royal Flush (250) |
| 0 | Yes | | | | | | | | | | 9 | | | | | | | | | |
| 1 | Yes | Yes | | | | | | | | | 8 | 1 | | | | | | | | |
| 1 | Yes | | Yes | | | | | | | | 8 | | 1 | | | | | | | |
| 2 | Yes | Yes | | | | | | | | | 7 | 2 | | | | | | | | |
| 2 | Yes | | Yes | | | | | | | | 7 | | 2 | | | | | | | |
| 2 | Yes | Yes | Yes | | | | | | | | 7 | 1 | 1 | | | | | | | |
| ... | ... | ... | ... | ... | ... | ... | ... | ... | ... | ... | ... | ... | ... | ... | ... | ... | ... | ... | ... | ... |
| 5 | | Yes | | | | | | | | | 4 | 5 | | | | | | | | |
| 5 | | | Yes | | | | | | | | 4 | | 5 | | | | | | | |
| 5 | Yes | | Yes | Yes | | | | | | | 6 | | 2 | 1 | | | | | | |
| 5 | Yes | Yes | | Yes | | | | | | | 6 | 2 | | 1 | | | | | | |
| 5 | Yes | Yes | Yes | Yes | | | | | | | 6 | 1 | 1 | 1 | | | | | | |
| 5 | | Yes | Yes | | | | | | | | 4 | 4 | 1 | | | | | | | |
| | | | | | | | | | | | 4 | 3 | 2 | | | | | | | |
| | | | | | | | | | | | 4 | 2 | 3 | | | | | | | |
| | | | | | | | | | | | 4 | 1 | 4 | | | | | | | |
| ... | ... | ... | ... | ... | ... | ... | ... | ... | ... | ... | ... | ... | ... | ... | ... | ... | ... | ... | ... | ... |
| 7 | Yes | | | | Yes | | | | | | 8 | | | | 1 | | | | | |
| 7 | Yes | | | | | Yes | | | | | 8 | | | | | 1 | | | | |
| 7 | Yes | | | | | | Yes | | | | 8 | | | | | | 1 | | | |
| 7 | | Yes | | Yes | | | | | | | 4 | 4 | | 1 | | | | | | |
| 7 | | | Yes | Yes | | | | | | | 4 | | 4 | 1 | | | | | | |
| 7 | | Yes | Yes | Yes | | | | | | | 4 | 2 | 2 | 1 | | | | | | |
| | | | | | | | | | | | 4 | 1 | 3 | 1 | | | | | | |
| | | | | | | | | | | | 4 | 3 | 1 | 1 | | | | | | |
| 7 | Yes | Yes | | Yes | | | | | | | 6 | 1 | | 2 | | | | | | |
| 7 | Yes | | Yes | Yes | | | | | | | 6 | | 1 | 2 | | | | | | |
| ... | ... | ... | ... | ... | ... | ... | ... | ... | ... | ... | ... | ... | ... | ... | ... | ... | ... | ... | ... | ... |
| 35 | | | | | | Yes | | | | | 4 | | | | | 5 | | | | |
| ... | ... | ... | ... | ... | ... | ... | ... | ... | ... | ... | ... | ... | ... | ... | ... | ... | ... | ... | ... | ... |
| 87 | | Yes | | Yes | | | | Yes | | | 4 | 1 | | 2 | | | | 2 | | |
| 87 | | | Yes | Yes | | | | Yes | | | 4 | | 1 | 2 | | | | 2 | | |
| 1800 | | | | | | | | | Yes | | | | | | | | | | 9 | |
| 2250 | | | | | | | | | | Yes | | | | | | | | | | 9 |

MULTI-SPIN POKER GAMING SYSTEM WITH PREDETERMINED GAME OUTCOMES

PRIORITY CLAIM

This application is a non-provisional application of, claims priority to and the benefit of U.S. Provisional Patent Application Ser. No. 60/805,293, filed on Jun. 20, 2006, the entire contents of which are incorporated herein.

CROSS-REFERENCE TO RELATED APPLICATIONS

This application relates to the following co-pending commonly owned patent applications: "GAMING DEVICE INCLUDING OUTCOME POOLS FOR PROVIDING GAME OUTCOMES," Ser. No. 10/261,744; "CENTRAL DETERMINATION GAMING SYSTEM WHERE THE SAME SEED IS USED TO GENERATE THE OUTCOMES FOR A PRIMARY GAME AND A SECONDARY GAME," Ser. No. 10/371,958; "CENTRAL DETERMINATION GAMING SYSTEM WHICH PROVIDES A PLAYER A CHOICE IN OUTCOMES," Ser. No. 10/442,318; "CENTRAL DETERMINATION GAMING SYSTEM WITH A GAME OUTCOME GENERATED BY A GAMING TERMINAL AND APPROVED BY A CENTRAL CONTROLLER," Ser. No. 10/383,423; "CENTRAL DETERMINATION GAMING SYSTEM WITH A GAMING TERMINAL ASSISTING THE CENTRAL CONTROLLER IN THE GENERATION OF A GAME OUTCOME," Ser. No. 10/431,755, "CENTRAL DETERMINATION GAMING SYSTEM WITH A KENO GAME," Ser. No. 10/601,482; "GAMING DEVICE HAVING AN INTERACTIVE POKER GAME WITH PREDETERMINED OUTCOMES," Ser. No. 10/934,258; "CENTRAL DETERMINATION POKER GAME," Ser. No. 10/945,642; "GAMING DEVICE HAVING A PREDETERMINED RESULT POKER GAME," Ser. No. 11/031,663; "CENTRAL DETERMINATION OFFER AND ACCEPTANCE GAME WITH MULTIPLIER," Ser. No. 11/048,220; "APPARATUS AND METHOD FOR GENERATING A POOL OF SEEDS FOR A CENTRAL DETERMINATION GAMING SYSTEM," Ser. No. 11/046,354; "APPARATUS AND METHOD FOR GENERATING A POOL OF SEEDS FOR A CENTRAL DETERMINATION GAMING SYSTEM," Ser. No. 11/071,372; "MULTI-PLAY POKER GAMING SYSTEM WITH PREDETERMINED GAME OUTCOMES, Ser. No. 60/709,959; "CENTRAL DETERMINATION GAMING SYSTEM WITH A CENTRAL CONTROLLER PROVIDING A GAME OUTCOME AND A GAMING TERMINAL DETERMINING A PRESENTATION OF THE PROVIDED GAME OUTCOME," Ser. No. 11/303,585; "METHOD FOR DISPLAYING AN INTERACTIVE GAME HAVING A PREDETERMINED OUTCOME," Ser. No. 10/829,578; "METHOD FOR DISPLAYING AN INTERACTIVE GAME HAVING A PREDETERMINED OUTCOME," Ser. No. 10/846,448; "METHOD FOR DISPLAYING AN INTERACTIVE GAME HAVING A PREDETERMINED OUTCOME," Ser. No. 10/864,784; and "STUD BINGO," Ser. No. 11/031,048.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

The present disclosure relates in general to a multi-spin poker gaming system which provides the player a predetermined game outcome.

The majority of the contemporary wagering gaming devices or gaming terminals, such as slot machines or poker games, randomly generate awards and other outcomes. Such gaming terminals typically include a relatively low probability associated with obtaining the highest award, relatively medium probabilities associated with obtaining medium range awards and relatively higher probabilities associated with obtaining low range awards. These gaming terminals also include probabilities associated with obtaining losses or no award at all. The probabilities of obtaining the awards and the amount of the awards determine the average expected pay out percentage of these wagering gaming terminals. Because each of the outcomes of these gaming terminals are completely individually and independently randomly determined, there is no certainty that a player will ever obtain any particular award. No matter how many times a player plays the game, since the gaming terminal generates each of the outcomes randomly or completely based upon a probability calculation, there is no certainty that the game will ever provide the player with a rare outcome, such as a jackpot award, or any other specific value for that matter. On the other hand, due to the random determination, the gaming terminal can provide the rare outcomes, such as jackpot awards, numerous times in a small number of plays.

For example, a probability-based $1 poker machine gaming terminal may be programmed to payback, on average, 95% of all wagers placed with a 1% chance of generating a $10 win outcome, a 5% chance of generating a $5 win outcome, a 10% chance of generating a $2 win outcome, a 40% chance of generating a $1 win outcome and a 44% chance of generating a $0 loss outcome. However, when one hundred game outcomes are generated by the probability-based poker machine gaming terminal, the actual payback may be 137% of all wagers placed and the actual generated outcomes may be six $10 win outcomes, one $5 win outcome, eighteen $2 win outcomes, thirty-six $1 win outcomes and thirty-nine $0 loss outcomes.

This uncertainty is faced by players and casinos or other gaming establishments. For example, certain casinos prefer that a relatively high number of players hit low awards while a relatively low number of players hit high awards. When players hit high awards periodically, casinos can attract more players, because of the positive publicity large wins generate. By using desired payback percentages or probabilities, the casinos can also expect to make a certain level of profit. The random determinations can, however, unexpectedly cause casinos to suffer a loss or, on the other hand, to reap a larger than expected profit in the short run and lose business in the long run due to a reputation for only paying out low awards.

Regulatory bodies in certain jurisdictions do not permit the use of probability-based gaming terminals in part for these reasons. These regulatory bodies permit the use of wagering gaming terminals which are guaranteed to provide certain or definite awards, so that, for example, a certain number of wins is guaranteed and the overall amount paid back to players is guaranteed. That is, the actual payback percentage is fixed and not an average expected amount. One type of gaming terminal which complies with this requirement is an instant-type lottery gaming terminal. An instant-type lottery gaming terminal includes a finite pool or set of electronic tickets with each electronic ticket assigned to a predetermined outcome. Alternatively, each electronic ticket could be assigned to a random number or game play seed which is deterministic of a predetermined outcome. In this embodiment, the gaming terminal utilizes the random number or game play seed in a selected deterministic random number generating algorithm to generate random numbers that the gaming terminal then uses to determine and provide the predetermined outcome. In an instant-type lottery gaming terminal, as the predetermined outcome for each electronic ticket is revealed to a player on the gaming terminal, the ticket is removed (i.e., flagged as used) from the finite pool or set of electronic tickets. Once removed from the pool or set, a ticket cannot be used again to determine another game outcome. This type of gaming terminal provides players with all of the available outcomes over the course of the play cycle and guarantees the actual wins and losses.

Since an instant-type lottery gaming machine has a finite pool of predetermined win/loss outcomes, it is possible to configure the pool to specific conditions or criteria requested by the casino or gaming establishment. An example of these conditions or criteria are the number of tickets included in the pool and the exact payback percentage or payback sum for the pool as a whole. The payback percentage or sum represents the guaranteed payout for the entire pool of predetermined outcomes. Other examples of conditions or criteria are what prizes will be awarded and the frequency of winning outcome tickets amongst the total number of tickets for the pool. For example, if a predetermined pool includes twenty $1 tickets and the pool has a payback sum of $10, then the pool might consist of one $5 win outcome, one $2 win outcome, three $1 win outcomes and fifteen $0 loss outcomes and may be represented as the following outcomes: 5, 2, 1, 1, 1, 1, 0, 0, 0, 0, 0, 0, 0, 0, 0, 0, 0, 0, 0, 0, 0, 0. It should be appreciated that the above described pool of twenty tickets is for illustration purposes only and a pool could include any suitable desired number of tickets including a large number such as one million or more.

It should be appreciated that even though a pool may contain more than one of the same game outcome (i.e., the loss or the win and if a win, the value), the presentation to the player (such as the cards dealt or drawn in the case of simulated card games) is preferably varied for each sequential game outcome. For example, in the twenty ticket pool described above, while three game outcomes may each determine a win game outcome with a value of $1, in a poker game machine each game outcome will be preferably presented to the player as one of a plurality of different card combinations that all yield the same $1 win outcome.

Central determination gaming systems are also generally known. A central determination gaming system provides a plurality of individual gaming terminals, located in a gaming establishment, such as a casino, coupled by one or more communication links, to a central processor or controller. When a player plays a game on one of the gaming terminals, a game outcome is randomly generated based on probability data by the central controller. The generated game outcome and how the game outcome is to be presented or displayed to the player are communicated from the central controller to the individual gaming terminal and then provided to the player. It should be appreciated that one central processor may continuously run hundreds or thousands of individual gaming terminals at once. Additionally, each individual gaming terminal may include a plurality of different types of games played at a plurality of different denominations.

In order to comply with the above mentioned regulatory rules that do not permit the use of probability-based gaming terminals, central determination gaming systems have been implemented wherein the central system maintains one or more predetermined pools or sets of game outcomes. Each game outcome in each set or pool includes a game outcome component (i.e., a win, a loss, a secondary game trigger or other suitable outcome) with an associated value or payout amount, if any, and a game presentation component (i.e., how the game outcome is displayed or presented to the player). In these systems, when a player makes a wager on one of the gaming devices, the central system independently selects a game outcome from a set or pool of game outcomes and flags or marks the selected game outcome as used. Once a game outcome is flagged as used, it is prevented from further selection from the set or pool and cannot be selected by the central controller upon another wager. The selected game outcome is communicated to the individual gaming terminal. The individual gaming terminal displays or presents the game presentation component and provides the player the game outcome component with the associated value, if any, for the selected game outcome. Additionally, certain central determination gaming systems have also been implemented wherein the central system maintains one or more predetermined pools or sets of random number or game outcome seeds.

Central production or control can assist a casino or other entity in maintaining appropriate records, controlling gaming, reducing and preventing cheating or electronic or other errors, reducing or eliminating win-loss volatility and the like. However, it should be appreciated that some existing central determination gaming systems involve minimal to no player interaction other than initiating a game play at a gaming terminal. That is, similar to an instant type lottery game, the central controller selects a game outcome from the pool and the selected game outcome is provided to the player with the player unable to influence the provided game outcome. Therefore, a need exists for central determination gaming systems that provide an increased level of player interaction while still providing a predetermined game outcome to a player.

As described above, in addition to central determination gaming systems, other known gaming devices are operable to provide a player a predetermined outcome. In these gaming devices, rather than receiving an outcome from a central controller, the gaming device stores a plurality of predetermined outcomes in a memory device. Upon a player initiating a game at the gaming device, the predetermined outcome which will ultimately be provided to the player is selected and flagged or marked as used. The gaming device then proceeds with one or more game sequences and upon the conclusion of the game sequences, the selected predetermined outcome is provided to the player. In another embodiment, a predetermined game outcome is determined based on the results of a bingo or keno game. In this embodiment, a plurality of individual gaming device each utilizes one or more bingo or keno games to determine the predetermined game outcome which will be provided to the player for any game played at that gaming device.

Poker games such as draw poker games are also well known. In a typical draw poker game, a gaming device initially deals five cards all face up from a conventional virtual deck of fifty-two playing cards. The gaming device enables the player to select the cards, if any, to hold via one or more input devices, such as pressing related hold buttons or via the touch screen. The player then presses the deal button and the gaming device removes each of any unwanted or discarded cards from the display. The gaming device replaces each removed playing card with another card dealt from the remaining cards in the deck. This results in a five-card hand which the gaming device evaluates or compares to a payout table which utilizes conventional poker hand rankings to determine the winning hands. The gaming device provides the player with an award, if any, based on a winning hand and the amount of credits the player wagered on the hand.

Another known poker game includes multiple hands of poker played simultaneously. In one such game, the gaming device generates or deals a plurality of hands of cards, such as three, five, ten, fifty or one-hundred individual hands of cards. In alternative versions, (i) the gaming device initially deals or displays the same playing cards for each of the individual hands of cards, or (ii) the gaming device only deals or displays playing cards for a primary hand and the remaining simultaneously played hands do not initially display any individual playing cards. The gaming device enables the player to choose the playing cards to hold, if any, in a primary hand. The held cards in the primary hand are also held in each of the remaining hands of cards. After holding zero, one or more cards in the primary hand (and thus holding zero, one or more of the same cards in each of the remaining hands), the gaming device removes the remaining non-held playing cards from each of the hands of cards. For each hand of cards, the gaming device independently deals or generates a replacement card for each removed, non-held playing card, wherein each hand of cards is associated with its own deck of cards. The gaming device compares each individual poker hand, hand by hand, to a payout table which utilizes conventional poker hand rankings to determine the award, if any, associated with each of the individual poker hands. The gaming device determines a total award based on any of the determined awards and provides the determined total award to the player.

In another type of poker game with multiple hands played simultaneously, one or more cards are included in a plurality of poker hands. In this poker game, known as spin poker or hand-spin poker, a plurality of playing cards are generated or dealt in a plurality of playing card positions on a plurality of virtual reels. In one spin poker gaming device, each playing card position includes a separate reel, such as a unisymbol reel. In this spin poker gaming device, the reel strip associated with each reel includes each of the playing cards that may be dealt to a player in a poker game. A plurality of paylines run through the plurality of playing card positions, wherein each wagered on payline represents an individual poker hand played by the player. That is, similar to how a symbol generated on a reel may be simultaneously intersected by a plurality of different overlapping paylines and thus be included in a plurality of symbol combinations, a playing card generated at a playing card position in a spin poker game may be simultaneously intersected by a plurality of overlapping paylines and thus be included in a plurality of individual poker hands. For example, as seen in FIGS. 1 and 2, even though only fifteen playing cards are dealt or generated on the reels, the gaming device utilizes these fifteen playing cards to form nine individual poker hands of five playing cards each. In this example: the playing cards of the seven of clubs, the jack of spades, the queen of diamonds, the six of hearts and the nine of diamonds generated along a first payline (i.e., payline #1 of FIG. 1) form a first individual poker hand (i.e., Hand #1 of FIG. 2), the playing cards of the seven of clubs, the two of diamonds, the four of hearts, the five of spades and the nine of diamonds generated along a second payline (i.e., payline #2 of FIG. 1) form a second individual poker hand (i.e., Hand #2 of FIG. 2) and the playing cards of the seven of clubs, the two of diamonds, the seven of hearts, the king of diamonds and the ten of clubs generated along a third payline (i.e., payline #3 of FIG. 1) form a third individual poker hand (i.e., Hand #3 of FIG. 2).

It should be appreciated that since in a spin-poker game, a plurality of playing cards are generated in a plurality of playing card positions on a plurality of reels and a plurality of overlapping paylines run through the plurality of playing card positions to form a plurality of individual poker hands, which playing cards are generated in which playing card positions determines the total payout amount for all of the played poker hands. That is, if even one playing card generated in one playing card position is changed, depending on the number of paylines which overlap and intersect this one playing card position, at least one and most likely a plurality of poker hands are changed to reflect this one changed playing card. For example, as seen in FIGS. 1 and 2, if the seven of hearts playing card generated in the middle playing card position of the third reel column is changed to the ace of clubs playing card, then the poker hand formed along payline #3 no longer results in a pair of sevens poker hand and the poker hands formed along paylines #4 and #7 each now result in winning, pair of aces poker hands.

In one embodiment of such a spin poker game, the gaming device deals or generates a plurality of cards in a plurality of playing card positions along a primary payline to form a primary poker hand. In one embodiment, the gaming device deals or generates a plurality of playing cards in a plurality of playing card positions along a plurality of additional paylines to form zero, one or more additional poker hands. In these embodiments, the gaming device enables the player to choose the playing cards to hold, if any, in the primary hand. The gaming device duplicates each held playing card in the primary poker hand in all of the playing card positions of the same reel column as the held playing card and thus, each held playing card in the primary hand is also held in each of the remaining poker hands. After holding zero, one or more playing cards in the primary hand (and thus holding zero, one or more of the same playing cards in each of the remaining hands of cards), the gaming device removes the remaining non-held playing cards from the primary poker hand. For each non-held playing card, the gaming device independently generates, via the reels for each vacant playing card position, a replacement playing card. As described above, the held playing cards and the replacement playing cards form a plurality of individual poker hands. The gaming device compares each individual poker hand, hand by hand, to a payout table which utilizes conventional poker hand rankings to determine the award, if any, associated with each of the individual poker hands. The gaming device determines a total award based on any of the determined awards and provides the determined total award to the player.

Some known gaming devices have attempted to provide a poker game wherein the outcome is predetermined. In these known games, a player is shown a first group of cards and invited to select one or more cards to be discarded. The player is then shown a second group of cards and a payoff is provided if the second group of cards is a winning hand according to a predetermined payout schedule. In these games, the initial group of cards and the second group of cards are both predetermined prior to the time the game is played. For this reason, there can often be an inconsistency between the player's selection of cards that are to be discarded and the transition from the initial group of cards to the second group of cards. This inconsistency can interfere with the desired simulation of a card game which provides a predetermined outcome.

One known gaming device described in U.S. Pat. No. 6,729,961 includes a poker game wherein an initial hand of cards is displayed to a player. The player designates which of the initial hand of cards are to be held and which are to be discarded and the game displays an intermediate hand generated in accordance with the player-specified designations. In this gaming device, a second hand which is associated with a value equal to the value associated with the predetermined game outcome is shown and in those cases where the player-specified designation (Hold/Discard) is inconsistent with a transition from the intermediate hand to the second hand, an entertaining display is shown and the predetermined game outcome is provided to the player.

Additionally, if there is an inconsistency between the award provided for the player's second hand which is based on the player's selections of cards to be discarded and the award associated with the predetermined outcome, other known gaming devices employ a mystery win card to increase the provided win amount up to the win amount associated with the predetermined game outcome. In other known gaming devices, any inconsistency between the award provided for the player's second hand which is based on the player's selections of cards to be discarded and the award associated with the predetermined outcome is held in an escrow or progressive pool to be subsequently provided to a player.

It should be appreciated that to provide a predetermined game outcome to a player that is simultaneously playing a plurality of poker hands, the predetermined game outcome must be divided over one or more of the simultaneously played poker hands while taking into account the different amounts wagered on the different simultaneously played poker hands. That is, the gaming device must find a distribution of outcomes which adds up to the award amount or value of the predetermined game outcome. For example, in a ten-play poker gaming device (i.e., a gaming device which enables a player to simultaneously player ten poker hands), there must be exactly ten individual payout amounts which each match a payout from the applicable paytable of poker game outcomes, that all add up to the award or value of the predetermined game outcome. However, a ten-play poker game with ten possible payout amounts includes 92,378 different possible distributions of poker game outcomes. For example, using only the payout values of 0, 1, 2, 3, 4, 6, 9, 25, 50 and 250, these ten individual payout values may be combined (using one or more distributions) to add up to the following values:

747: There is exactly 1 distribution:
250, 250, 50, 50, 50, 50, 25, 9, 9, 4
748: There is no distribution.
749: There is exactly 1 distribution:
250, 250, 50, 50, 50, 50, 25, 9, 9, 6
750: There are 5 distributions:
250, 250, 250, 0, 0, 0, 0, 0, 0, 0
250, 250, 50, 50, 50, 50, 50, 0, 0, 0
250, 250, 50, 50, 50, 50, 25, 25, 0, 0
250, 250, 50, 50, 50, 25, 25, 25, 25, 0
250, 250, 50, 50, 25, 25, 25, 25, 25, 25
993: There is 1 distribution:
250, 250, 250, 50, 50, 50, 50, 25, 9, 9
994-999: There is no distribution.
1000: There are 4 distributions:
250, 250, 250, 250, 0, 0, 0, 0, 0, 0
250, 250, 250, 50, 50, 50, 50, 50, 0, 0
250, 250, 250, 50, 50, 50, 50, 25, 25, 0
250, 250, 250, 50, 50, 50, 25, 25, 25, 25

This problem is only magnified if more poker hands are simultaneously played. For example, a twenty-play poker game with ten possible payout amounts includes 10,015,005 possible distributions of poker game outcomes and a fifty-play poker game with ten possible payout amounts includes 12,565,671,261 possible distributions of poker game outcomes. It should be appreciated that since the gaming device enables the player to play a variable number of simultaneously played poker hands (i.e., the player may play one to ten poker hands in a ten-play poker game), each different number of played poker hands includes a different number of possible distributions of poker game outcomes. For example, if a player is simultaneously playing seven poker hands in a ten-play poker game, the gaming device must utilize a different set of possible distributions than if the player were simultaneously playing six or eight poker hands in the ten-play poker game. It should be further appreciated that each set of possible distributions is specific to the number of possible payout amounts and the value of each possible payout amount, wherein if the number of possible payout amounts or the value of each possible payout amount changes, so may the set of possible distributions.

Moreover, in a spin poker gaming device, once a distribution has been selected, the gaming device must still determine which cards to draw to complete that distribution. If no cards are held, there are 982,869,376,029,609,100,032,000 ways to draw 15 cards. If 1 card is held, there are 25,028,504,609,870, 361,600 ways to draw 12 cards. If 2 cards are held, there are 494,478,121,737,600 ways to draw 9 cards. If 3 cards are held, there are 7,731,052,560. If 4 cards are held, there are 97,290 ways to draw 3 cards. Accordingly, it is not practical for a gaming device to try all possible distributions to determine an appropriate distribution of poker game outcomes or to determine that no solution or appropriate distribution exists. Therefore, since the gaming device must react quickly to the player's choice, a need exists for a gaming system and method to quickly select an appropriate distribution or determine that no solution exists.

Accordingly, many challenges exist in providing a predetermined game outcome to a player simultaneously playing a plurality of poker hands. One challenge which must be overcome in providing a predetermined game outcome to a player that is simultaneously playing multiple hands of poker is determining which playing cards to draw in each of the simultaneously played poker hands to produce a total payout amount for all of the played poker hands equal to the value or payout associated with the predetermined game outcome. After determining the payout associated with the predetermined game outcome, the gaming device must determine (based on the playing cards the player designated to hold and discard as well as the amount wagered on each of the simultaneously played poker hands) one or more distributions of poker game outcomes for the simultaneously played poker hands which would result in a total payout for all of the simultaneously played poker hands equaling the payout associated with the predetermined game outcome.

Additionally, in providing a spin-poker game with a predetermined game outcome, not only must the gaming device determine one or more distributions of poker game outcomes for the simultaneously played poker hands which would result in a total payout for all of the simultaneously played poker hands equaling the payout associated with the predetermined game outcome, the gaming device must also determine which playing cards to generate in which playing card positions to result in one of the determined poker game outcome distributions. As described above, since at least one playing card in at least one playing card position is included in a plurality of individual poker hands (based on the number of overlapping paylines which run through this one playing card position), determining which playing card to generate in even one playing card position influences a plurality of the individual poker hands played. As at least one playing card generated in at least one playing card position affects a plurality of the individually played poker hands, which playing cards are generated in which playing card positions thus affects if the total payout for all of the individually played poker hands equals the predetermined game outcome. Accordingly, the greater the number of wagered on, overlapping paylines, the greater the likelihood that at least one playing card generated in at least one playing card position will affect a plurality of simultaneously played poker hands and the lower the likelihood that the gaming device will be able to generate the appropriate playing cards in the appropriate playing card positions to form a plurality of poker hands with a total payout equal to a predetermined game outcome value. Thus, even if a gaming device determines an appropriate distribution of poker game outcomes for the simultaneously played poker hands which results in a total payout for all of the simultaneously played poker hands equaling the payout associated with the predetermined game outcome, if the gaming device is unable to generate the appropriate playing cards in the appropriate playing card positions to form a plurality of poker hands which form the determined poker game outcome distribution, the predetermined game outcome cannot be provided to the player without causing one or more of the inconsistencies described above.

Therefore, a need exists for a central determination gaming system wherein a player may play a plurality of simultaneous hands in a spin-poker game and a predetermined game outcome is provided to the player.

SUMMARY

The present disclosure relates to a central determination gaming system which provides a multi-hand spin poker game wherein the player is provided a predetermined game outcome.

In one embodiment, prior to a player initiating game play of a multi-hand spin poker game at a gaming device, one or more databases or tables are generated. A first database or look-up table includes a plurality of different payout amounts for the multi-hand spin poker game (i.e., a payout of zero to a maximum possible payout amount) and the distributions of possible poker game outcomes which correlate to each of the payout amounts. The distribution of possible poker game outcomes for this database is based on an applicable paytable and the number of simultaneously played poker hands. For example, assuming nine poker hands will be simultaneously played and according to an applicable paytable, the payout amount associated with a poker game outcome of a straight-flush is two-hundred, this database may include an entry that for the payout amount of one-thousand-eight-hundred, the only distribution of poker game outcomes which corresponds to that payout amount is nine straight-flush poker hand outcomes (i.e., nine straight-flush poker hands which payout two-hundred each equals the total payout amount of one-thousand-eight-hundred).

A second database or look-up table includes a plurality of different poker hand seeds (which are each deterministic of an initial hand of playing cards and a payout amount) and zero, one or more solutions or solution screens which are associated with each poker hand seed. For each poker hand seed, the different solutions are based on which of the playing cards in the deterministic initial poker hand are held, the payout amount associated with the poker hand seed and which playing cards to display in which playing card positions are necessary to form the poker hands that are associated with payouts that total the payout amount associated with the poker hand seed.

In one embodiment, a player at a gaming device initiates game play of the multi-hand spin poker game by wagering on one or more paylines. Upon initiation of the multi-hand spin poker game, a predetermined game outcome or predetermined game outcome value is selected or otherwise communicated to the gaming device. The predetermined game outcome value correlates to one or more distributions of poker game outcomes (determined via the first database) which are associated with individual payout amounts that total or equal the predetermined game outcome value.

In one embodiment, the gaming device selects a poker hand seed that is associated with a payout equal to the predetermined game outcome value. The gaming device shuffles a deck of playing cards (using one or more random number sequencers that are seeded with the selected poker hand seed) and generates or displays along a designated or first payline a designated number of playing cards from the shuffled deck. The generated or displayed playing cards form the initial poker hand. In addition to the initial displayed poker hand, in one embodiment, the gaming device simultaneously displays one or more secondary poker hands along one or more secondary paylines, wherein each simultaneously displayed secondary poker hand includes equivalent playing cards as the initial poker hand.

In one embodiment, the gaming device enables a player to select one or more of the generated playing cards from the initial poker hand to hold or discard. In this embodiment, the gaming device holds any playing cards held in the initial poker hand in one, more or each of the plurality of simultaneously displayed secondary poker hands. That is, for each held playing card, the gaming device holds or duplicates that held playing card in each playing card position of the same reel column. The gaming device evaluates the set of playing cards selected by the player to hold and determines if, based on the held playing cards and the remaining playing cards in the deck, the appropriate playing cards can be generated in the appropriate playing card positions to result in one of the poker game outcome distributions (from the first database) associated with the selected predetermined game outcome value.

In one embodiment, if the gaming device determines that the appropriate playing cards can be generated in the appropriate playing card positions to result in at least one of the distributions of poker game outcomes (from the first database) which matches at least one of the poker game outcome distributions associated with selected predetermined game outcome value, the gaming device generates such determined playing cards in the appropriate playing card positions to form a plurality of final poker hands along the plurality of paylines. The gaming device analyzes each of the final poker hands generated along each wagered on payline to determine, based on the applicable paytable, the payout associated with each poker hand. The gaming device provides a total combined payout of each of the analyzed poker hands to the player, wherein the payouts associated with each of the provided final poker hands generated along each wagered on payline add up to the selected predetermined game outcome value.

In one embodiment, if the gaming device is unable to determine the appropriate playing cards to generate in the appropriate playing card positions to result in at least one of the distributions of poker game outcomes (from the first database) which matches at least one of the poker game outcome distributions associated with the selected predetermined game outcome value in a set amount of time (or in a set number of attempts), the gaming device attempts to find or determine a stored solution (from the second database) for the selected poker game outcome seed that is compatible with the playing cards the player designated to hold and the playing cards the player designated to discard. It should be appreciated that one embodiment of the gaming system disclosed herein also provides that an algorithm searches for a solution using a deterministic random number generator, but only searches for a set length of time or for a set or limited number of attempts. If the algorithm fails to find a solution in the set length of time, the gaming system utilizes a table of solutions to look up an applicable solution. Such a blend of the utilization of one or more algorithms and the utilization of one or more data tables to produce a predetermined game outcome substantially increases the capabilities of the gaming system disclosed herein.

In one such embodiment, an applicable solution provides a total payout for all of the simultaneously played poker hands generated on all of the wagered on paylines that equals the predetermined game outcome value. If the gaming device finds a stored solution which corresponds with the playing cards held by the player and a total payout amount of each simultaneously played poker hand generated on all of the wagered on paylines equal to the selected predetermined game outcome value, the gaming device displays to the player the playing cards in the playing card positions associated with the found solution and provides the player the selected predetermined game outcome value.

In one embodiment, if the gaming device is unable to determine the appropriate playing cards to generate in the appropriate playing card positions to result in a distribution of poker game outcomes from the first database which matches at least one of the poker game outcome distributions associated with selected predetermined game outcome and the gaming device is further unable to find a stored solution for the selected poker game outcome seed from the second database that is compatible with the playing cards the player designated to hold and the playing cards the player designated to discard, the gaming device modifies one or more aspects of the played poker game. In one embodiment, the gaming device overrides the player's designation regarding which playing cards to hold and which playing cards to discard and forces the player to follow an alternative holding strategy. In another embodiment, the gaming device replaces one or more of the player's held playing cards with different playing cards. In these embodiments, after modifying one or more aspects of the played poker game, the gaming device repeats the process described above until either determining the appropriate playing cards to generate in the appropriate playing card positions as described above, or until an applicable solution is found and displayed to the player as described above.

It should be appreciated that even if the gaming device must modify one or more aspects of the played poker game, the gaming device will ultimately generate one or more poker hands along one or more wagered on paylines which result in a total payout such that the gaming device provides the player the selected predetermined game outcome value.

Generation of Distribution Table

In one embodiment, as mentioned above, prior to the play of any of the multi-play spin poker games, the gaming system determines and stores, a first table or database which includes for each available payout amount (i.e., from zero to the maximum payout), the different configurations or distributions of poker game outcomes which would result in that payout amount. This determination is based on the payout amounts associated with each poker game outcome (as designated by an appropriate paytable) as well as by the number of poker hands simultaneously played. For example, Table 1 below illustrates all of the different configurations of poker game outcomes possible for a nine-play game (wherein an equal amount is wagered on each game played) which would result in a payout amount of eleven.

TABLE 1

| Poker Game Outcomes Used (Payouts of Each Outcome in parentheses) | | | | | | | |
|---|---|---|---|---|---|---|---|
| Win Amount | Lose (0) | Jacks or Better (1) | Two-pair (1) | Three-of-a-kind (3) | Straight (7) | Flush (7) | Full House (7) |
| 11 | 6 | 1 | | 1 | 1 | | |
| 11 | 6 | 1 | | 1 | | 1 | |
| 11 | 6 | 1 | | 1 | | | 1 |
| 11 | 6 | | 1 | 1 | 1 | | |
| 11 | 6 | | 1 | 1 | | 1 | |
| 11 | 6 | | 1 | 1 | | | 1 |
| 11 | | 8 | | 1 | | | |
| 11 | | 7 | 1 | 1 | | | |
| 11 | | 6 | 2 | 1 | | | |
| 11 | | 5 | 3 | 1 | | | |
| 11 | | 4 | 4 | 1 | | | |
| 11 | | 3 | 5 | 1 | | | |
| 11 | | 2 | 6 | 1 | | | |
| 11 | | 1 | 7 | 1 | | | |
| 11 | | | 8 | 1 | | | |
| 11 | 2 | 5 | | 2 | | | |
| 11 | 2 | 4 | 1 | 2 | | | |
| 11 | 2 | 3 | 2 | 2 | | | |
| 11 | 2 | 2 | 3 | 2 | | | |
| 11 | 2 | 1 | 4 | 2 | | | |
| 11 | 2 | | 5 | 2 | | | |
| 11 | 4 | 1 | 1 | 3 | | | |
| 11 | 4 | 2 | | 3 | | | |
| 11 | 4 | | 2 | 3 | | | |
| 11 | 4 | 1 | 3 | | 1 | | |
| 11 | 4 | 1 | 3 | | | 1 | |
| 11 | 4 | 1 | 3 | | | | 1 |
| 11 | 4 | 2 | 2 | | 1 | | |
| 11 | 4 | 2 | 2 | | | 1 | |
| 11 | 4 | 2 | 2 | | | | 1 |
| 11 | 4 | 3 | 1 | | 1 | | |
| 11 | 4 | 3 | 1 | | | 1 | |
| 11 | 4 | 3 | 1 | | | | 1 |
| 11 | 4 | 4 | | | 1 | | |
| 11 | 4 | 4 | | | | 1 | |
| 11 | 4 | 4 | | | | | 1 |
| 11 | 4 | | 4 | | 1 | | |
| 11 | 4 | | 4 | | | 1 | |
| 11 | 4 | | 4 | | | | 1 |

As illustrated in Table 1, the gaming system determines that, based on the payout associated with each possible poker game outcome of the applicable paytable and the number of hands simultaneously played, there are thirty-nine different configurations of poker game outcomes possible which would result in the payout amount of eleven. For example, the combination of six losing outcomes (paying zero credits each), one two-pair poker game outcome (paying one credit), one three-of-a-kind poker game outcome (paying three credits) and one straight poker game outcomes (paying seven credits) would result in a total payout amount of eleven. Additionally, the combination of five jacks-or-better poker game outcome (paying one credit each), three two-pair poker game outcome (paying one credit each) and one three-of-a-kind poker game outcomes (paying three credits) would also result in a total payout amount of eleven.

It should be appreciated that as the above described poker game outcomes configuration determination is dependent on the specific paytable used as well as the number of hands simultaneously played, if the specific paytable used and/or the number of hands simultaneously played changes, any generated distribution table may need to be modified to account for any changes. That is, each different number of simultaneously played poker hands may require a separate distribution table which must be determined and stored for each applicable paytable which may be utilized. Moreover, as the player may wager different amounts on each of the simultaneously played poker hands, such different wager amounts may correspond to different pay tables used for the different simultaneously played poker hands which may each require a separate distribution table to be determined and appropriately stored.

Assigning Payout Amounts with Poker Hand Seeds

In addition to determining one or more applicable distribution tables, in one embodiment the gaming devices determines and stores a second database or look-up table. The second database or look-up table includes a plurality of different poker hand seeds (which, as described below, are each deterministic of an initial hand of playing cards and a payout amount) and zero, one or more solutions or solution screen which are associated with each poker hand seed. For each poker hand seed, the different solutions of this database are based on which of the playing cards in the initial poker hand are held, the payout amount associated with the poker hand seed and which playing cards must be generated in which playing card positions to form the poker hands that are individually associated with payouts that total the payout amount associated with the poker hand seed.

In one embodiment, to create this database, the gaming system or gaming system developer generates or compiles a set or list of random number generator poker hand seeds. Each poker hand seed, when applied to or used by one or more selected deterministic random number generating algorithms, is deterministic of an order of playing cards in a deck of playing cards. It should be appreciated that as the first designated number of ordered playing cards form an initial poker hand, each poker hand seed is thus deterministic of an initial poker hand. The set or list of poker hands seeds include one poker hand seed that is deterministic for each possible poker hand that may be formed utilizing different combinations of the playing cards in a set or deck of playing cards. For example, a first poker hand seed of 13 is deterministic of a first hand that includes the playing cards of the seven of spades, the queen of clubs, the ace of diamonds, the four of spades and the four of clubs, while a second poker hand seed of 25484 is deterministic of a second poker hand that includes the playing cards of the two of spades, the three of spades, the four of spades, the five of spades and the six of spades.

In one embodiment, the generated set or list of poker hand seeds includes only one poker hand seed which is deterministic of each different playing card combination possible. That is, the gaming system generates a poker hand seed, determines the initial poker hand associated with or otherwise determined by the generated poker hand seed and determines if the determined initial poker hand is already included in the list or set of possible poker hands which may be formed based on the different playing cards available. Thus, if the gaming system generates a previously generated poker hand seed, that poker hand seed is not added to the set or list of possible poker hand seeds and the gaming system continues with generating possible poker hand seeds. It should be appreciated that in one embodiment, each different arrangement or order of the same playing cards is considered a different possible poker hand which is associated with a different poker hand seed.

After a set of each possible poker hand seeds is generated, the gaming system selects one of the generated poker hand seeds, shuffles the deck of playing cards (using a random number sequencer that is seeded with the selected poker hand seed) and generates, draws or deals a designated number of playing cards of the shuffled deck to form an initial poker hand. It should be appreciated that given the same poker hand seed, the selected random number sequencer(s) will always produce these same playing cards in the same order to form the same initial poker hand.

For example, if the gaming system selects the first poker hand seed of 13, the gaming system seeds one or more selected random number sequencer(s) with the number 13 to shuffle a deck of playing cards. In this example, the order of the first fourteen playing cards in the shuffled deck is: the seven of spades, the queen of clubs, the ace of diamonds, the four of spades, the four of clubs, the four of diamonds, the two of hearts, a joker, the seven of diamonds, the two of spades, the nine of diamonds, the four of hearts, the seven of hearts and the queen of diamonds. The first five playing cards of the shuffled deck (i.e., the seven of spades, the queen of clubs, the ace of diamonds, the four of spades, and the four of clubs) are the initial poker hand for the selected first poker hand seed of 13. Accordingly, if the gaming system generates or deals the initial poker hand for the selected poker hand seed of 13 along a designated payline of a five-reel column, three playing card positions per reel column hand-spin poker game, the plurality of reels would display:

| | | | | |
|---|---|---|---|---|
| Seven of Spades | Queen of Clubs | Ace of Diamonds | Four of Spades | Four of Clubs |

In one embodiment, the gaming system determines which of these generated playing cards to hold and which of these generated playing cards to discard based on a suitable conventional auto-hold algorithm or strategy. In this embodiment, the gaming system's auto-hold strategy takes an appropriate paytable into account in determining which playing cards to hold and which playing cards to discard for the initial poker hand determined based on the selected poker hand seed. As described above, each held playing card on a reel is also held in each other playing card position of that reel column and thus each playing card is held in one, more or each of a plurality of simultaneously played secondary poker hands. It should be appreciated that since the auto-hold strategy is based on an applicable paytable, any alterations or modifications to the applicable paytable may alter the auto-hold algorithm's recommendation of which playing cards to hold and which playing cards to discard for each generated poker hand.

Applying a suitable auto-hold algorithm to the example described above, the gaming system determines to hold the four of spades and the four of clubs and to discard the seven of spades, queen of clubs and ace of diamonds. Accordingly, if the gaming system held the four of spades and the four of clubs as the fourth playing card and the fifth playing card in each of the plurality of simultaneously played secondary poker hands, the plurality of reels would display:

| | | | | |
|---|---|---|---|---|
| | | | Four of Spades | Four of Clubs |

-continued

| | | |
|---|---|---|
| | Four of Spades | Four of Clubs |
| | Four of Spades | Four of Clubs |

In one embodiment, after determining which playing cards to hold for the poker hand associated with the selected poker hand seed, the gaming system generates, deals or draws a playing card from the shuffled deck for each discarded playing card and for each vacant playing card position in each of the secondary poker hands. The plurality of generated playing cards and any held playing cards form a plurality of poker hands wherein each formed poker hand is based on which playing cards intersect each payline. That is, for a designated payline, the gaming system determines which playing cards intersect or are otherwise generated along the designated payline to determine the individual poker hand formed for that designated payline. It should be appreciated that since a plurality of paylines may intersect or run through the same playing card, one or more playing cards may each be included in a plurality of individual poker hands.

In the example described above, after discarding the appropriate non-held playing cards (i.e., the seven of spades, the queen of clubs and the ace of diamonds), the gaming system generates or deals the next nine cards from the shuffled deck into the remaining unoccupied playing card positions. That is, the gaming system generates or deals playing cards (in order from the shuffled deck) to the three playing card positions left vacant from the three non-held discarded playing cards and the six unoccupied playing card positions from the secondary poker hands. As the next nine playing cards are the four of diamonds, the two of hearts, a joker, the seven of diamonds, the two of spades, the nine of diamonds, the four of hearts, the seven of hearts and the queen of diamonds, the plurality of reels would display:

Solution Screen 1A

| | | | | |
|---|---|---|---|---|
| Four of Diamonds | Seven of Diamonds | Four of Hearts | Four of Spades | Four of Clubs |
| Two of Hearts | Two of Spades | Seven of Hearts | Four of Spades | Four of Clubs |
| Joker | Nine of Diamonds | Queen of Diamonds | Four of Spades | Four of Clubs |

In one embodiment, this solution or solution screen of which playing cards to generate in which playing card positions is associated with the selected poker hand seed and stored for subsequent use. In another embodiment, this solution or solution screen is associated with the selected poker hand seed but not stored for subsequent use. That is, as this solution is associated with the auto-hold strategy, the gaming system can redetermine this solution relatively quickly (i.e., by dealing the playing cards from the shuffled deck into the unoccupied playing card positions) and thus there is no need to store this solution.

After generating or drawing a playing card for each vacant playing card position, the gaming system analyzes each of the poker hands generated along each of the wagered on paylines to determine the payout associated with each poker hand. The gaming system determines a total payout for each of the individual payouts associated with each of the poker hands generated along each of the wagered on paylines. The gaming system associates the determined total combined payout with the selected poker hand seed. It should be appreciated that since a player may wager on a variable number of paylines for each play of the spin poker game disclosed herein, each different number of wagered on paylines may be associated with a different total payout. Thus, a selected poker hand seed may be associated with different payout amounts depending on the number of paylines actively wagered on.

In the above-described example, assuming each of nine paylines were wagered on, the gaming system analyzes these nine poker hands to determine if any of the formed poker hands are associated with a winning playing card combination. In this example, according to an applicable paytable, these nine poker hands are associated with a total combined payout of ninety-eight credits. That is:

| Payline | Playing Cards in Poker Hand | Poker Hand Outcome | Payout |
|---|---|---|---|
| 1 | Four of Diamonds, Two of Spades, Queen of Diamonds, Four of Spades, Four of Clubs | Three-of-a-kind | 3 |
| 2 | Four of Diamonds, Seven of Diamonds, Four of Hearts, Four of Spades, Four of Clubs | Four-of-a-kind | 40 |
| 3 | Four of Diamonds, Seven of Diamonds, Seven of Hearts, Four of Spades, Four of Clubs | Full House | 7 |
| 4 | Two of Hearts, Nine of Diamonds, Seven of Hearts, Four of Spades, Four of Clubs | Loser | 0 |
| 5 | Two of Hearts, Two of Spades, Seven of Hearts, Four of Spades, Four of Clubs | Two-Pair | 1 |
| 6 | Two of Hearts, Seven of Diamonds, Seven of Hearts, Four of Spades, Four of Clubs | Two-Pair | 1 |
| 7 | Joker, Nine of Diamonds, Seven of Hearts, Four of Spades, Four of Clubs | Three-of-a-kind | 3 |
| 8 | Joker, Nine of Diamonds, Queen of Diamonds, Four of Spades, Four of Clubs | Three-of-a-kind | 3 |
| 9 | Joker, Two of Spades, Four of Hearts, Four of Spades, Four of Clubs | Four-of-a-kind | 40 |
| | | | Total: 98 |

Accordingly, the payout of ninety-eight credits is associated with the selected first poker hand seed of 13 if the player wagers on nine paylines.

Determination of Look-Up Solution Table

After determining the payout amount to associate with the selected poker hand seed, the gaming device determines which of the playing cards of the initial poker hand (for the selected poker hand seed) to hold based on one or more intelligent alternative holding strategies. Similar to the auto-hold strategy, the gaming system's intelligent alternative holding strategies take an appropriate paytable into account in determining which playing cards to hold and which playing cards to discard for the generated initial poker hand.

In one embodiment, if no intelligent alternative holding strategies exist for the initial poker hand associated with or generated based on the selected poker hand seed, the gaming system stores or retains the selected poker hand seed. On the other hand, if at least one intelligent alternative holding strategy exists for the initial poker hand associated with the selected poker hand seed, for each of the intelligent alternative holding strategies for the selected poker hand seed, the gaming system attempts to find, based on which playing card are held according to the alternative holding strategy, which playing cards to generate in which playing card positions that will form a plurality of poker hands with a total payout equal to the payout previously associated with that selected poker hand seed. In one embodiment, for each intelligent alternative holding strategy, the gaming system utilizes the stored table of different distributions of poker game outcomes from the first database to access any poker game outcome distributions for the payout amount previously associated with the selected poker hand seed. For each accessed poker game outcome distribution with a payout equal to the payout previously associated with the selected poker hand seed, the gaming system evaluates the set of cards designated as held under the alternative holding strategy and determines if, based on the held playing cards and the remaining playing cards in the shuffled deck, any of the accessed poker game outcome distributions are possible.

In one embodiment, if the gaming system cannot determine any available playing cards to generate in the appropriate playing card positions to result in a poker game outcome distribution with the same payout as the payout previously associated with the selected poker hand seed, the gaming system removes the selected poker hand seed from the set or list of available poker hand seeds. On the other hand, if the gaming system determines one or more available playing cards to generate in the appropriate playing card positions to result in a poker game outcome distribution with the same payout as the payout previously associated with the selected poker hand seed, the gaming system retains the selected poker hand seed in the set or list of available poker hand seeds. That is, if the gaming system determines the appropriate playing cards (from the playing cards remaining in the deck) to generate in the unoccupied or vacant playing card positions, such that the generated playing cards and any held playing cards form a plurality of poker hands with a total combined payout equal to the payout associated with the selected poker hand seed, then the selected poker hand seed is retained or kept in the set of possible poker hand seeds. In one embodiment, the gaming system utilizes playing cards, in order, from the shuffled deck to generate in the vacant playing card positions to form a plurality of poker hands with a total combined payout equal to the payout associated with the selected poker hand seed.

In another embodiment, the gaming system utilizes any playing cards from the shuffled deck to generate in the vacant playing card positions to form a plurality of poker hands with a total combined payout equal to the payout associated with the selected poker hand seed.

In one embodiment, in addition to retaining the selected poker hand seed, the solution of which playing cards to generate in which playing card positions to result in an overall payout equal to the payout associated with the selected poker hand seed is stored. In another embodiment, if the gaming system is unable to determine which playing cards to generate in which playing card positions in a set amount of time (or a set number of attempts), the solution is stored. Accordingly, in this embodiment, if the gaming system determines which playing cards to generate in which playing card positions in a set amount of time (or a set number of attempts), the solution is stored For example, the gaming system determines that for the selected first poker hand seed of 13, one intelligent alternative holding strategy exists. This alternative holding strategy is holding the queen of hearts and the ace of diamonds and discarding the seven of spades, the four of spades and the four of clubs. Accordingly, if the queen of hearts and the ace of diamonds are held as the second playing card and the third playing card in each of the plurality of simultaneously played secondary poker hands (and the remaining playing cards are discarded), the plurality of reels would display:

| | |
|---|---|
| Queen of Clubs | Ace of Diamonds |
| Queen of Clubs | Ace of Diamonds |
| Queen of Clubs | Ace of Diamonds |

For this intelligent alternative holding strategy, the gaming system utilizes the stored poker game outcome distribution table to access the different poker game outcome distributions associated with the payout amount of ninety-eight. It should be appreciated that the gaming system accesses the distributions for the payout amount of ninety-eight because ninety-eight is the payout amount previously associated with the selected poker hand seed of 13. In this example, the distribution table includes fifty-two entries for the payout amount of ninety-eight. A first entry for a payout of ninety-eight requires two four-of-a-kind poker hands, two full house poker hands, one three-of-a-kind poker hand, one two-pair poker hand and three losing poker hands. A second entry for a payout of ninety-eight requires two four-of-a-kind poker hands, one full house poker hand, three three-of-a-kind poker hands, two two-pair poker hands and one losing poker hand.

For each entry with a payout of ninety-eight, the gaming system evaluates the queen of clubs and the ace of diamonds held according to the alternative holding strategy and determines if, based on these held playing cards and the remaining playing cards in the deck, one of the determined poker game outcome distributions is possible. That is, utilizing the held playing cards and the remaining playing cards in the deck, the gaming system attempts to generate playing cards in the nine vacant playing card positions in the secondary poker hands to build a plurality of poker hands with one of the two poker game outcome distributions for the payout of $98 previously associated with the selected poker hand seed of 13. It should be appreciated any suitable manner of providing zero, one or more playing cards to each of the played poker hands may be implemented in the gaming system disclosed herein.

In this case, the gaming system determines that, based on the held queen of clubs and ace of diamonds and the remaining playing cards in the deck, the appropriate playing cards cannot be generated which result in the first poker game outcome distribution with a payout of $98. That is, the gaming system cannot generate playing cards in the appropriate playing card positions to result in two four-of-a-kind poker hands, two full house poker hands, one three-of-a-kind poker hand, one two-pair poker hand and three losing poker hands.

After determining that playing cards cannot be generated in vacant playing card positions to form the poker hands of the first poker game outcome distribution, the gaming system turns to the second entry which results in a payout of ninety-eight. For this entry, the gaming system determines that, based on the held queen of clubs and the ace of diamonds and the remaining playing cards in the deck, the appropriate playing cards can be generated which result in the second poker game outcome distribution with a payout of $98. That is, the gaming system can generate playing cards in the appropriate playing card positions to result in two four-of-a-kind poker hands, one full house poker hand, three three-of-a-kind poker hands, two two-pair poker hands and one losing poker hand. After the determined playing cards are generated and placed in the appropriate playing card positions, a solution or solution screen for holding the queen of clubs and the ace of diamonds would be the plurality of reels would display:

| Solution Screen 1B | | | | |
|---|---|---|---|---|
| Four of Hearts | Queen of Clubs | Ace of Diamonds | Queen of Hearts | Four of Diamonds |
| Queen of Spades | Queen of Clubs | Ace of Diamonds | Five of Hearts | Joker |
| Ace of Hearts | Queen of Clubs | Ace of Diamonds | Ace of Spades | Ace of Clubs |

Accordingly, since the gaming system determined the appropriate playing cards (from the playing cards remaining in the deck) to provide in the unoccupied or vacant playing card positions for at least one alternative holding strategy (wherein the provided playing cards and any held playing cards form a plurality of poker hands with a total combined payout equal to the payout associated with the selected poker hand seed), the selected first poker hand seed of 13 is retained or kept in the set of possible poker hand seeds. Additionally, since the intelligent alternative holding strategy of holding the queen of clubs and the ace of diamonds results in a solution screen with the same payout of $98 as was previously associated with the selected first poker hand seed of 13, the solution for this alternative holding strategy of which playing cards must be generated in which playing card positions to result in an overall payout equal to the payout associated with the selected poker hand seed is stored in a table of solutions associated with the selected first poker hand seed.

In one embodiment, if the gaming system cannot determine a solution for an intelligent alternative holding strategy, the gaming system must modify one or more of the playing cards held according to the intelligent alternative holding strategy such that a plurality of poker hands are formed with a total payout equal to the payout associated with the selected poker hand seed. For example, if an intelligent alternative holding strategy includes holding a designated playing card in each playing card position of a designed reel or reel column, the gaming system may modify one of the playing cards in one of the playing card positions of the designated reel column (and thus modify the playing cards in some, but not all of the plurality of poker hands) to result in a plurality of poker hands are formed with a total payout equal to the payout associated with the selected poker hand seed.

In one embodiment, for each of the intelligent alternative holding strategies for the selected poker hand seed, the gaming system attempts to find a solution (i.e., generate a plurality of playing cards in the vacant playing card positions) to form a plurality of poker hands with a total payout equal to the payout previously associated with that selected poker hand seed as described above. In one embodiment, the gaming system retains or stores one or more determined solutions for each intelligent alternative holding strategies for the selected poker hand seed, wherein the displayed playing cards in their displayed playing card positions form a plurality of poker hands with a total payout equal to the payout previously associated with the selected poker hand seed.

After determining at least one solution for each intelligent alternative holding strategy for the selected poker hand seed, for every other hold strategy the player may employ the gaming system attempts to generate which playing cards to generate in which vacant playing card positions to form a plurality of poker hands with a total payout equal to the payout associated with the selected poker hand seed. In one embodiment, one or more of the these solutions are stored for each alternative hold strategy the player may employ. That is, for every possible hold strategy the player may select, the gaming system attempts to generate and store a solution which includes the playing cards held and any subsequent generated playing cards, wherein the playing cards in their respective playing card positions form a plurality of poker hands with a total payout equal to the payout previously associated with the selected poker hand seed.

In the example described above, after determining a solution for the one intelligent alternative holding strategy, the gaming system attempts to determine a suitable solution for any of the thirty remaining ways to play the initial poker hand. It should be appreciated that the thirty remaining ways to play the initial poker hand are the thirty-two original ways to play the five card poker hand minus the auto-hold strategy way to play and the one intelligent alternative hold strategy way to play discussed above. In this example, the gaming system determines that solutions exist for two of the possible remaining ways to play the initial poker hand associated with the selected poker hand seed of 13. That is, the gaming system determines that if a player holds only the seven of spades (and discards the remaining playing cards in the initial poker hand), a solution exists (as seen in solution screen IC below), wherein the solution includes which playing cards to generate in which playing card positions for form a plurality of poker hands with a total payout equal to the payout previously associated with the selected poker hand seed. The gaming system also determines that if the player holds only the queen of clubs (and discards the remaining playing cards in the initial poker hand) another solution exists (as seen in solution screen ID below), wherein the solution includes which playing cards to generate in which playing card positions to form a plurality of poker hands with a total payout equal to the payout previously associated with the selected poker hand seed.

| Solution Screen 1C | | | | |
|---|---|---|---|---|
| Seven of Spades | Two of Clubs | Two of Hearts | Seven of Diamonds | Three of Diamonds |
| Seven of Spades | Three of Spades | Two of Diamonds | Three of Hearts | Nine of Diamonds |
| Seven of Spades | Seven of Hearts | Three of Clubs | Seven of Clubs | Joker |

| Solution Screen 1D | | | | |
|---|---|---|---|---|
| Seven of Hearts | Queen of Clubs | Queen of Hearts | Nine of Hearts | Nine of Clubs |
| Three of Diamonds | Queen of Clubs | Three of Hearts | Three of Spades | Three of Clubs |

-continued

| Solution Screen 1D | | | | |
|---|---|---|---|---|
| Joker | Queen of Clubs | Seven of Diamonds | Seven of Clubs | Queen of Spades |

In one embodiment, each determined solution is stored in associated with the selected poker hand seed. In another embodiment, the gaming system stores one or more, but not all of the determined solutions associated with the selected poker hand seed. In another embodiment, any other determined solutions which the gaming system can redetermine relatively quickly (i.e., in a set amount of time or in a set number of attempts) are not stored in associated with the selected poker hand seed.

In the example described above, the gaming system determines that solution screen 1A (the auto-hold strategy solution) and solution screen 1C can be redetermined within a set amount of time (or within a set number of attempts) and thus these solutions do not need to be stored in associated with the selected first poker hand seed. On the other hand, the gaming system determines that solution screens 1B and 1D require more computing time to determine (i.e. cannot be determined within a set amount of time or a set number of attempts) and thus these solutions are stored in association with the selected first poker hand seed.

After determining the payout associated with the selected poker hand seed and determining solutions for any intelligent holding strategies a player may employ, the gaming system determines if each of the poker hand seeds in the generated set are associated with a payout and zero, one or more solutions. If not all of the generated poker hands seeds are each associated with a payout, the gaming system selects another poker hand seed, shuffles a deck based on the selected poker hand seed and proceeds as described above. If each of the poker hand seeds in the generated set are associated with a payout amount, the second database or look-up table is complete with a plurality of different poker hand seeds and zero, one or more solutions which are associated with each poker hand seed.

Game Play

After determining the payout to associate with each generated poker hand seed, the gaming system is adapted for game play of a multi-play spin poker game. In one embodiment, a player selects a number of paylines to wager on (i.e., a number of simultaneous poker hands to play) from one payline (i.e., one poker hand) to a designated number of paylines (i.e., a designated number of poker hands)) and an amount to wager on each payline (or simultaneously played hand). In this embodiment, upon a player making such a wager, a predetermined game outcome or a predetermined game outcome value is selected. The selected predetermined game outcome represents the outcome which will ultimately be provided to the player. It should be appreciated that the selected predetermined game outcome valve must be provided to the player over the selected number of simultaneously played poker hands while taking into account the applicable paytable, the amount wagered on each of the simultaneously played poker hands on the plurality of paylines.

In one embodiment, the predetermined game outcomes are stored in a central controller. In this embodiment, upon a player initiating game play at the gaming device, the initiated gaming device communicates a game outcome request to the central server or controller. Upon receiving the game outcome request, the central controller independently selects one of the game outcomes from a set or pool of game outcomes and flags or marks the selected game outcome as used. Once a game outcome is flagged as used, it is prevented from further selection from the set or pool and cannot be selected by the central controller upon another wager. The selected game outcome is communicated to the individual gaming device to be utilized in the initiated multi-play spin poker game. In another embodiment, the predetermined game outcome is stored in a memory device of the gaming device. In this embodiment, the gaming device selects a game outcome from a set or pool of stored game outcomes and flags the selected game outcome as used.

In one embodiment, each predetermined game outcome or predetermined game outcome value includes an outcome component (such as a win, a lose, a secondary game triggering or other suitable outcome) which is associated with a value or payout amount, if any. For example, a predetermined game outcome of win $98 is selected.

In one embodiment, after a predetermined game outcome value is selected, the gaming system selects a poker hand seed for the selected predetermined game outcome value. In one embodiment, the gaming system selects a poker hand seed for the selected predetermined game outcome value based on the payout associated with each poker hand seed. That is, the payout previously associated with the selected poker hand seed must match the selected predetermined game outcome value. For example, for the selected predetermined game outcome of win $98, the gaming system selects the first poker hand seed of 13 which, as described above, is associated with a payout of $98. The selected poker hand seed is deterministic of a plurality of playing cards.

In different embodiments, if more than one poker hand seed is associated with a payout equal to the selected predetermined game outcome value, the gaming system randomly selects one of these poker hand seeds. In one embodiment, the central controller selects a poker hand seed for the predetermined game outcome value and communicates the selected predetermined game outcome value and the selected poker hand seed to the gaming device. In another embodiment, the gaming device selects a poker hand seed for the predetermined game outcome value communicated from the central controller.

In one embodiment, the gaming device shuffles a deck of playing cards (using a random number sequencer that is seeded with the selected poker hand seed, such as seen in U.S. Pat. No. 6,533,664). For example, for the selected first poker hand seed of 13, the gaming device seeds one or more selected random number sequencer(s) with the number 13 to shuffle the deck of playing cards. As described above, the order of the first fourteen playing cards in a deck shuffled with the selected poker hand seed of 13 is: the seven of spades, the queen of clubs, the ace of diamonds, the four of spades, the four of clubs, the four of diamonds, the two of hearts, a joker, the seven of diamonds, the two of spades, the nine of diamonds, the four of hearts, the seven of hearts and the queen of diamonds.

After shuffling the deck of playing cards according to the selected poker hand seed, the gaming device generates, draws or deals a designated number of playing cards of the shuffled deck. In one embodiment, each playing card position is a separate, independent or unisymbol reel which is operable to generate any of the playing cards of the shuffled deck. In this example, the first five playing cards of the shuffled deck (i.e., the seven of spades, the queen of clubs, the ace of diamonds, the four of spades, and the four of clubs) are generated or displayed along a designated payline as the initial poker hand for the selected poker hand seed. Accordingly, after the initial poker hand is generated or displayed along the designed payline, the plurality of displayed playing for a five-reel column, three playing card positions per reel column hand-spin poker game would be:

| | | | | |
|---|---|---|---|---|
| Seven of Spades | Queen of Clubs | Ace of Diamonds | Four of Spades | Four of Clubs |

In one embodiment, in addition to the initial primary poker hand, the gaming device simultaneously displays one or more secondary poker hands along one or more secondary poker hand paylines. In one embodiment, the simultaneously displayed secondary poker hands each include the same playing cards as or equivalent playing cards to the initial primary poker hand. For example, if the initial primary poker hand includes the four of spades playing card and four of clubs playing cards, a first secondary poker hand may include the four of diamonds playing card and the four of hearts playing card. In this example, another secondary poker hand may includes the five of spades playing card and the five of clubs playing card. It should be appreciated that in this embodiment, as long as the same poker game outcomes are possible on the draw for each secondary poker hand, the actual playing cards displayed in each of the secondary poker hands does not matter. In another embodiment, the simultaneously displayed poker hands do not initially include any playing cards.

For example, in a nine-payline, nine-hand poker game, the gaming device enables the player to wager on nine paylines to simultaneously play nine poker hands wherein the held cards from the primary poker hand are held, carried over or replicated into each of the eight other simultaneously played poker hands. It should be appreciated that even though zero, one or more cards may be carried over from one or more simultaneously played poker hands, each simultaneously played poker hand is evaluated independent of the remaining simultaneously played poker hands.

After the player is provided an initial poker hand, the gaming device enables the player to select one or more of the initially dealt playing cards in the primary poker hand to hold or to discard. As described above, the held playing cards in the primary hand are also held in one, more or each of the other simultaneously displayed hands of playing cards. That is, if a playing card generated on a reel in a first reel column is held, that playing card is held in each playing card position (or unisymbol reel) of the first reel column.

In addition to enabling the player to designate which playing cards to hold and which playing cards to discard, in one embodiment, the gaming device utilizes the stored table of different distributions of poker game outcomes for each payout amount to determine which distributions of poker game outcomes result in a total payout equal or substantially equal to the selected predetermined game outcome value. In this embodiment, the gaming device utilizes the stored distribution table which corresponds to the applicable pay table, the number of wagered on paylines (i.e., the number of simultaneously played poker hands) and the amount wagered on each of the paylines or simultaneously played poker hands. For example, for the selected predetermined game outcome value of $98, the gaming device utilizes the stored table of poker game outcome distributions to determine that a first entry for a payout of $98 requires two four-of-a-kind poker hands, two full house poker hands, one three-of-a-kind poker hand, one two-pair poker hand and three losing poker hands and a second entry for a payout of $98 requires two four-of-a-kind poker hands, one full house poker hand, three three-of-a-kind poker hands, two two-pair poker hands and one losing poker hand.

In one embodiment, after the player designates which playing cards to hold and which playing cards to discard, the gaming device determines if the player followed the auto-hold strategy for the initial poker hand. If the player followed the auto-hold strategy for the initial poker hand, the gaming device proceeds in generating, dealing or drawing a playing card from the shuffled deck for each discarded playing card and for each vacant playing card position in each of the secondary poker hands to form a plurality of final poker hands. The gaming device analyzes each of the final poker hands generated along each wagered on payline to determine the payout associated with each poker hand. The gaming device provides the total combined payout of each of the individually analyzed poker hands to the player. It should be appreciated that since the payout associated with the selected poker hand seed was previously determined based on following an auto-hold strategy, if the player follows the auto-hold strategy during game play, the payouts associated with each of the final poker hands generated along each wagered on payline will add up to the selected predetermined game outcome value. That is, if the player follows the auto-hold strategy, regardless of the number of overlapping paylines wagered on, the gaming device is able to generate the appropriate playing cards in the appropriate playing card positions to result in a plurality of poker hands (generated along wagered on paylines) with a total payout equal to the selected predetermined game outcome value.

For example, if the player followed the auto-hold strategy and held the four of spades and the four of clubs (and discarded the seven of spades, the queen of clubs and the ace of diamonds), the gaming device deals the next nine cards from the shuffled deck into the vacant or unoccupied playing card positions. That is, the gaming system deals playing cards, in order from the shuffled deck, to the three playing card positions left vacant from the three non-held discarded playing cards and the six vacant playing card positions from the secondary poker hands to form a plurality of final poker hands. The gaming device analyzes each of the final poker hands generated along each of the wagered on paylines to determine the payout associated with each poker hand. The gaming device provides the total combined payout of each of the analyzed poker hands to the player.

In one embodiment, if the player did not follow the auto-hold strategy for the initial poker hand, the gaming device evaluates the set of playing cards selected by the player to hold and determines if, based on the held playing cards and the remaining playing cards in the deck, the appropriate playing cards can be dealt, generated or drawn in the appropriate playing card positions to result in one of the poker game outcome distributions previously determined to be associated with the selected predetermined game outcome value. It should be appreciated that since one or more playing cards generated in one or more playing card positions are included in a plurality of poker hands, the appropriate placement of each playing card in the appropriate playing card position is necessary to insure that a plurality of poker hands are formed (along a plurality of wagered on paylines) with a total payout equal to the predetermined game outcome value. That is, in addition to determining, based on the held playing cards and the remaining playing cards in the deck, which playing cards must be generated to form a plurality of poker hands with a total payout equal to the selected predetermined game outcome value, the gaming device must also determine if these determined playing cards can each be generated in the appropriate playing card position such that a plurality of poker hands are formed with a total payout equal to the selected predetermined game outcome value. For example, even if the gaming device determines, based on the held playing cards and the remaining playing cards in the deck, which playing cards to generate to form a plurality of poker hands with a total payout equal to the selected predetermined game outcome value, if the gaming device is unable to generate such playing cards in the appropriate playing card positions, the gaming device must either determine another plurality of playing cards to place in the appropriate playing card positions or the gaming device must utilize one of the solutions associated with the selected poker hand seed as described in more detail below. In other words, the gaming system disclosed herein utilizes an algorithm and/or a look-up table to determine which playing cards to generate in which playing card positions.

In one embodiment, if the gaming device determines the appropriate playing cards to generate in the appropriate playing card positions to result in a plurality of poker hands having a distribution of poker game outcomes which matches at least one of the poker game outcome distributions associated with selected predetermined game outcome, the gaming device generates or displays such determined playing cards to the player to form a plurality of final poker hands along a plurality of wagered on paylines. The gaming device analyzes each of the final poker hands generated along each wagered on payline to determine the payout associated with each poker hand. The gaming device determines a total combined payout of each of the analyzed poker hands and provides the determined total payout to the player. It should be appreciated that the payouts associated with each of the provided final poker hands add up to the selected predetermined game outcome value.

In one embodiment, the gaming device attempts to determine the appropriate playing cards to generate in the appropriate playing card positions to result in a plurality of poker hands having a distribution of poker game outcomes which matches at least one of the poker game outcome distributions associated with selected predetermined game outcome for a set or limited amount of time. In another embodiment, the gaming device attempts to determine the appropriate playing cards to generate in the appropriate playing card positions to result in a plurality of poker hands having a distribution of poker game outcomes which matches at least one of the poker game outcome distributions associated with selected predetermined game outcome in a set or limited number of attempts.

For example, if the player holds only the seven of spades (and discards the remaining playing cards in the initial poker hand), the gaming device determines if based on the held seven of spades and the remaining playing cards in the deck, whether the appropriate playing cards can be generated in the appropriate playing card positions to result in a plurality of poker hands having a distribution of poker game outcomes which matches the first compatible poker game outcome distribution for the selected predetermined game outcome value of $98. That is, the gaming device determines if, based on the seven of spades held in the first playing card position for each of the simultaneously played poker hands and the remaining playing cards in the deck, if the appropriate playing cards can be generated into the appropriate playing card positions to result in two four-of-a-kind poker hands, one full house poker hand, three three-of-a-kind poker hands, two two-pair poker hands and one losing poker hand. In this case, the gaming device determines in a set amount of time (or a set number of attempts), the appropriate playing cards to generate in the appropriate playing card positions to result in a plurality of poker hands having a distribution of poker game outcomes which matches the first compatible poker game outcome distribution for the selected predetermined game outcome value of $98. Accordingly, the gaming device generates, deals or displays the determined playing cards in the appropriate playing card positions to form a plurality of final poker hands. The gaming device analyzes each of the final poker hands generated along each wagered on payline to determine the payout associated with each poker hand. The gaming device determines a total combined payout of each of the analyzed poker hands and provides the determined total payout to the player. The gaming device displayed playing cards matches solution screen 1C described above. It should be appreciated that in this example, the gaming device is able to generate the appropriate playing cards in the appropriate playing card positions to result in a plurality of poker hands (generated along wagered on paylines) with a total payout equal to the selected predetermined game outcome value.

In one embodiment, if the gaming device is unable to determine, in a set amount of time (or a set number of attempts), the appropriate playing cards to generate in the appropriate playing card positions to result in a plurality of poker hands having a distribution of poker game outcomes which matches at least one of the poker game outcome distributions associated with the selected predetermined game outcome value the gaming device attempts to find or determine a stored solution for the selected poker game outcome seed that is compatible with the playing cards the player designated to hold and the playing cards the player designated to discard. In this embodiment, the gaming device accesses the previously stored set of solutions or solution screens associated with the selected poker hand seed and tries to find a solution which includes the same playing cards as those held by the player. That is, if the player designated to hold two of the five playing cards in the initial poker hand, the gaming device determines if a stored solution (previously associated with the selected poker game) exists which includes the two playing cards the player designated to hold and results in a plurality of poker hands having a distribution of poker game outcomes which matches at least one of the poker game outcome distributions associated with selected predetermined game outcome value. If the gaming device is able to find or determine a stored solution associated with the selected poker hand seed which includes the playing cards held by the player, the gaming device generates or displays the playing cards in the appropriate playing card positions based on the determined solution to the player. The generated playing cards form a plurality of final poker hands. The gaming device analyzes each of the final poker hands generated along each wagered on payline to determine the payout associated with each poker hand. The gaming device determines a total combined payout of each of the analyzed poker hands and provides the determined total payout to the player. It should be appreciated that the determined total payout for each of the poker hands generated along each of the paylines wagered on equals the selected predetermined game outcome value.

For example, if the player holds only the queen of clubs (and discards the remaining playing cards in the initial poker hand), the gaming device determines if based on the held queen of clubs and the remaining playing cards in the deck, whether the appropriate playing cards can be generated in the appropriate playing card positions to result in a plurality of poker hands having a distribution of poker game outcomes which matches the first compatible poker game outcome distribution for the selected predetermined game outcome value of $98. That is, the gaming device determines if, based on the queen of clubs held in the second playing card position for each of the simultaneously played poker hands and the remaining playing cards in the deck, if the appropriate playing cards can be generated into the appropriate playing card positions to result in two four-of-a-kind poker hands, two full house poker hands, one three-of-a-kind poker hand, one two-pair poker hand and three losing poker hands. In this case, the gaming device is unable to determine, in a set amount of time (or a set number of attempts, the appropriate playing cards to generate in the appropriate playing card positions to result in a plurality of poker hands having a distribution of poker game outcomes which matches the first compatible poker game outcome distribution for the selected predetermined game outcome value of $98. Accordingly, the gaming device attempts to determine for the second compatible poker game outcome distribution for the payout of $98 (i.e., two four-of-a-kind poker hands, one full house poker hand, three three-of-a-kind poker hands, two two-pair poker hands and one losing poker hand), whether the appropriate playing cards can be generated in the appropriate playing card positions to result in a plurality of poker hands having a distribution of poker game outcomes which matches the second poker game outcome distribution associated with selected predetermined game outcome. In this case, the gaming device is unable to determine, in a set amount of time (or a set number of attempts) the appropriate playing cards to generate in the appropriate playing card positions to result in a plurality of poker hands having in a distribution of poker game outcomes which matches the second compatible poker game outcome distribution for the selected predetermined game outcome value of $98.

In this example, since the gaming device is unable to determine the appropriate playing cards to generate in the appropriate playing card positions to result in a plurality of poker hands having a distribution of poker game outcomes which matches either the first or the second poker game outcome distribution associated with the selected predetermined game outcome value of $98, the gaming device attempts to find a stored solution for the selected poker game outcome seed that is compatible with the playing cards the player designated to hold and the playing cards the player designated to discard. In this example, the gaming device finds and displays to the player the playing cards in the playing card positions associated with the stored solution which includes the held queen of clubs (i.e., solution screen 1D above). The generated playing cards form a plurality of final poker hands. The gaming device analyzes each of the final poker hands generated along each wagered on payline to determine the payout associated with each poker hand. The gaming device determines a total combined payout of $98 for each of the analyzed poker hands and provides the determined total payout to the player. It should be appreciated that the determined total payout of $98 equals the selected predetermined game outcome value of $98.

In one embodiment, if the gaming device is unable to determine the appropriate playing cards to generate in the appropriate playing card positions to result in a plurality of poker hands having a distribution of poker game outcomes which matches at least one of the poker game outcome distributions associated with selected predetermined game outcome and the gaming device is further unable to find a stored solution for the selected poker game outcome seed that is compatible with the playing cards the player designated to hold and the playing cards the player designated to discard, the gaming device overrides the player's designation regarding which playing cards to hold and which playing cards to discard and forces the player to follow the auto-hold strategy. In this embodiment, the gaming device proceeds as described above regarding the player following the auto-hold strategy.

In another embodiment, if the gaming device is unable to determine the appropriate playing cards to generate in the appropriate playing card positions to result in a plurality of poker hands having a distribution of poker game outcomes which matches at least one of the poker game outcome distributions associated with selected predetermined game outcome and the gaming device is further unable to find a stored solution for the selected poker game outcome seed that is compatible with the playing cards the player designated to hold and the playing cards the player designated to discard, the gaming device overrides the player's designation regarding which playing cards to hold and which playing cards to discard and forces the player to follow one of the alternative hold strategies for the selected poker hand seed. In this embodiment, the gaming device proceeds as described above regarding the player following one of the alternative hold strategies.

In another embodiment, if the gaming device is unable to determine the appropriate playing cards to generate in the appropriate playing card positions to result in a plurality of poker hands having a distribution of poker game outcomes which matches at least one of the poker game outcome distributions associated with selected predetermined game outcome and the gaming device is further unable to find a stored solution for the selected poker game outcome seed that is compatible with the playing cards the player designated to hold and the playing cards the player designated to discard, the gaming device must replace one or more of the player's held playing cards with different playing cards. In different embodiments, the replaced playing cards are predetermined, randomly determined, determined based on the player's wager, determined based on the player's status (e.g., determined through a player tracking system), determined from the occurrence of one or more symbols or determined based on any other suitable method. In this embodiment, after replacing one or more of the player's held playing cards with different playing cards, the gaming device repeats the process described above in determining the appropriate playing cards to generate in the appropriate playing card positions to result in a plurality of poker hands having a distribution of poker game outcomes which matches at least one of the poker game outcome distributions associated with selected predetermined game outcome and further determining a stored solution screen for the selected poker game outcome seed that is compatible with the playing cards the player designated to hold and the playing cards the player designated to discard. Accordingly, regardless of how the player plays the multi-play spin poker game disclosed herein, the gaming device will ultimately provide the player the selected predetermined game outcome.

Accordingly, one embodiment of the gaming system disclosed herein provides a multi-play spin poker game which provides a predetermined game outcome to a player wherein a player is enabled to make one or more choices or decisions during the multi-play spin poker game while the predetermined game outcome is still provided to the player.

Accordingly, one embodiment of the gaming system disclosed herein also provides that an algorithm searches for a solution using a deterministic random number generator, but only searches for a set length of time or for a set or limited number of attempts. If the algorithm fails to find a solution in the set length of time, the gaming system utilizes a table of solutions to look up an applicable solution. Accordingly, the solution look-up table is built to contain solutions to only situations where the algorithm fails to find a solution in the set length of time.

Additional features and advantages are described in, and will be apparent from, the following Detailed Description and the figures.

BRIEF DESCRIPTION OF THE FIGURES

FIG. 5 is a chart of one embodiment disclosed herein illustrating a plurality of poker hand seeds and the poker hand each of the poker hand seeds is deterministic of when the poker hand seed is applied to or used by one or more selected deterministic random number generating algorithms.

FIG. 7 is a paytable of one embodiment disclosed herein illustrating the different possible poker game outcomes and the payout amounts associated with each of the poker game outcomes.

FIG. 8 is a chart of one embodiment disclosed herein illustrating a generated distribution table including a plurality of possible payout amounts and the different outcome configurations which may be generated to result in the payout amounts.

DETAILED DESCRIPTION

The present disclosure provides a central determination gaming system wherein one or more gaming devices are operable to each play a separate multi-play spin poker game and provide a predetermined game outcome to the player.

Figure 1:
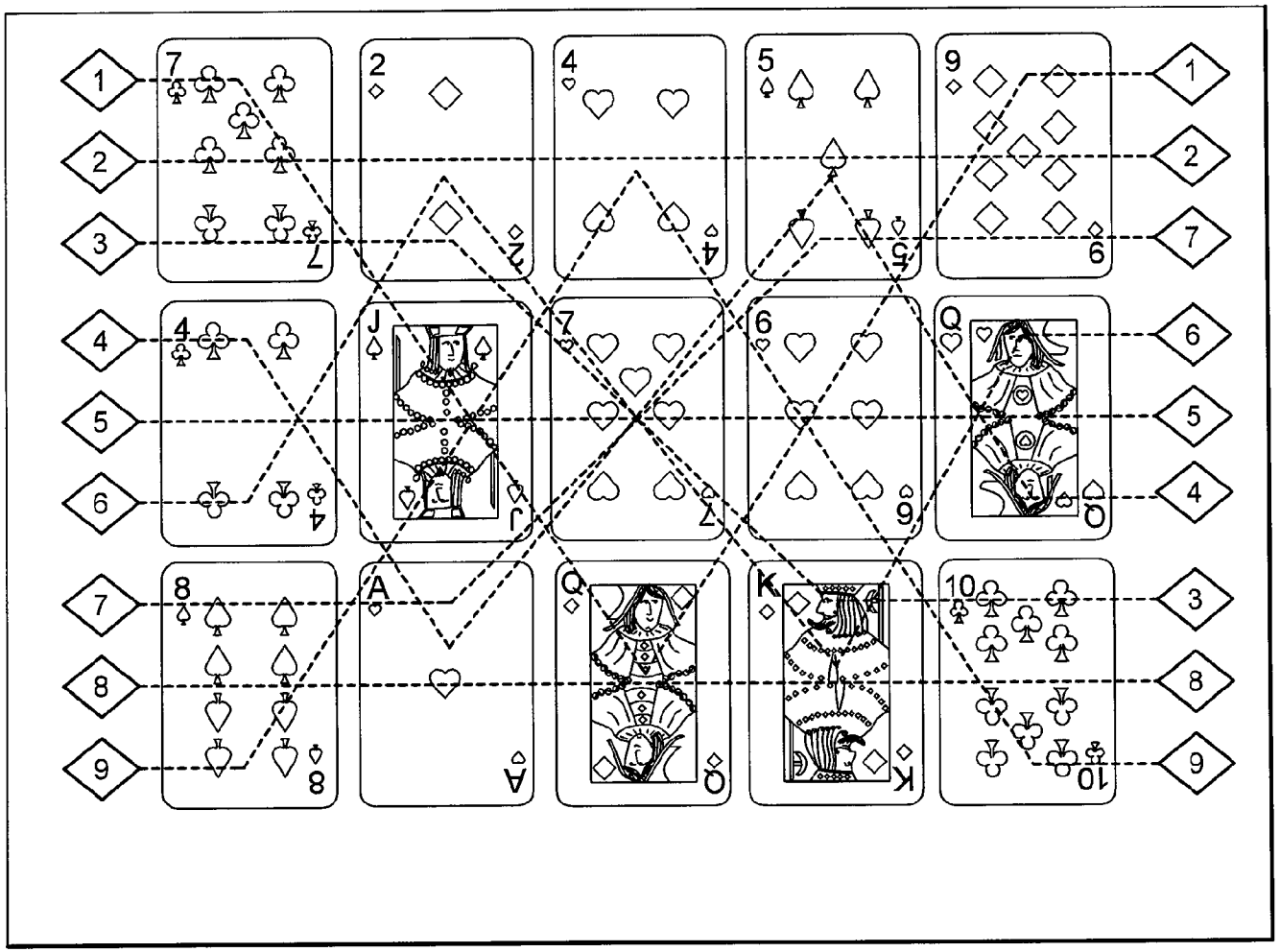
FIG. 1 (Prior Art)
FIG. 1 is a top plan view of a multi-hand spin poker game wherein one or more playing cards are each included in one or more different, simultaneously played poker hands.
Figure 2:
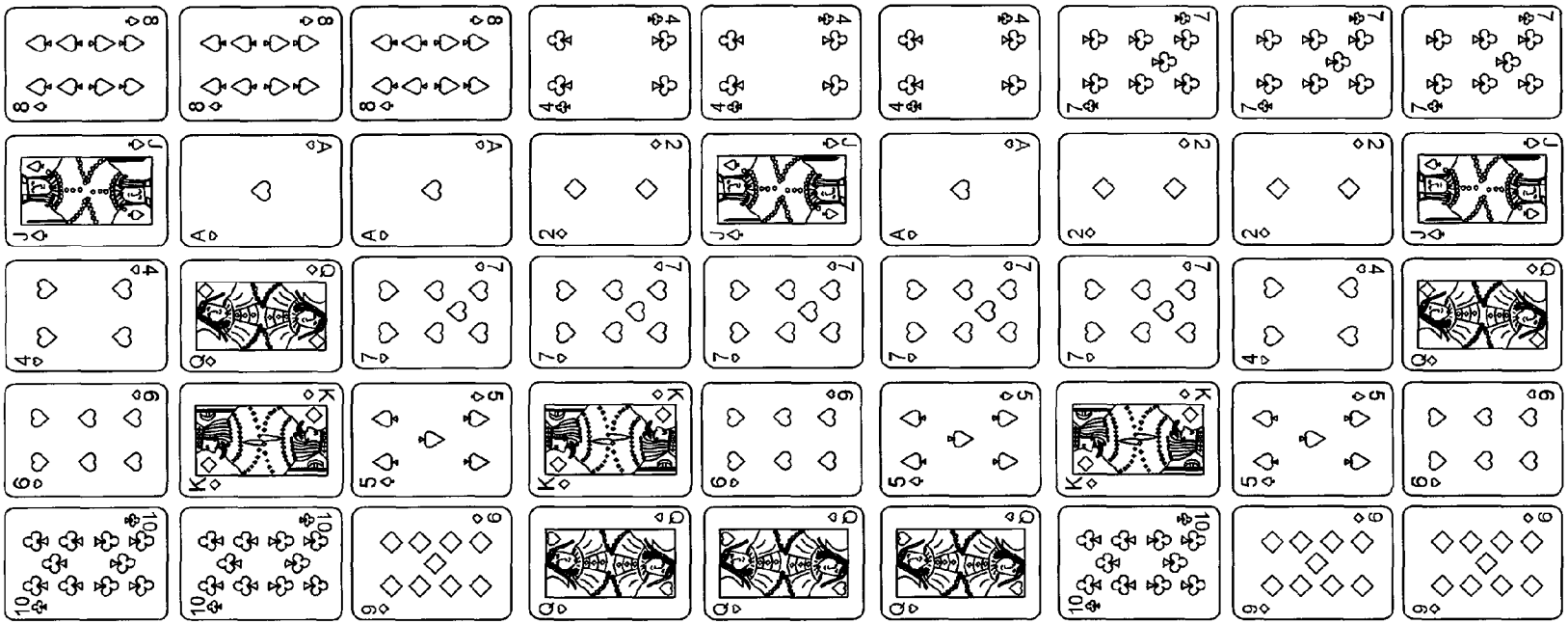
FIG. 2 (Prior Art)
FIG. 2 is a top plan view of the multi-hand spin poker game of FIG. 1, illustrating each simultaneously played poker hand individually.
Figure 3:
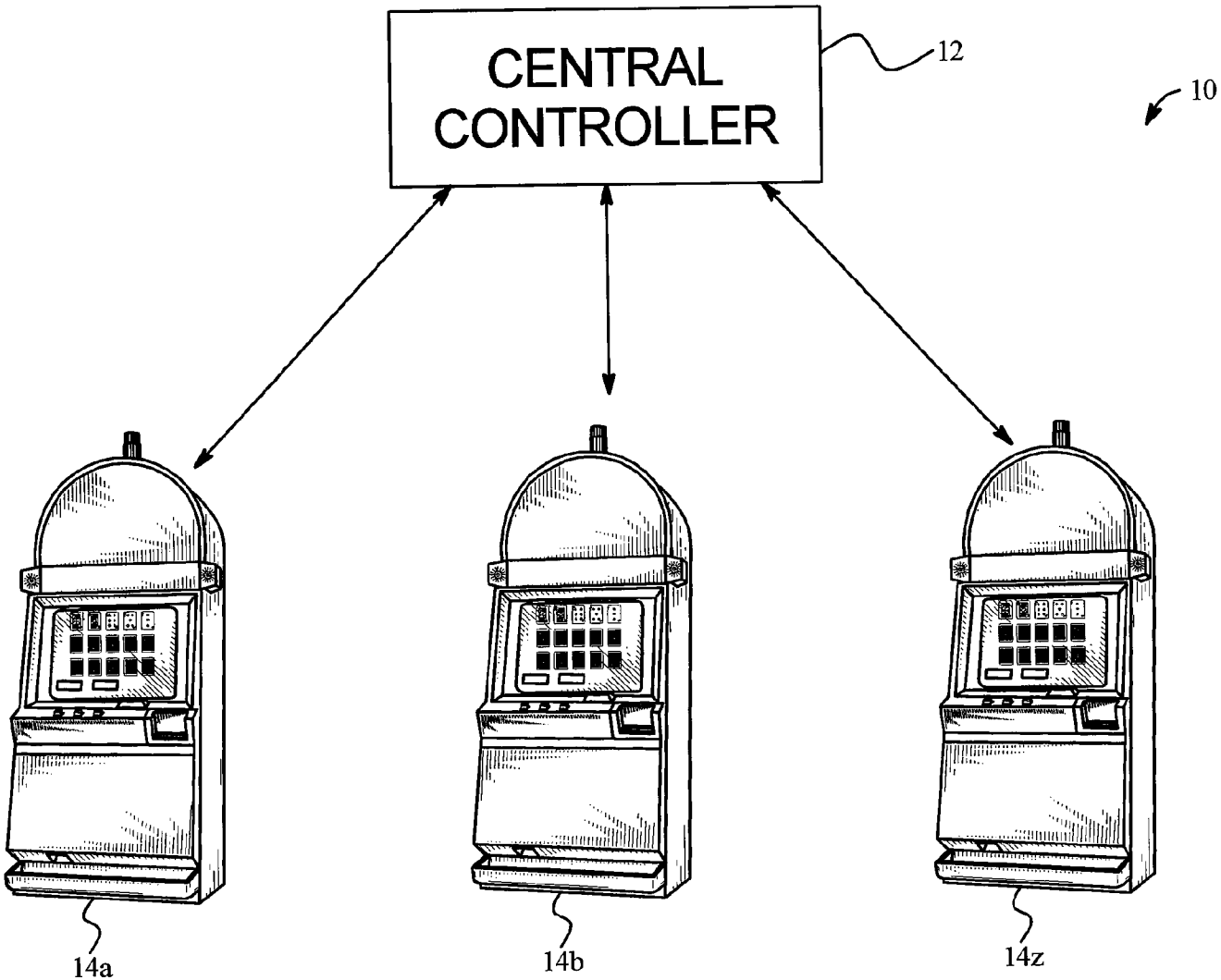
FIG. 3 is a schematic diagram of the central controller in communication with a plurality of gaming machines in accordance with one embodiment disclosed herein.

Referring to FIG. 3, one embodiment of the gaming system 10 includes a central server or controller 12 and a plurality of gaming machines or gaming devices 14*a*, 14*b* . . . 14*z* in communication with or linked to the central server or processor 12. The number of gaming machines in the gaming system can vary as desired by the implementer of the gaming system. These gaming machines are referred to herein alternatively as the group of gaming machines, the linked gaming machines or the system gaming machines. The play of each of the gaming machines 14*a*, 14*b* . . . 14*z* in the group is monitored by the central server 12. The central server or controller may be any suitable server or computing device which includes a processor and a memory or storage device. In alternative embodiments, the central server is a progressive controller or another gaming machine in the gaming system.

Determination of Possible Poker Hands

Figure 4:
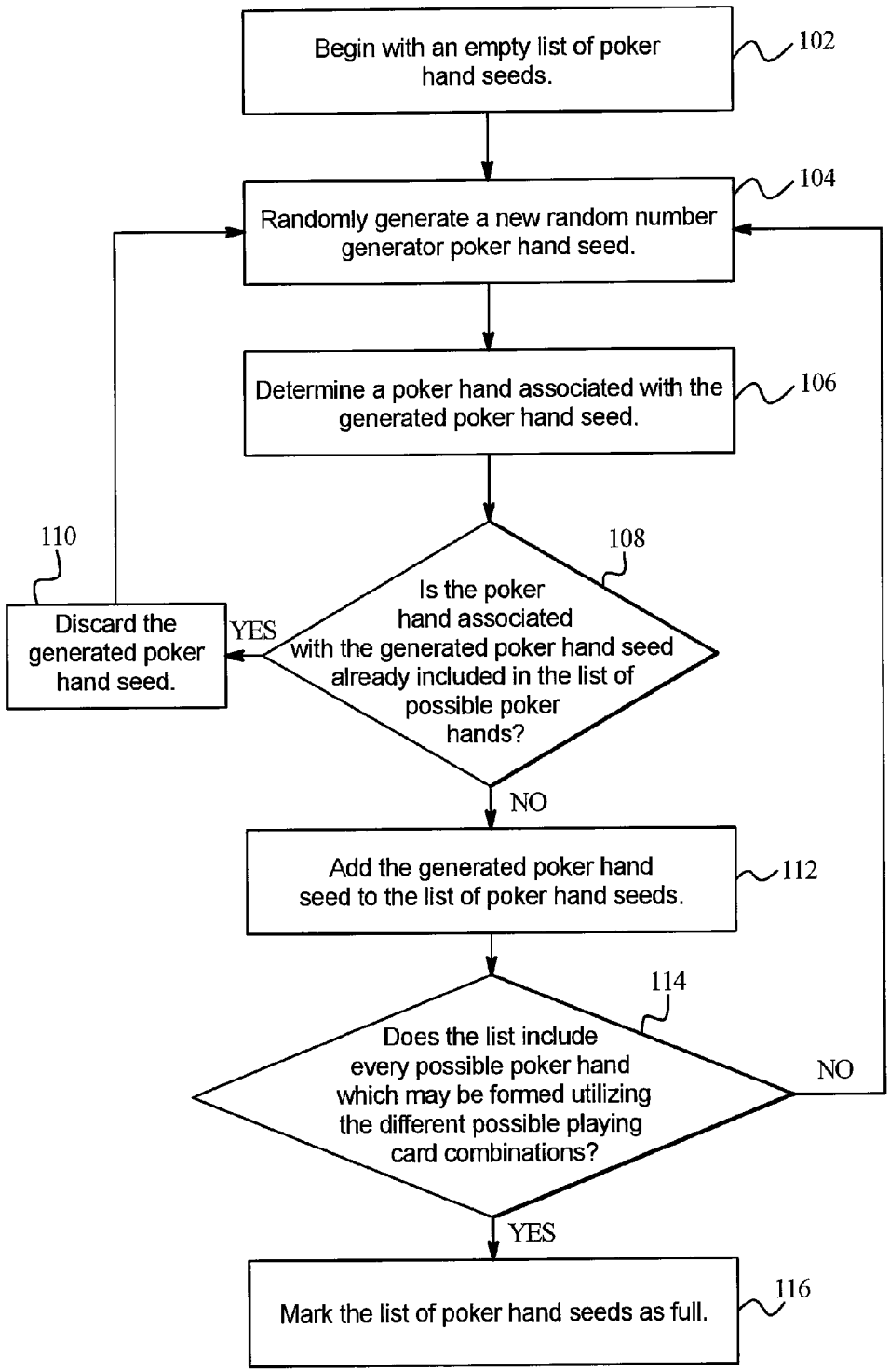
FIG. 4 is a flowchart of one embodiment disclosed herein illustrating the generation of a list of poker hand seeds which are deterministic of every possible poker hand which may be formed.

Referring to FIG. 4, in one embodiment, prior to the play of any of the multi-play spin poker games, a set or list of poker hand seeds is generated or compiled, wherein the set or list initially includes poker hand seeds which are deterministic of every possible poker hand which may be formed utilizing different playing card combinations. The number of possible poker hands which may be formed is based on the number of playing cards in a deck or set of playing cards as well as the number of playing cards in each poker hand. For example, for a five card poker hand dealt out of a standard fifty-two card deck there are 2,598,960 different possible poker hands which may be formed using different combinations of the available playing cards. In different embodiments, this set or list is generated by the game developer, game development system, central controller, by an individual gaming machine, by a casino or gaming machine operator or by any other suitable method. In one embodiment, each different arrangement or order of the same playing cards is considered a different possible poker hand which is associated with a different poker hand seed. Accordingly, in this embodiment, the number of different possible poker hands which may be formed using different combinations of the available playing cards is significantly increased. For example, if each different arrangement of the same playing cards is considered a different possible poker hand, the 2,598,960 different possible poker hands is increased by a factor of 120 to 311,875,200 different possible poker hands.

In the embodiment illustrated in FIG. 4, after beginning with an empty list of poker hand seeds as indicated in block 102, the gaming system randomly generates a new random number generator poker hand seed as indicated in block 104. Each poker hand seed, when applied to one or more selected deterministic random number generating algorithms, is deterministic of a different one of the possible poker hands which may be generated or dealt from a deck or set of available playing cards.

In one embodiment, the available playing cards from a single fifty-two card deck are utilized. In another embodiment, the playing cards from a plurality of fifty-two card decks are utilized. In another embodiment, the playing cards from a predetermined set of player cards are utilized. In another embodiment, the playing cards from a deck of more than fifty-two playing cards, such as a deck including one or more "joker" or wild playing cards, are utilized.

After generating a poker hand seed, the gaming system determines a poker hand associated with the generated poker hand seed as indicated in block 106. In this embodiment, the gaming system applies the generated poker hand seed to one or more selected deterministic random number generating algorithms to determine the poker hand associated with the generated poker hand seed. In one embodiment, the gaming system shuffles a deck of playing cards (using a random number sequencer that is seeded with the selected poker hand seed) and generates, draws or deals a designated number of playing cards from the shuffled deck. In this embodiment, the dealt playing cards from the poker hand associated with the generated poker hand seed. For example, when a designated first poker hand seed of 1,028,113 is applied to one or more selected deterministic random number generating algorithms, the designated first poker hand seed yields an associated first poker hand or combination of playing cards including the three of hearts, the jack of clubs, the six of diamonds, the queen of hearts and the nine of spades. In another example, when a designated second poker hand seed of 58,449 is applied to one or more selected deterministic random number generating algorithms, the designated second poker hand seed yields an associated second poker hand or combination of playing cards including the ace of diamonds, the ace of hearts, the three of clubs, the king of hearts and the queen of hearts. It should be appreciated that as each poker hand seed is deterministic of a specific poker hand, each time a specific poker hand seed is applied or used by one or more selected deterministic random number generating algorithms, the poker hand seed will yield the same playing cards to generate the same poker hand.

The gaming system next determines if the poker hand associated with or determined by the generated poker hand seed is already included in the list of possible poker hands as indicated in diamond 108. Since the set or list of possible poker hands includes only one of each different playing card combination possible, if the poker hand associated with the generated poker hand seed is already included in the list of possible poker hands, the generated poker hand seed is discarded as indicated in block 110 and the gaming system proceeds to block 104 as described above. If the poker hand associated with the generated poker hand seed is not already included in the list of possible poker hands, the gaming system adds the generated poker hand seed to the list as indicated in block 112.

After adding the generated poker hand seed to the list, the gaming system determines if the list includes every possible poker hand which may be formed utilizing the different possible playing card combinations as indicated in diamond 114. If the list does not include every possible poker hand, the gaming system proceeds to block 104 as described above. If the list includes every possible poker hand, the gaming system marks or flags the list of poker hand seeds as full as indicated in block 116. It should be appreciated that since the different possible poker hands which may be formed is based on the types of available playing cards, number of available playing cards and the number of playing cards in each poker hand, if the types of available playing cards, the number of available playing cards or the number of playing cards in each poker hand are altered or otherwise modified, the list of possible poker hands available would also be altered or modified and thus the list of poker hand seeds would require appropriate alterations or modifications.

FIG. 5 illustrates a sampling of a full list of poker hand seeds. As seen in FIG. 5, each poker hand seed 120 is deterministic or otherwise associated with a poker hand 122. For example, a first poker hand seed 120*a* is deterministic or otherwise associated with a first poker hand 122*a* of the three of hearts, the jack of clubs, the six of diamonds, the queen of hearts and the nine of spades. A second poker hand seed 120*b* is deterministic of otherwise associated with a second poker hand 122*b* of the ace of diamonds, the ace of hearts, the three of clubs, the king of hearts and the queen of hearts. In this example, a third poker hand seed 120*c* is deterministic of or otherwise associated with a third poker hand 122*c* of the queen of clubs, the queen of hearts, the two of diamonds, the three of spades and the eight of clubs and a fourth poker hand seed 120*d* is deterministic of or otherwise associated with a fourth poker hand 122*d* of the jack of clubs, the jack of hearts, the queen of hearts, the king of hearts and the two of clubs.

Generation of Distribution Table

In addition to determining the different poker game outcomes possible for each of the possible poker hands in the set or list of possible poker hands, the gaming system determines and stores for each available payout amount (i.e., from zero to the maximum payout), the different configurations or distributions of poker game outcomes which would result in that payout amount. This determination is based on the payout amounts associated with each poker game outcome (as designated by an appropriate paytable) as well as by the number of poker hands simultaneously played.

Figure 6A:
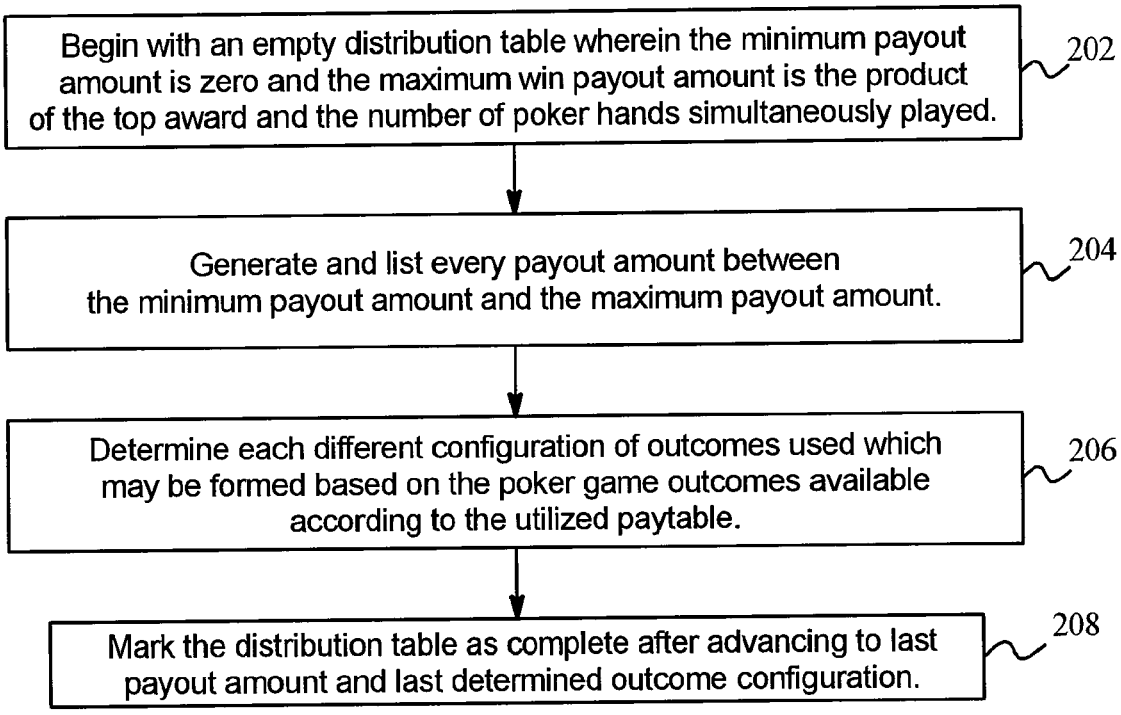
FIG. 6A is a flowchart of one embodiment disclosed herein illustrating the generation of a distribution table.
Figure 6B:
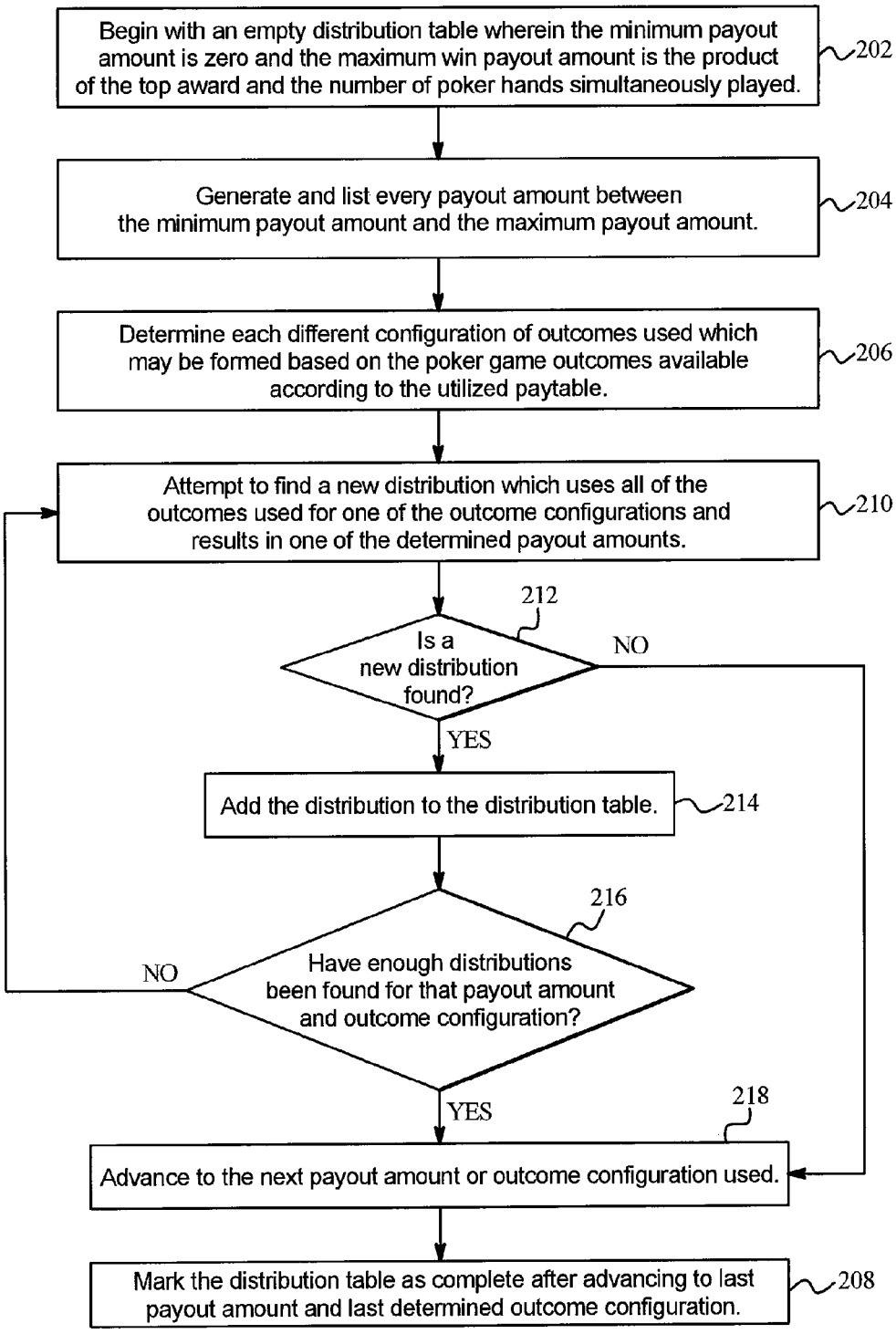
FIG. 6B is a flowchart of another embodiment disclosed herein illustrating the generation of a distribution table.

Referring to FIGS. 6A and 6B, in one embodiment, the gaming system begins with an empty distribution table wherein the minimum payout amount is zero and the maximum win or payout amount is the product of the top award and the number of poker hands simultaneously played as indicated in block 202. In this embodiment, the gaming system utilizes an applicable paytable, such as the paytable illustrated in FIG. 7. For example, as illustrated in the distribution table of FIG. 8, if the top award is two-hundred-fifty and the nine poker hands are simultaneously played, the maximum win or payout amount is two-thousand-two-hundred-fifty.

After setting the minimum payout amount and the maximum win or payout amount, the gaming system generates and lists every win or payout amount between the minimum payout amount and the maximum payout amount as indicated in block 204 of FIG. 6A or 6B. For example, as seen in FIG. 8, if the minimum payout amount is zero and the maximum win or payout amount is two-thousand-two-hundred-fifty, the gaming system lists every payout amount between the minimum payout amount and the maximum payout amount. It should be appreciated that for illustration purposes, FIG. 8 displays a sampling of the different payout amounts listed for this generated distribution.

After listing every possible payout amount, as indicated in block 204 of FIGS. 6A and 6B, the gaming system determines each different configuration of outcomes used which may be formed based on the poker game outcomes available according to the utilized paytable. In this embodiment, each different configuration of outcomes used represents the different poker game outcomes which are utilized over the plurality of simultaneously played poker hands played. This determination is based on the number of simultaneously played poker hands as well as the number of different poker game outcomes available to be provided to the player. For example, for a poker game with ten different outcomes possible (i.e., the ten different poker game outcomes listed in the paytable of FIG. 7) there are $2^{10}$ or one-thousand-twenty-four different possible configurations of outcomes used which the gaming system determines. In one embodiment, as seen in FIG. 6A, after determining which different configurations of poker game outcomes can be used for each payout amount, the gaming system marks the distribution table as complete as indicated in block 208.

In the alternative embodiment of FIG. 6B, as described in more detail below, the database of FIG. 8 includes one or more Outcomes Used columns which display a sampling of the different outcome configurations possible for nine simultaneously played poker hands. For example, one configuration of outcomes requires that only losing game outcomes (i.e., losing poker hands) are used over the plurality of simultaneously played poker hands played (i.e., each of the plurality of poker hands must be a losing poker hand). Another configuration of outcomes requires that losing game outcomes and poker game outcomes of jacks or better are the only outcomes which may be utilized over the plurality of simultaneously played poker hands played (i.e., each of the plurality of poker hands must be either a losing poker hand or a jacks or better poker hand). It should be appreciated that if a configuration of outcomes requires that a specific poker game outcome be utilized, then at least one of the simultaneously played poker hands must result in that specific poker game outcome.

In this alternate embodiment, after listing every possible payout amount and determining each of the different possible configurations of outcomes used, the gaming system determines, for each different configuration of outcomes used if it is possible, utilizing an appropriate paytable, to form a distribution of outcomes which pays one of the listed win or payout amounts. In this embodiment, the gaming system selects, one at a time, each determined outcome configuration and determines, for the selected outcome configuration, which possible payout amounts may result from different distributions of the outcomes used in the selected outcome distribution. In one embodiment, the gaming system attempts to find a new distribution which uses all of the outcomes used for the selected outcome configuration and results in one of the determined win amounts as indicated in block 210 of FIG. 6B. If a new distribution is found, the gaming system adds the distribution to the distribution table as indicated in diamond 212 and block 214. The gaming system then determines if enough distributions have been found for that win amount and selected outcome configuration as indicated in diamond 216.

The determination of when enough distributions have been found is a balance between game play aesthetics and available storage space. That is, more distributions means more options to choose from for each situation (i.e., more variety of poker hand distributions to display to the player). However, more stored distributions equates to a larger distribution table and more memory or storage space necessary to hold the larger distribution table. Accordingly, for multi-hand spin poker games with less simultaneously played poker hands (e.g., three played hands or five played hands), a target of around five distributions for each win amount and outcome configuration is considered enough distributions. For multi-hand spin poker games with a greater number of simultaneously played poker hands (e.g., ten played hands, fifty played hands or one-hundred played hands), a target of at least one distribution for each win amount and outcome configuration is considered enough distributions. In these embodiments, if fewer than the target number of distributions are found after a number of attempts (e.g., ten or fifteen attempts), the distribution table will include the lesser number of distributions found, wherein the distribution table will include at least one distribution, if any are possible.

If not enough distributions have been found for that win amount and selected outcome configuration, the gaming system proceeds to block 210 as described above. If no new distribution is found or enough distributions have been found for that win amount and outcome configuration used, the gaming system advances to the next, if any, win amount, or the next, if any, outcome configuration as indicated in block 218. After the last win amount and the last determined outcome configuration have been examined, the marks the distribution table as complete as indicated in block 210. In one embodiment, the determined distribution table is communicated to each of the gaming devices of the gaming system. As described below, since it is necessary for each gaming device to determine what distribution of wins or payouts to use once the player is dealt an initial hand and designated which playing cards to hold and discard, each gaming device must store the determined distribution table.

For example, based on the paytable listed in FIG. 7 and as seen in FIG. 8, for a nine play poker game, if the selected configuration of outcomes used requires that each outcome used is a losing outcome, then the gaming system determines that the only possible payout amount which may be formed utilizing the available losing outcomes is a payout amount of zero (i.e., a losing game outcome). In another example, if selected configuration of outcomes used requires that each outcome must be a losing game outcome or a jacks or better poker game outcome, then the gaming system determines that the possible payout amounts of one (i.e., one jacks or better poker hand and eight losing poker hands), two (i.e., two jacks or better poker hands and seven losing poker hands), three (i.e., three jacks or better poker hands and six losing poker hands), four (i.e., four jacks or better poker hands and five losing poker hands), five (i.e., five jacks or better poker hands and four losing poker hands) six (i.e., six jacks or better poker hands and three losing poker hands), seven (i.e., seven jacks or better poker hands and two losing poker hands) and eight (i.e., eight jacks or better poker hands and one losing poker hand) may each be formed utilizing the available losing game outcomes and jacks or better poker game outcomes.

As seen in the distribution table of FIG. 8, a plurality of the different win or payout amounts each have a number of different outcome configurations which may be used to result in that win amount. For example, nine different outcome configurations may each be utilized to result in a payout or win amount of five. Moreover, one outcome configuration may be distributed a plurality of different ways and still result in the same payout or win amount. For example, as seen in FIG. 8, for the outcome configuration including losing poker hands, jacks or better poker hands and two pair poker hands, at least five different distributions of this outcome configuration may be utilized and still result in the payout amount of five. It should be appreciated that as the above described poker game outcomes configuration determination is dependent on the specific paytable used as well as the number of hands simultaneously played, if the specific paytable used and/or the number of hands simultaneously played changes, the above described sequence must be again determined to account for any changes.

In an alternative embodiment, one or more entries in a first distribution table (configured for a first number of simultaneously played poker hands) may be used for a second distribution table (configured for a lower number of simultaneously played poker hands) if the same specific paytable is utilized for each distribution table. In this embodiment, for a first distribution table, the gaming system indexes each entry or solution by the associated win amount and the number of losing outcomes (i.e., outcomes with a payout of zero). The gaming system compares the first distribution to a second distribution table (with less simultaneously played poker hands than the first distribution table) to determine any entries or solution with losing outcomes in the first distribution table which may be carried over or utilized in the second distribution table. It should be appreciated that entries with losing outcomes may be carried over because one losing outcome may be associated with one poker hand which is no longer played when the number of simultaneously poker hands is reduced. For example, if a distribution table configured for ten simultaneously played poker hands includes an entry for a payout of $750 which includes three losing outcomes, then that same entry for a payout of $750 may be used in distribution tables configured for seven, eight or nine simultaneously played poker hands. In this example, one losing outcome may be associated with the one less poker hand which is played when the number of simultaneously played poker hands is reduced from ten to nine, two losing outcomes may be associated with the two less poker hands which are played when the number of simultaneously played poker hands is reduced from ten to eight and three losing outcomes may be associated with the three less poker hands which are played when the number of simultaneously played poker hands is reduced from ten to seven.

Assigning Payout Amounts with Poker Hand Seeds

In addition to determining one or more applicable distribution tables, in one embodiment, the gaming system determines and stores a second database or look-up table. The second database or look-up table includes the previously generated set or list of possible poker hand seeds (which are each deterministic of an initial hand of playing cards and are further associated with a payout amount) and zero, one or more solutions which are associated with each poker hand seed. For each poker hand seed, the different solutions of this database are based on which of the playing cards in the initial poker hand are held, the payout amount associated with the poker hand seed and which playing cards are necessary to generate in which playing card positions to form a plurality of poker hands that are associated with individual payouts that total the payout amount associated with the poker hand seed.

Figure 9:
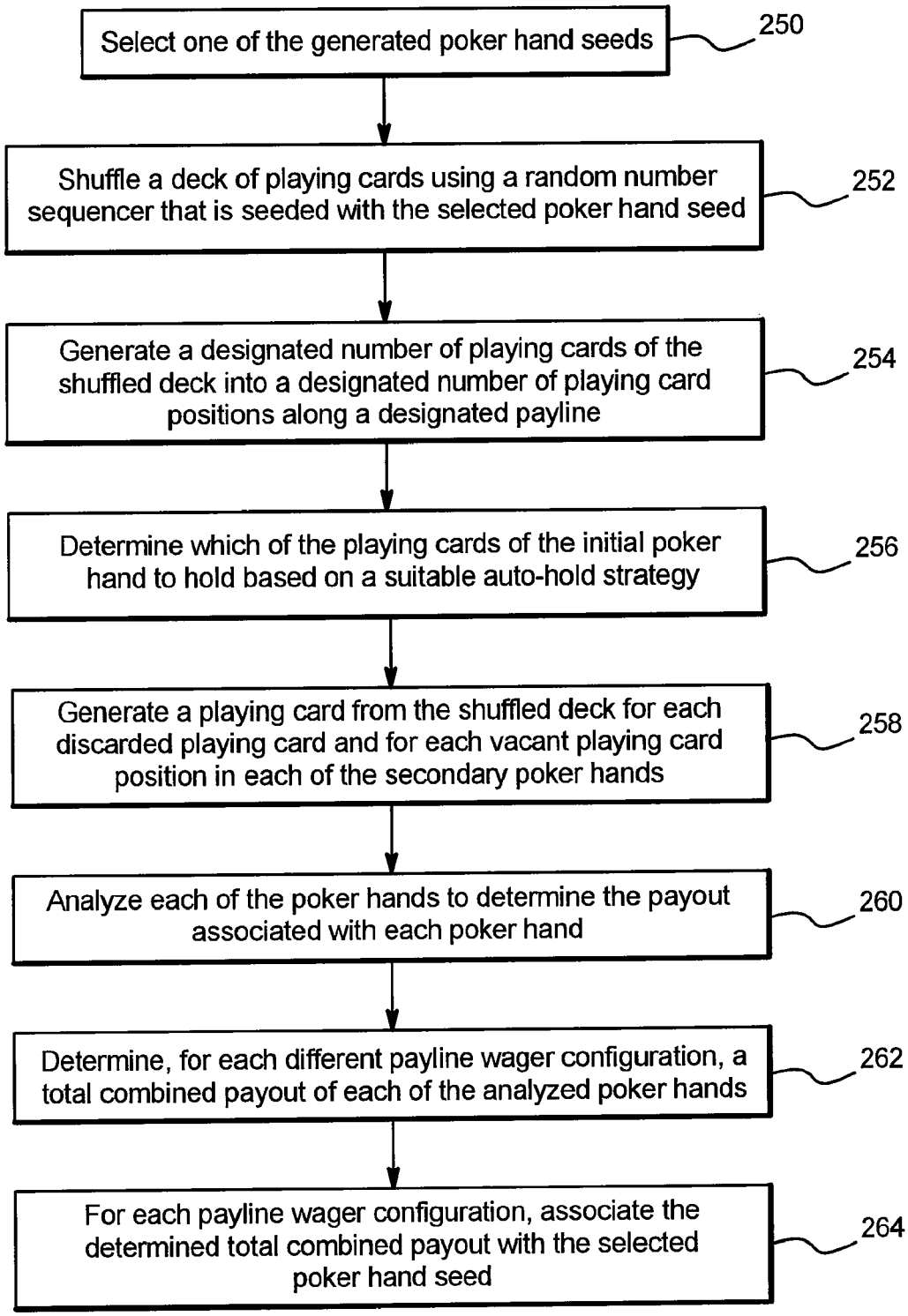
FIG. 9 is a flowchart of one embodiment disclosed herein illustrating the association of a payout amount with a poker hand seed.

In one embodiment, to create this database, the gaming system or gaming system developer selects one of the generated poker hand seeds as indicated in block 250 of FIG. 9. The gaming system shuffles a deck of playing cards (using a random number sequencer that is seeded with the selected poker hand seed) and generates, draws or deals a designated number of playing cards of the shuffled deck into a designated number of playing card positions as indicated in blocks 252 and 254. It should be appreciated that given the same poker hand seed, the selected random number sequencer(s) will always produce these same playing cards in the same order.

Figure 10:
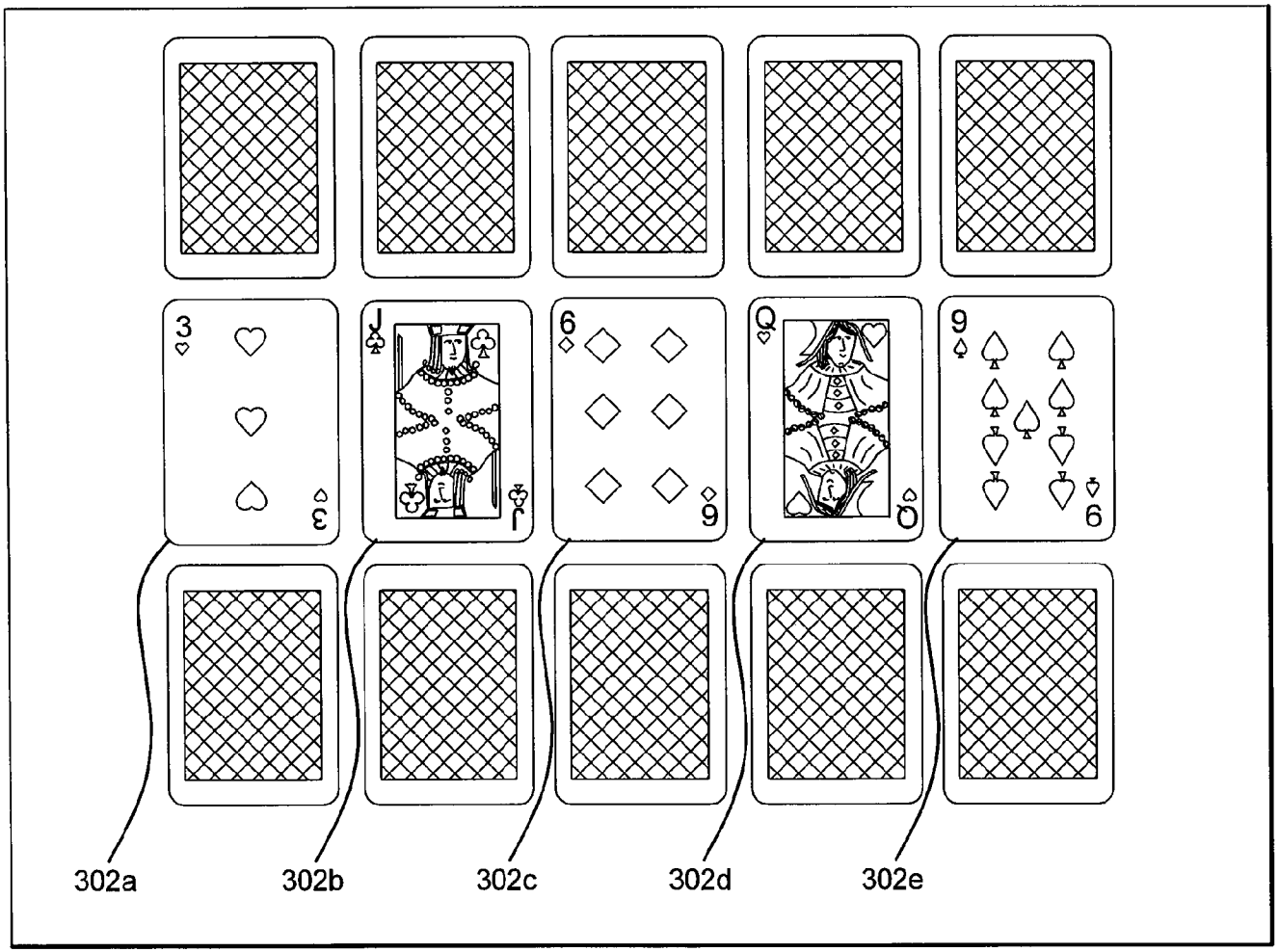
FIGS. 10, 11, 12 and 13 are top plan views of one embodiment disclosed herein illustrating the association of a payout amount with a poker hand seed based on a suitable auto-hold algorithm.

For example, if the gaming system selects the first poker hand seed of 1,028,113, one or more selected random number sequencer(s) are seeded with the number 1,028,113 to shuffle a deck of playing cards. Such shuffling results in the order of the playing cards in the shuffled deck as: the three of hearts, the jack of clubs, the six of diamonds, the queen of hearts, the nine of spades, the two of diamonds, the two of hearts, the three of clubs, the five of spades, the seven of hearts, the eight of diamonds, the jack of hearts, the king of hearts, the king of clubs, the four of clubs, the eight of spades and the ten of hearts. In this example, the gaming system deals or generates the first five playing cards of the shuffled deck (i.e., the three of hearts, the jack of clubs, the six of diamonds, the queen of hearts, and the nine of spades) along a designated one of the paylines to represent the initial poker hand for the selected poker hand seed. Accordingly, if the multi-hand poker game will be implemented on a five-reel column, three playing card positions per reel column gaming device, FIG. 10 illustrates the initial poker hand generated for the first poker hand seed of 1,028,113. As seen in FIG. 10, the playing cards of the initial poker hand 302*a* to 302*e* are generated along a payline which runs through the middle playing card position of each reel column. It should be appreciated that the playing cards of the initial poker hand may be generated along any payline which runs through any combination of playing card positions.

In one embodiment, the gaming system determines which of the playing cards of the initial poker hand to hold based on a suitable auto-hold algorithm or strategy as indicated in block 256 of FIG. 9. In this embodiment, the gaming system's auto-hold strategy takes an appropriate paytable into account in determining which playing cards to hold and which playing cards to discard for the dealt poker hand. It should be appreciated that since the auto-hold strategy is based on an applicable paytable, any alterations or modifications to the applicable paytable may alter the auto-hold algorithm's recommendation of which playing cards to hold and which playing cards to discard for each generated poker hand. It should be further appreciated that as described above, each held playing card is also held in one, more or each of a plurality of simultaneously played secondary poker hands.

Figure 11:
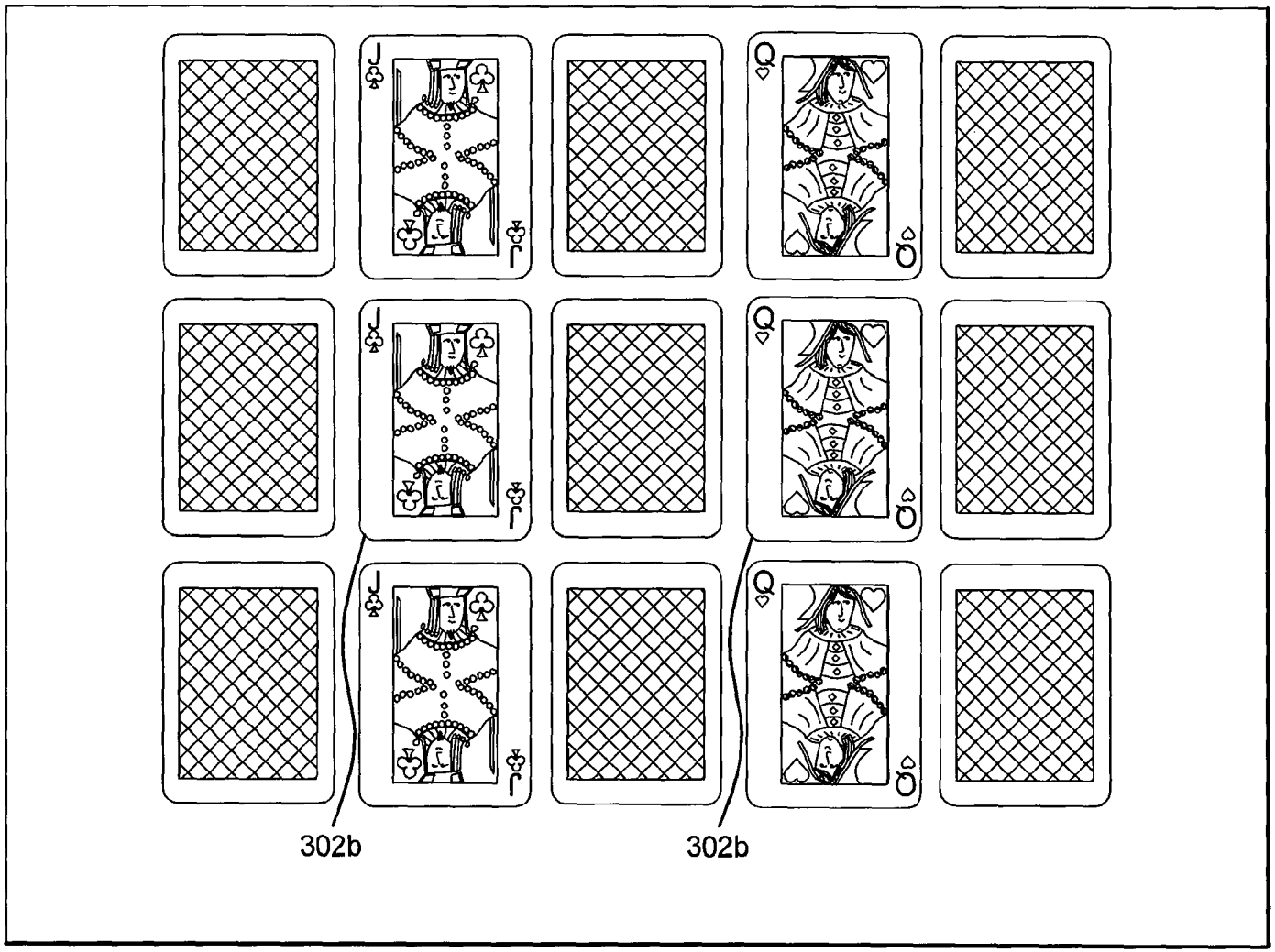

Applying a suitable auto-hold algorithm to the example described above, the gaming system determines that under a suitable auto-hold strategy, the jack of clubs 302*b* and the queen of hearts 302*d* should be held and the three of hearts 302*a*, the six of diamonds 302*c* and the nine of spades 302*e* should be discarded. Accordingly, as seen in FIG. 11, the jack of clubs 302*b* is held in each playing card position for the second reel column and the queen of hearts 302*d* is held in each playing card position for the fourth reel column. Accordingly, the jack of clubs and the queen of hearts are held as the second playing card and the fourth playing card in each of the plurality of simultaneously played secondary poker hands and the remaining playing cards from the initial poker hand are discarded.

In one embodiment, after determining which playing cards to hold from the poker hand associated with the selected poker hand seed, as indicated in block 258 of FIG. 9, the gaming system generates a playing card from the shuffled deck for each discarded playing card and for each vacant playing card position in each of the secondary poker hands. In this embodiment, the gaming system generates playing cards, in order, from the shuffled deck to form a plurality of poker hands.

Figure 12:
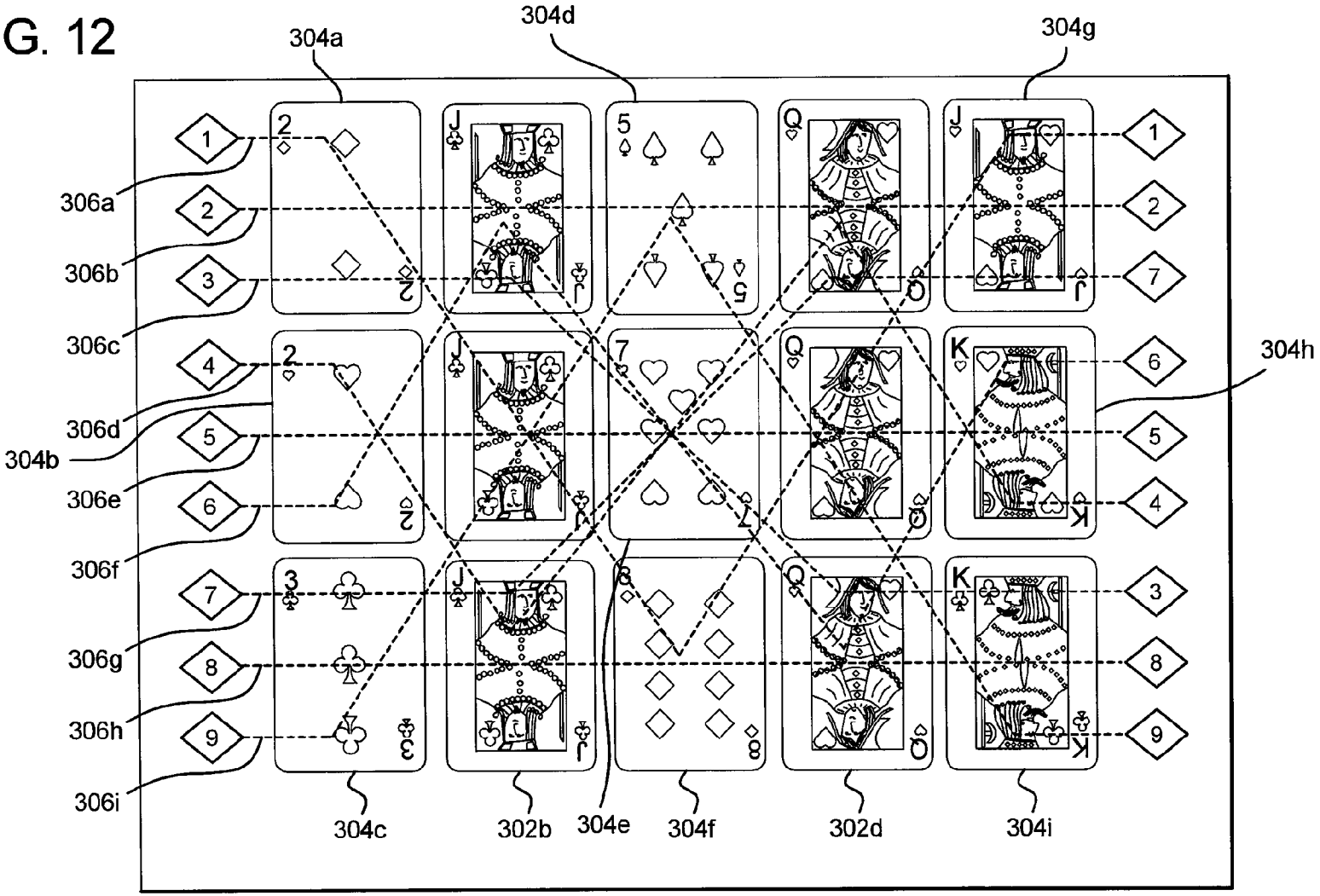

In the example described above, after discarding the appropriate non-held playing cards (i.e., the three of hearts, the six of diamonds and the nine of spades), the gaming system generates or deals the next nine playing cards from the shuffled deck into the remaining unoccupied playing card positions. That is, as seen in FIG. 12, the gaming system generates playing cards 304*a* to 304*i* from the shuffled deck to the three playing card positions left vacant from the three non-held discarded playing cards and the six vacant playing card positions in the secondary poker hands. In this example, the next nine playing cards from the shuffled deck that are generated in vacant playing card positions are the two of diamonds, the two of hearts, the three of clubs, the five of spades, the seven of hearts, the eight of diamonds, the jack of hearts, the king of hearts, and the king of clubs.

After generating zero, one or more playing cards, the gaming system analyzes each of the poker hands to determine the payout associated with each poker hand as indicated in block 260 of FIG. 9. In the multi-play spin poker game disclosed herein, each poker hand is formed based on which playing cards intersect each payline. That is, for a designated payline, the gaming system determines which playing cards intersect or are otherwise generated on the designated payline and if such playing cards form a winning poker hand. It should be appreciated that since a plurality of paylines may intersect or run through the same generated playing card, that generated playing card may be included in a plurality of individual poker hands.

As indicated in block 262, the gaming system determines, for each different payline wager configuration, a total combined payout for each of the analyzed poker hands. As indicated in block 264, for each payline wager configuration, the determined total payout is associated with the selected poker hand seed. That is, since each different payline includes an individual poker hand and a player may wager on any number of paylines, the number of wagered on paylines determines the number of poker hands played which thus determines the different total combined payouts to associate with the selected poker hand seed. For example, for a selected poker hand seed, if each of nine poker hands generated along nine paylines is associated with a payout of one, then a wager on each of the paylines results in a total combined payout of nine associated with the selected poker hand seed, while a wager on six of the paylines results in a total combined payout of six associated with the selected poker hand seed. It should be appreciated that enabling a player to wager different amounts on different paylines is further factored into the plurality of different payline wager configurations for each selected poker hand seed. Accordingly, each poker hand seed may be associated with a plurality of different payouts depending on the number of wagered on paylines and the wager amount on each payline.

Figure 13:
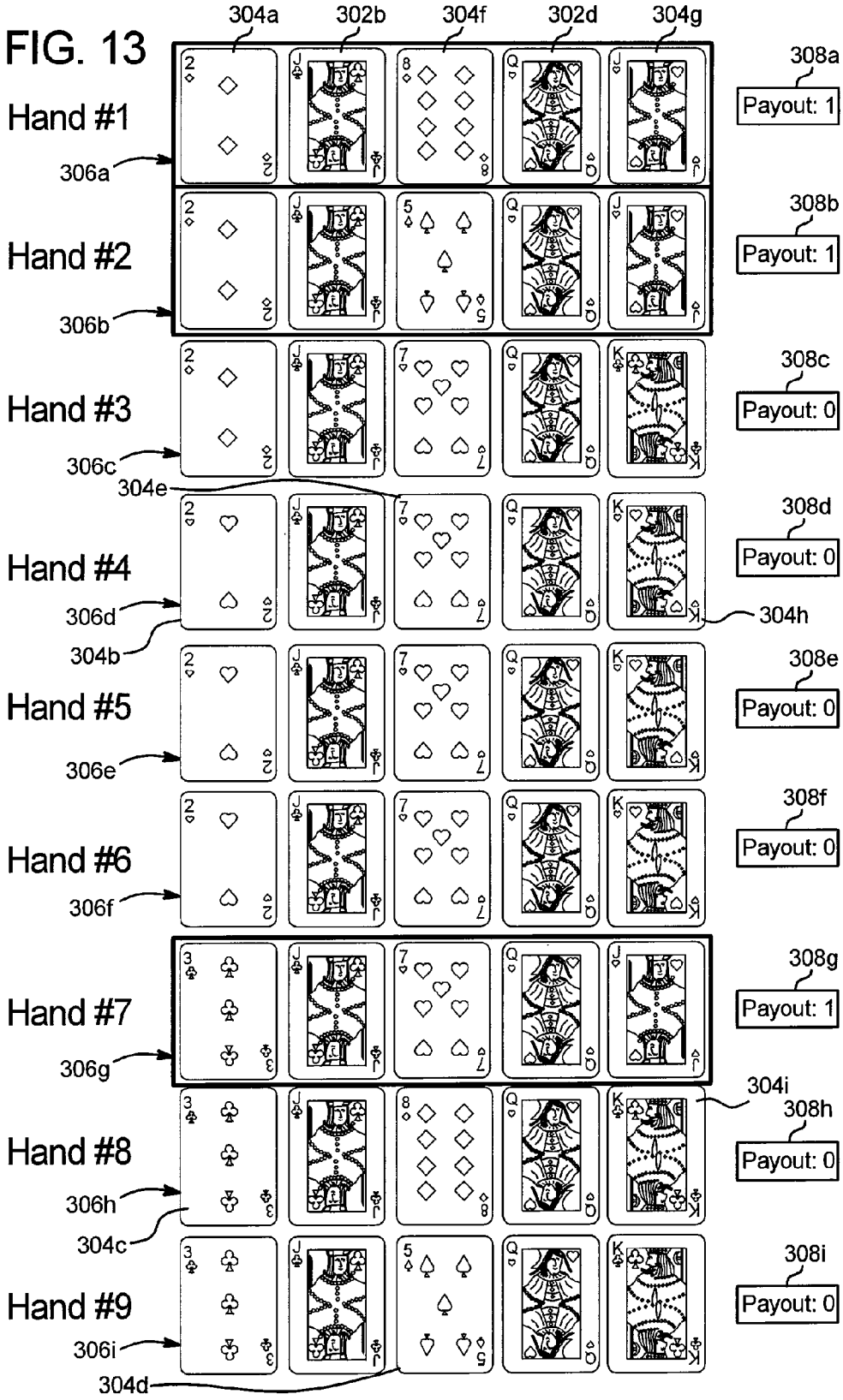

In the above-described example, the gaming system analyzes the generated formed poker hands to determine if any are associated with a winning playing card combination. According to an applicable paytable, the gaming system determines that these generated poker hands result in a total combined payout of three credits. That is, as illustrated in FIGS. 12 and 13, a payout of one credit 308*a* is associated with the pair of jacks poker hand (including the two of diamonds, the jack of clubs, the eight of diamonds, the queen of hearts and the jack of hearts) generated along payline #1 306*a*; a payout of one credit 308*b* is associated with the pair of jacks poker hand (including the two of diamonds, the jack of clubs, the five of spades, the queen of hearts and the jack of hearts) generated along payline #2 306*b*; and a payout of one credit 308*g* is associated with the pair of jacks poker hand (including the three of clubs, the jack of clubs, the seven of hearts, the queen of hearts and the jack of hearts) generated along payline #7 306*g*. Accordingly, if an equal wager were placed on all nine paylines, the gaming system associates the payout of three credits with the selected poker hand seed of 1,028,113. It should be appreciated that this process is repeated for each different possible payline wager configuration.

In one embodiment, after determining the payout amount associated with the selected poker hand seed for each different payline wager configuration, the gaming system determines which of the playing cards generated as the initial poker hand to hold based on one or more intelligent alternative holding strategies. That is, for each intelligent alternative holding strategy, as indicated in block 280 of FIG. 14, the gaming system determines which of the playing cards generated to hold. Similar to the auto-hold strategy, the gaming system's intelligent alternative holding strategies takes an appropriate paytable into account in determining which playing cards to hold and which playing cards to discard for the generated initial poker hand.

In one embodiment, one of the gaming system's intelligent alternative holding strategies includes holding the playing card(s) which translate to an optimal expected value for the played poker hand. For example, for a five-card poker hand, there are thirty-two different ways to hold zero, one or more playing cards. Each of these thirty-two different ways to play is associated with an average expected value. In this embodiment, the gaming system indexes each of these thirty-two different ways to play from the way to play with the highest average expected value (i.e., the auto-hold strategy) to the way to play with the lowest average expected value. In one embodiment, as the gaming system has previously held playing cards which yield the highest average expected value (i.e., the playing cards held according to the auto-hold strategy), the gaming system's intelligent alternative holding strategy includes selecting a different way to play that is associated with the next highest average expected value.

In another embodiment, the gaming system's intelligent alternative holding strategy includes selecting a plurality of different ways to play that are associated with a plurality of the next highest average expected values. In another embodiment, the gaming system selects the next highest average expected value (or a plurality of the next highest average expected values) as the gaming system's intelligent alternative holding strategy if the next highest average expected value (or plurality of the next highest average expected values) each exceed a designated threshold average expected value.

In another embodiment, the gaming system's intelligent alternative holding strategy includes holding the playing cards which form a winning hand (i.e., a poker hand that is associated with a payout greater than zero prior to any draw). In another embodiment, the gaming system's intelligent alternative holding strategy includes holding one or more playing cards based on one or more heuristic patterns. That is, heuristic patterns exist in the form of "poker strategy charts", which players can buy online or in casino gift shops. Such heuristic charts outline a simple set of rules which help the players play intelligently, but not always optimally (due to a simplification of the rules from what a computer can handle to what a player can handle, resulting in some sacrifices in the optimal strategy to reduce complexity).

In one embodiment, if no intelligent alternative holding strategies exist for the initial poker hand associated with the selected poker hand seed, the gaming system retains the selected poker hand seed in the set of generated poker hand seeds.

Figure 14:
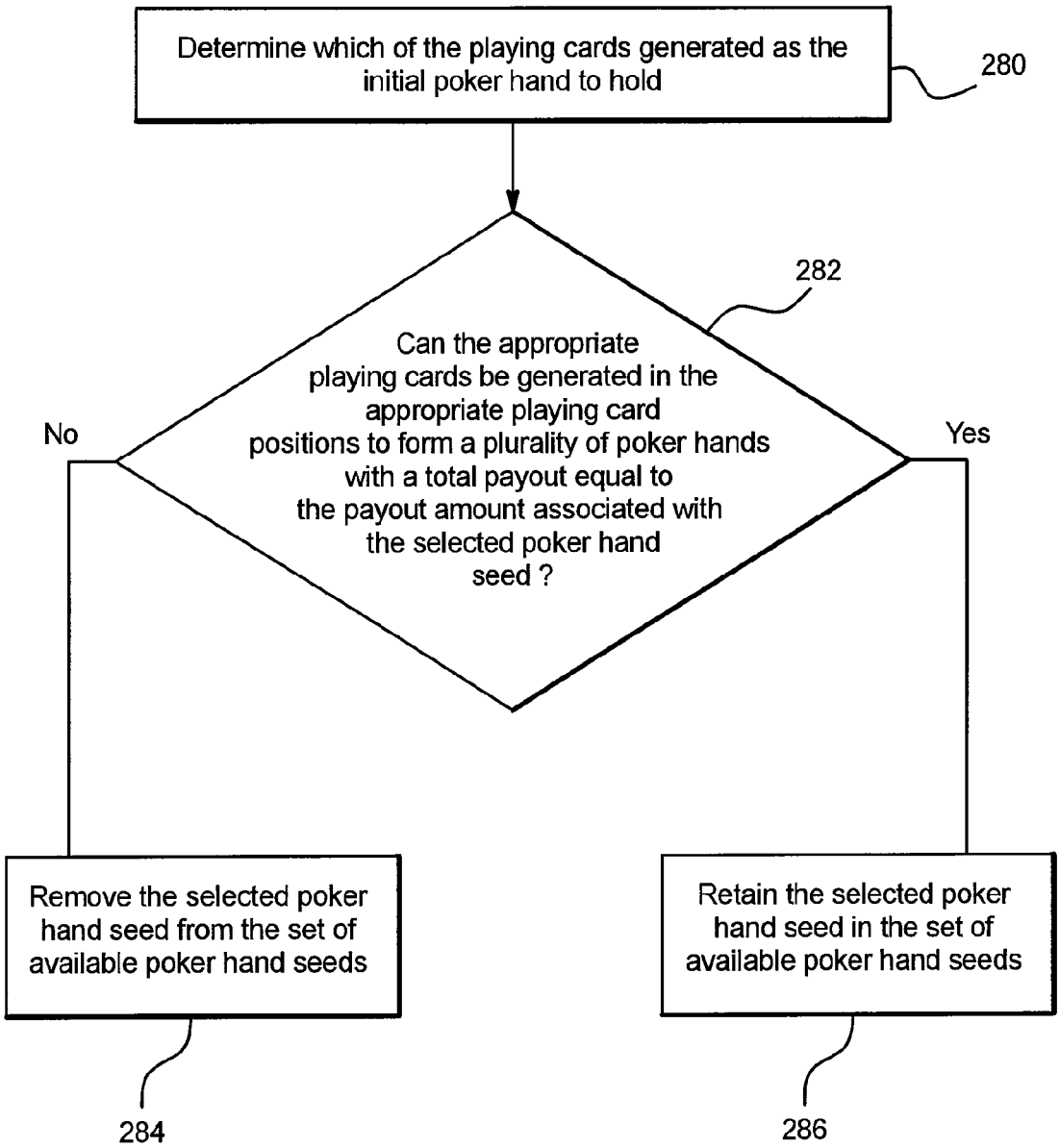
FIG. 14 is a flowchart of one embodiment disclosed herein illustrating a determination of whether to retain each generated poker hand seed. the association of a payout amount with a poker hand seed.

In one embodiment, for each of the intelligent alternative holding strategies for the selected poker hand seed, as indicated in diamond 282 of FIG. 14, the gaming system attempts to find a plurality of playing cards which will form a plurality of poker hands with a total payout equal to the payout previously associated with that selected poker hand seed. In this embodiment, as one or more playing cards are each included in a plurality of individual poker hands, the gaming system attempts to find a solution which includes the playing cards held according to the alternative holding strategy and zero, one or more subsequently generated playing cards in the appropriate playing card positions to form a plurality of poker hands with a total payout equal to the payout previously associated with the selected poker hand seed.

In one embodiment, for each vacant playing card position, the gaming system generates a playing card, in order, from the previously shuffled deck of playing cards. For example, if the gaming system must generate playing cards for six vacant playing card positions, the gaming system generates the next six playing cards from the shuffled deck of playing cards. In one such embodiment, if the playing cards generated from the deck (and any held playing cards) do not form a plurality of poker hands resulting in a poker game outcome distribution with the same payout as the payout previously associated with the selected poker hand seed, the gaming system replaces one or more of the generated playing cards. The gaming system again determines if the playing cards form a plurality of poker hands associated with a total payout that is equal to or substantially equal to payout previously associated with the selected poker hand seed. If the formed plurality of poker hands are still not associated with a total payout that is equal to or substantially equal to the payout previously associated with the selected poker hand seed, the gaming system repeats the playing card replacement process described above one or more times.

In another embodiment, for each vacant playing card position, the gaming system generates any playing card from the previously shuffled deck of playing cards regardless of the order of the shuffled deck. In this embodiment, the gaming system utilizes each of the remaining playing cards in the deck and attempts to determine the appropriate playing cards to be generated in the appropriate playing card positions to form a plurality of poker hands with a total payout equal or substantially equal to the payout amount previously associated with the selected poker hand seed. In different embodiments, determining which playing cards to generate to form the plurality of poker hands may be determined as described in co-pending U.S. patent application Ser. No. 10/945,642 which is incorporated herein by reference, in U.S. Pat. No. 6,729,961 B1 which is incorporated herein by reference or in any other suitable manner.

In one embodiment, the gaming system utilizes the stored table of different distributions of poker game outcomes to determine any poker game outcome distributions for the payout amount previously associated with the selected poker hand seed. For each determined poker game outcome distribution with the same payout as the payout previously associated with the selected poker hand seed the gaming system individually evaluates the playing cards held under the alternative holding strategy for the initial poker hand of the selected poker hand seed and determines if, based on these held playing cards and the remaining playing cards in the deck, the appropriate playing cards (from the remaining playing cards in the deck) can be generated in the appropriate playing card positions to form a plurality of poker hands that corresponds with one of the poker game outcome distributions which is associated with the payout amount previously associated with the selected poker hand seed. That is, for each alternative holding strategy for the initial poker hand of the selected poker hand seed, the gaming system attempts to determine which of the available playing cards to generate in which unoccupied or vacant playing card positions to form a plurality of poker hands along a plurality of paylines wherein the total payout for each of the formed poker hands is equal to or substantially equal to the payout associated with the selected poker hand seed.

In another embodiment, to determine which playing cards to generate in which playing card positions, the gaming system evaluates the set of playing cards to hold under the intelligent alternative holding strategy and determines which poker game outcomes are possible based on the held playing cards and the remaining playing cards in the deck. The gaming system then utilizes the stored table of different distributions of poker game outcomes which would result in each payout amount and a previous determination regarding which poker game outcomes are possible based on the held playing cards. In this embodiment, the gaming system utilizes the stored distribution table which corresponds to the applicable pay table, the number of simultaneously played poker hands and the amount wagered on each of the simultaneously played poker hands. The gaming system utilizes the appropriate distribution table to determine a distribution of outcomes that provides a total payout equal to the payout associated with the selected poker hand seed. That is, the distribution table is sorted by payout amount and by win categories used within each payout amount. Accordingly, given a payout amount and a set of win categories possible (as determined by the cards held according to the intelligent alternative holding strategy), the gaming system first searches the table for the entries with the matching payout amount and then searches those entries for win categories used that are compatible with the given win categories possible. If a compatible distribution is determined (utilizing the stored table of different distributions of poker game outcomes which would result in each payout amount and the previous determination regarding which poker game outcomes are possible based on the held playing cards), the gaming system selects one of the compatible distributions and attempts to utilize the selected distribution to determine which playing cards to generate in which playing card positions to form a plurality of poker hands with outcomes that match the selected compatible distribution.

In one embodiment, as indicated in block 284 of FIG. 14, if the gaming system cannot determine, for any alternative holding strategy for the initial poker hand of the selected poker hand seed, any available playing cards to generate in any vacant playing card position to form a plurality of poker hands which would result in a poker game outcome distribution which is associated with the same payout as the payout previously associated with the selected poker hand seed, the selected poker hand seed must be removed from the set or list of available poker hand seeds. For example, if three intelligent alternative holding strategies exist for the initial poker hand associated with a selected poker hand seed and based on the playing cards held in each of these three intelligent alternative holding strategies, the gaming system is unable to determine which playing cards to generate in which vacant playing card positions to form a plurality of poker hands associated with the same total payout as the payout previously associated with the selected poker hand seed, then the gaming system must remove the selected poker hand seed.

On the other hand, if the gaming system determines, for at least one intelligent alternative holding strategy for the initial poker hand of the selected poker hand seed, one or more available playing cards to generate to form a plurality of poker hands associated with the same, total payout as the payout previously associated with the selected poker hand seed, the selected poker hand seed is retained in the set or list of available poker hand seeds as indicated in block 286. That is, if the gaming system determines, for at least one alternative holding strategy for the initial poker hand of the selected poker hand seed, the appropriate playing cards (from the playing cards remaining in the deck) to generate in any unoccupied or vacant playing card positions, wherein the generated playing cards and any held playing cards form a plurality of poker hands with a total combined payout equal to the payout associated with the selected poker hand seed, then the selected poker hand seed is retained or kept in the set of possible poker hand seeds. For example, if three alternative holding strategies exist for the initial poker hand associated with a selected poker hand seed and based on the playing cards held in each of these three alternative holding strategies, the gaming system determines for at least one of the alternative holding strategies, which playing cards to generate in which vacant playing card positions to form a plurality of poker hands associated with the same total payout as the payout previously associated with the selected poker hand seed, then the gaming system retains and stores the selected poker hand seed. It should be appreciated that in one embodiment, in addition to retaining the selected poker hand seed, the solution of which playing cards must be generated in which playing card positions to result in an overall payout equal to the payout associated with the selected poker hand seed is stored in association with the stored poker hand seed.

In one embodiment, if the selected poker hand seed is retained and for at least one intelligent alternative holding strategy, the gaming system is unable to generate which playing cards to generate in which playing card positions to result in a plurality of poker hands with a total payout equal to the payout associated with the selected poker hand seed, the gaming system must modify at least one of the generated playing cards. In this embodiment, after modifying at least one of the generated playing cards, the gaming system repeats the process described above to form a plurality of poker hands with a total payout equal to the payout associated with the selected poker hand seed.

For example, utilizing the database of poker game outcome distributions, the gaming system determines that the payout of $3 (associated with the selected poker hand seed of 1,028,113) is associated with the poker game outcome distributions of: (a) one three-of-a-kind poker hand and eight losing poker hands; (b) three two-pair poker hands and six losing poker hands; (c) two two-pair poker hands, one jacks or better poker hand and six losing poker hands; (d) one two-pair poker hand, two jacks or better poker hands and six losing poker hands; or (e) three jacks or better poker hands and six losing poker hands.

Figure 15:
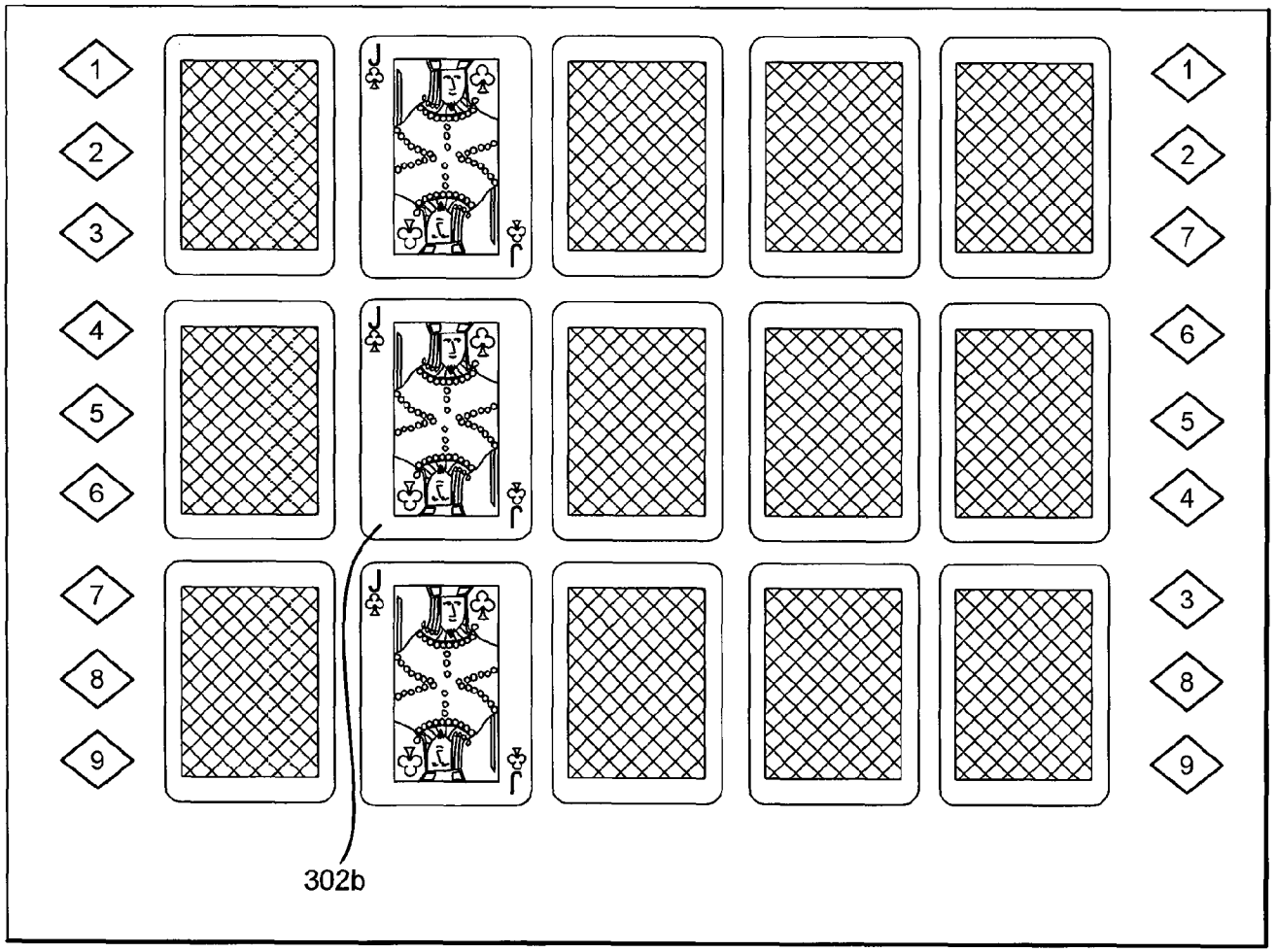
FIGS. 15, 16 and 17 are top plan views of one embodiment disclosed herein illustrating a play of the multi-hand spin poker game according to one alternative holding strategy.
Figure 16:
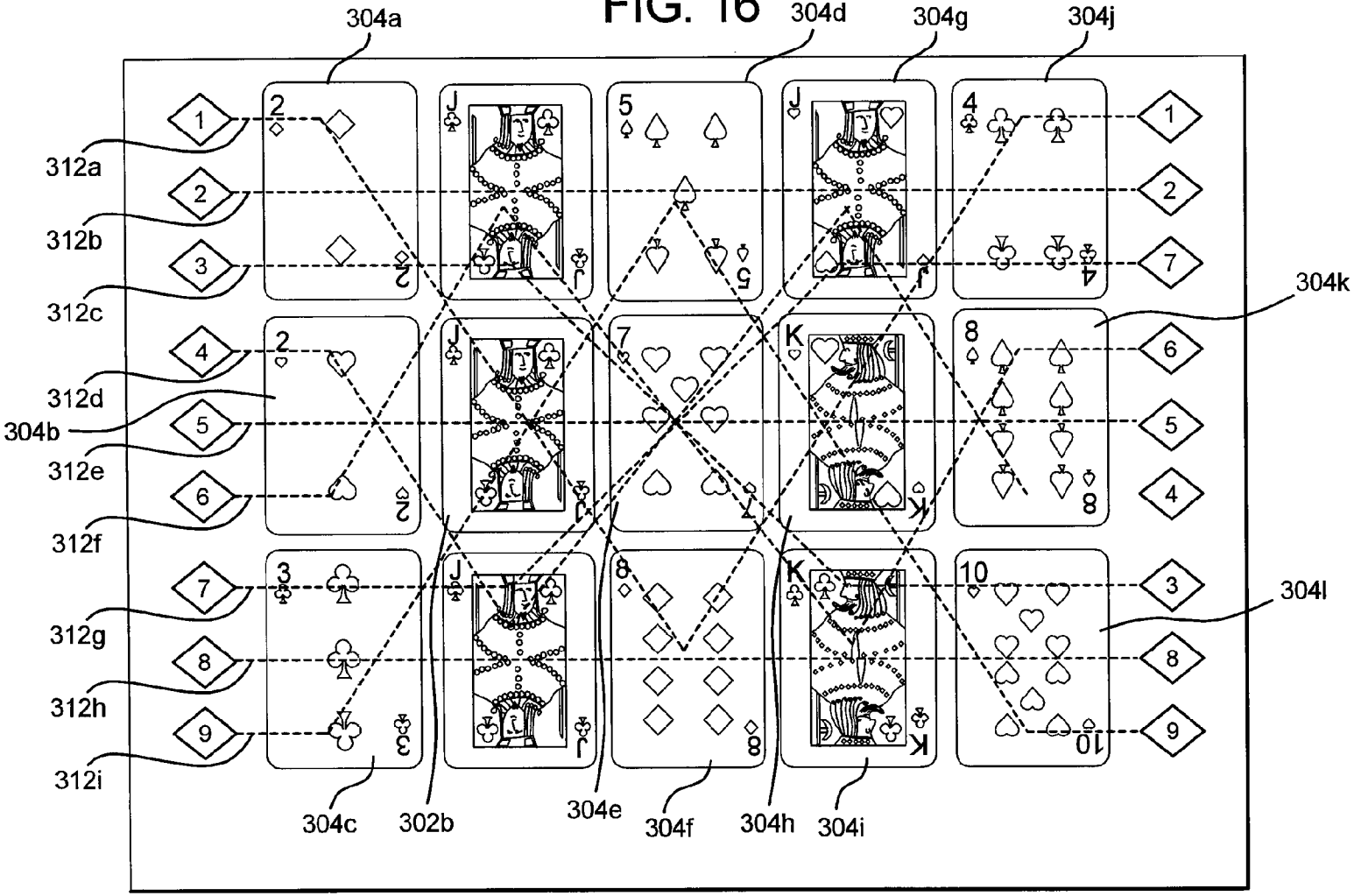

In this example, the gaming system determines that for the poker hand seed of 1,028,113 (which is deterministic of the initial poker hand displayed in FIG. 10), two alternative holding strategies exist. The first alternative holding strategy, as seen in FIG. 15, is holding only the jack of clubs 302*b* and discarding the three of hearts, the six of diamonds, the queen of hearts and the nine of spades. Accordingly, if the jack of clubs is held in each playing card position on the second reel column and is thus held as the second playing card in each of the plurality of simultaneously played secondary poker hands, the gaming system attempts to find twelve playing cards (from the plurality of playing cards remaining in the shuffled deck) to generate in the appropriate playing card positions to form a plurality of poker hands which would result in one of the above-listed poker game outcome distributions associated with a payout of $3 (i.e., the payout previously associated with the selected poker hand seed of 1,028,113). In this case, as seen in FIG. 16, the gaming system generates the next twelve cards 304*a* to 304*l* from the deck (previously shuffled using the selected poker hand seed) into the remaining unoccupied playing card positions. These generated playing cards along with the jack of clubs held according to the alternative holding strategy form a plurality of poker hands.

Figure 17:
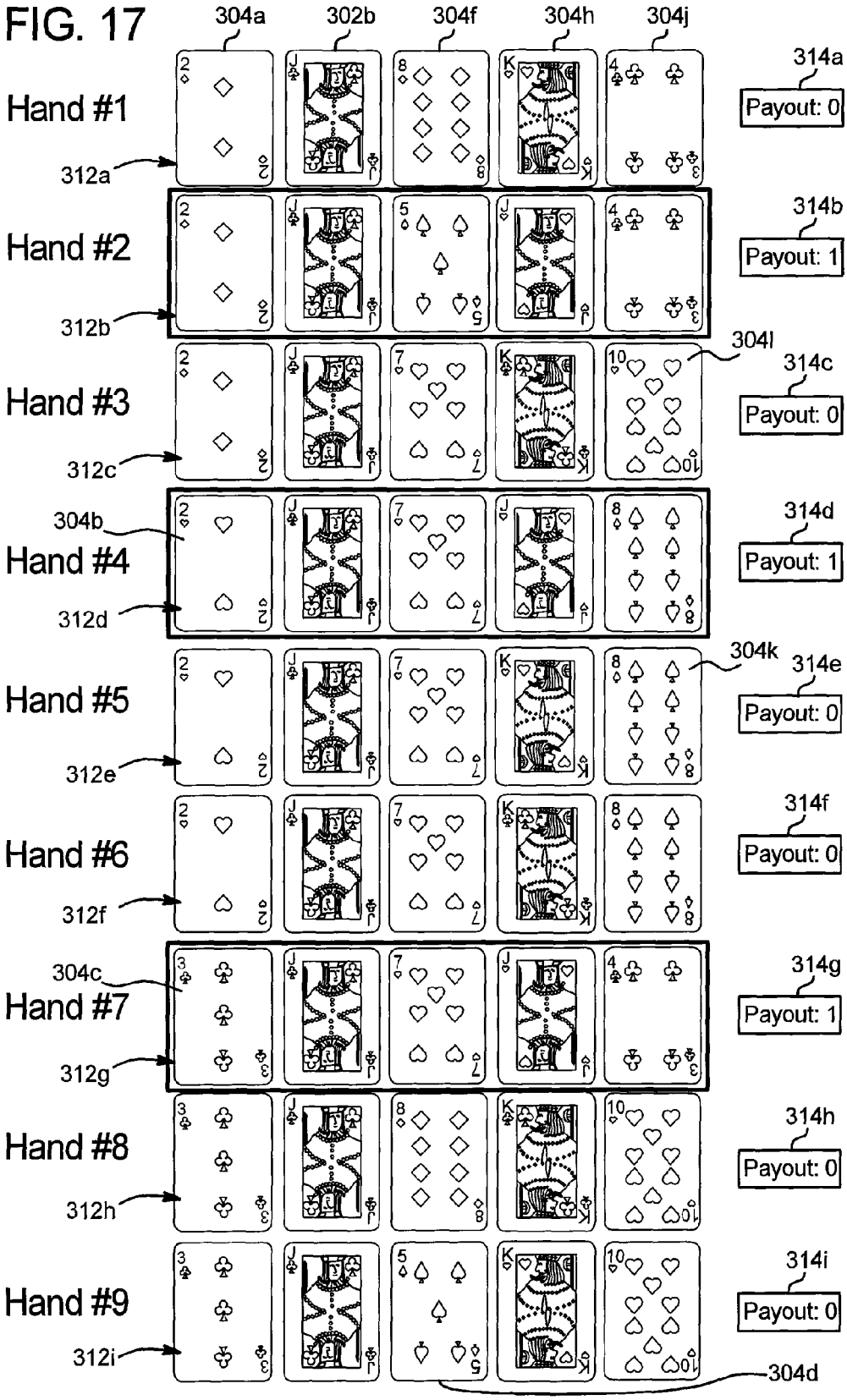

In the above-described example, the gaming system analyzes the nine formed poker hands to determine if any are associated with a winning playing card combination. According to an applicable paytable, the gaming system determines that if nine paylines are equally wagered on these nine poker hands are associated with a total combined payout of three credits. That is, as illustrated in FIGS. 16 and 17, a payout of one credit 314*b* is associated with the pair of jacks poker hand generated along payline #2 312*b*; a payout of one credit 314*d* is associated with the pair of jacks poker hand generated along payline #4 312*d*; and a payout of one credit 314*g* is associated with the pair of jacks poker hand generated along payline #8 312*g*. Accordingly, since the alternative holding strategy of holding the jack of clubs results in the same payout of three credits as was previously associated with the selected poker hand seed of 1,028,113, the selected poker hand seed of 1,028,113 is retained or stored and a solution for this alternative holding strategy is also stored in associated with the selected poker hand seed.

Figure 18:
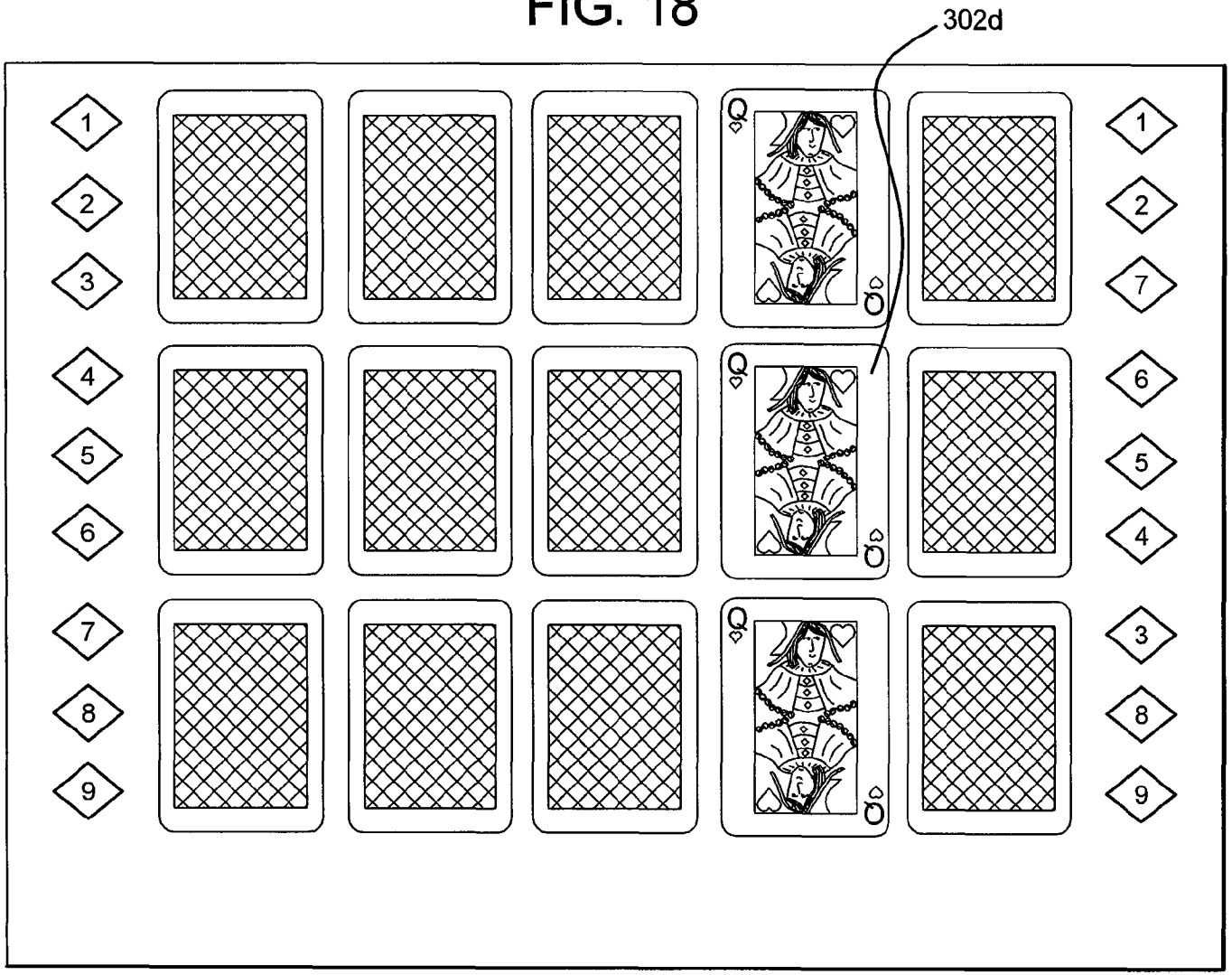
FIGS. 18, 19, 20 and 21 are top plan views of one embodiment disclosed herein illustrating a play of the multi-hand spin poker game according to one alternative holding strategy and the subsequent association of a solution screen with a poker hand seed.
Figure 19:
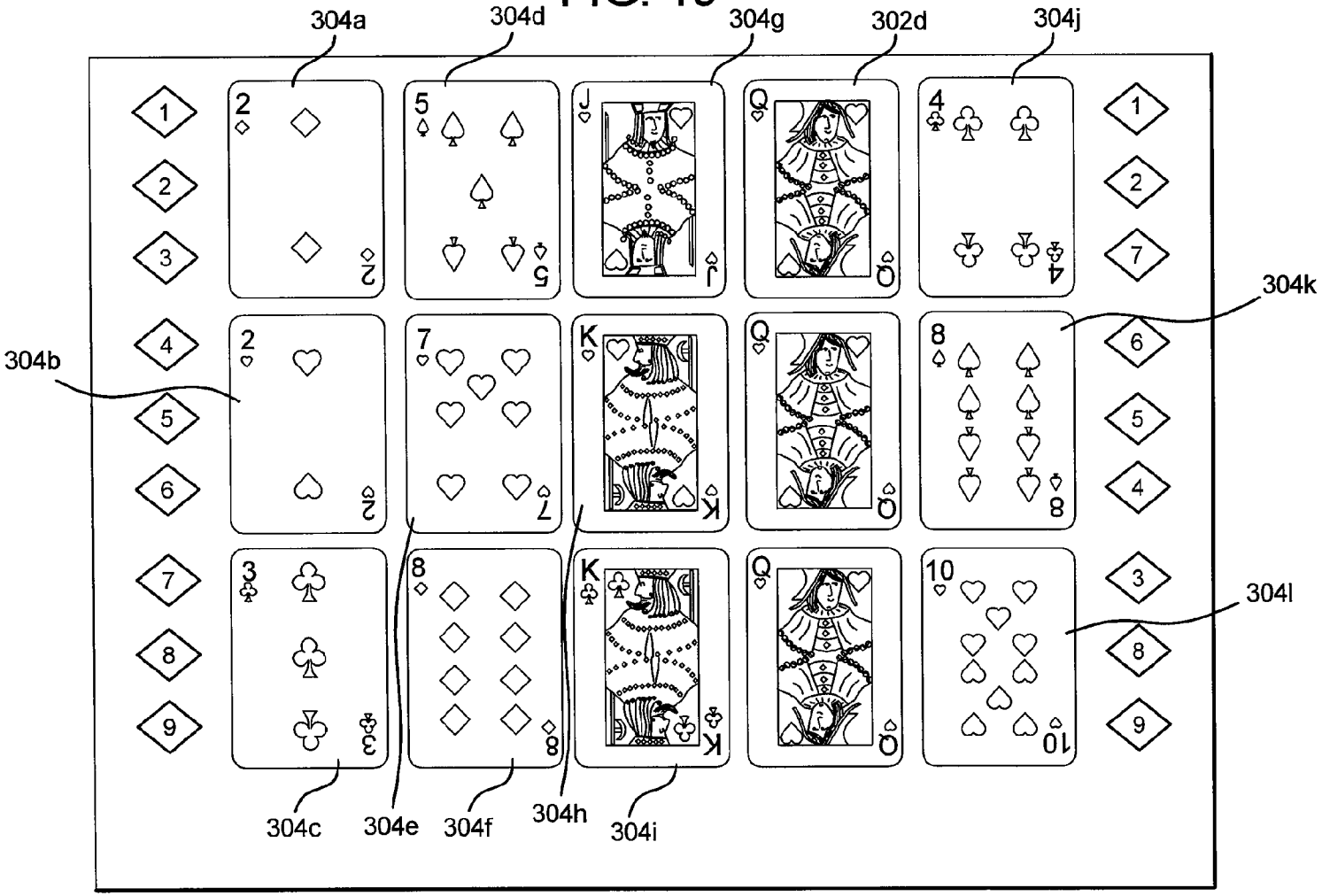

As illustrated in FIG. 18, the second alternative holding strategy for the poker hand seed of 1,028,113 is holding only the queen of hearts 302*d* and discarding the three of hearts, the jack of clubs, the six of diamonds and the nine of spades. Accordingly, if the queen of hearts is held in each playing card position on the fourth reel column and is thus held as the fourth playing card in each of the plurality of simultaneously played secondary poker hands, the gaming system attempts to find twelve playing cards (from the plurality of playing cards remaining in the shuffled deck) to generate in the appropriate playing card positions to form a plurality of poker hands which would result in one of the above-listed poker game outcome distributions associated with a payout of $3 previously associated with the selected poker hand seed of 1,028,113. In this case, as seen in FIG. 19, the gaming system generates the next twelve cards 304*a* to 304*l* from the deck (previously shuffled using the selected poker hand seed) into the remaining unoccupied playing card positions. These generated playing cards along with the queen of hearts held according to the alternative holding strategy form a plurality of poker hands.

Figure 20:
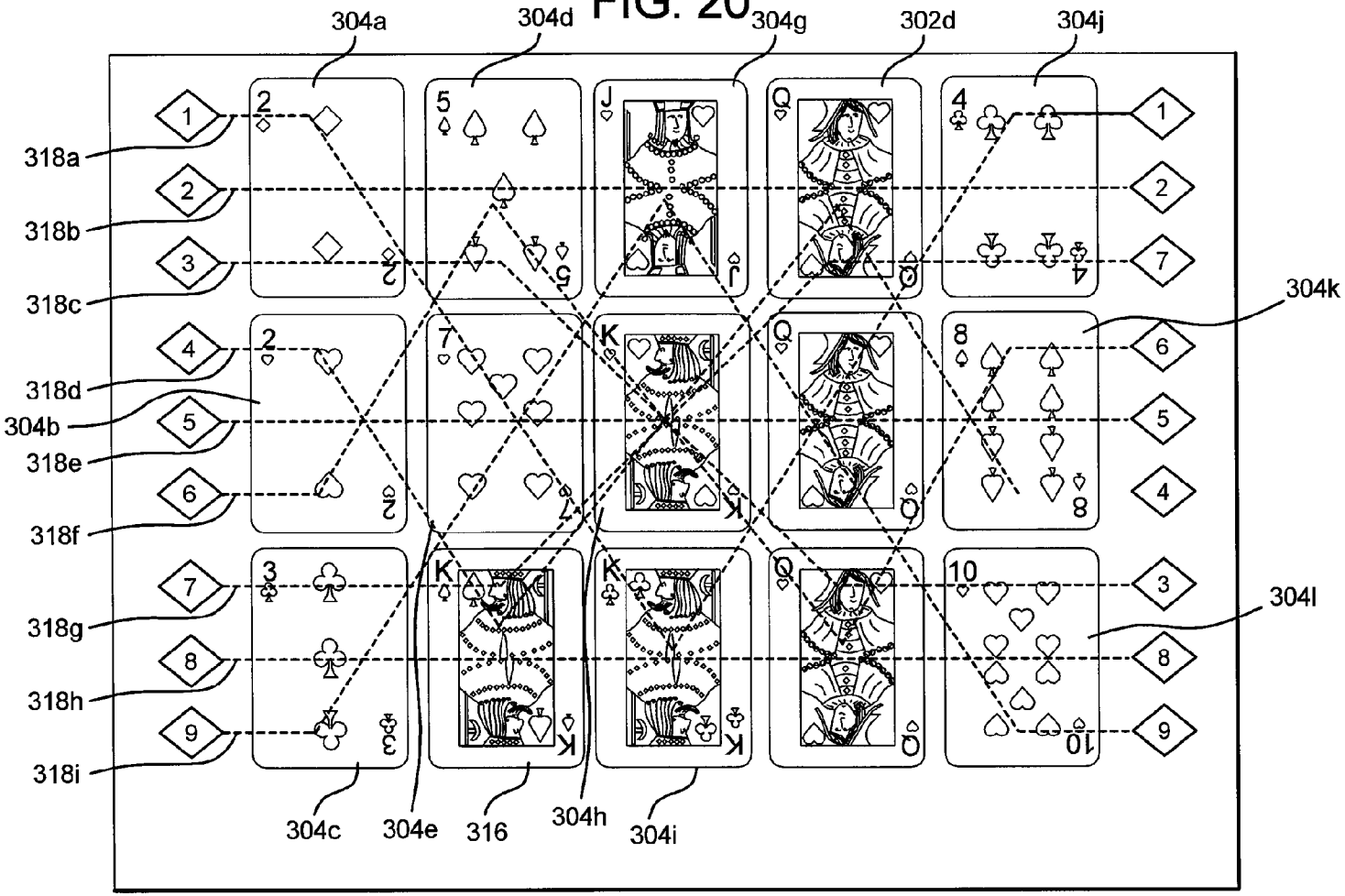

In the above-described example, the gaming system analyzes the nine formed poker hands to determine if any are associated with a winning playing card combination. According to an applicable paytable, the gaming system determines that if nine paylines are each equally wagered on these nine poker hands are associated with a total combined payout of zero credits. Accordingly, since this alternative holding strategy is not associated with the same payout of $3 as was previously associated with the selected poker hand seed of 1,028,113, one or more playing cards must be modified. In one embodiment, with reference to the different poker hand distributions that yield a total payout of $3, the gaming system utilizes an appropriate backfill algorithm to determine which playing cards to modify. For example, as seen in FIG. 20, based on the poker game outcomes which yield a total payout of $3, the queen of hearts held according to this alternative holding strategy and one or more of the generated playing cards, the gaming system utilizes an appropriate backfill algorithm to replace the generated eight of diamonds with the king of spades 316.

Figure 21:
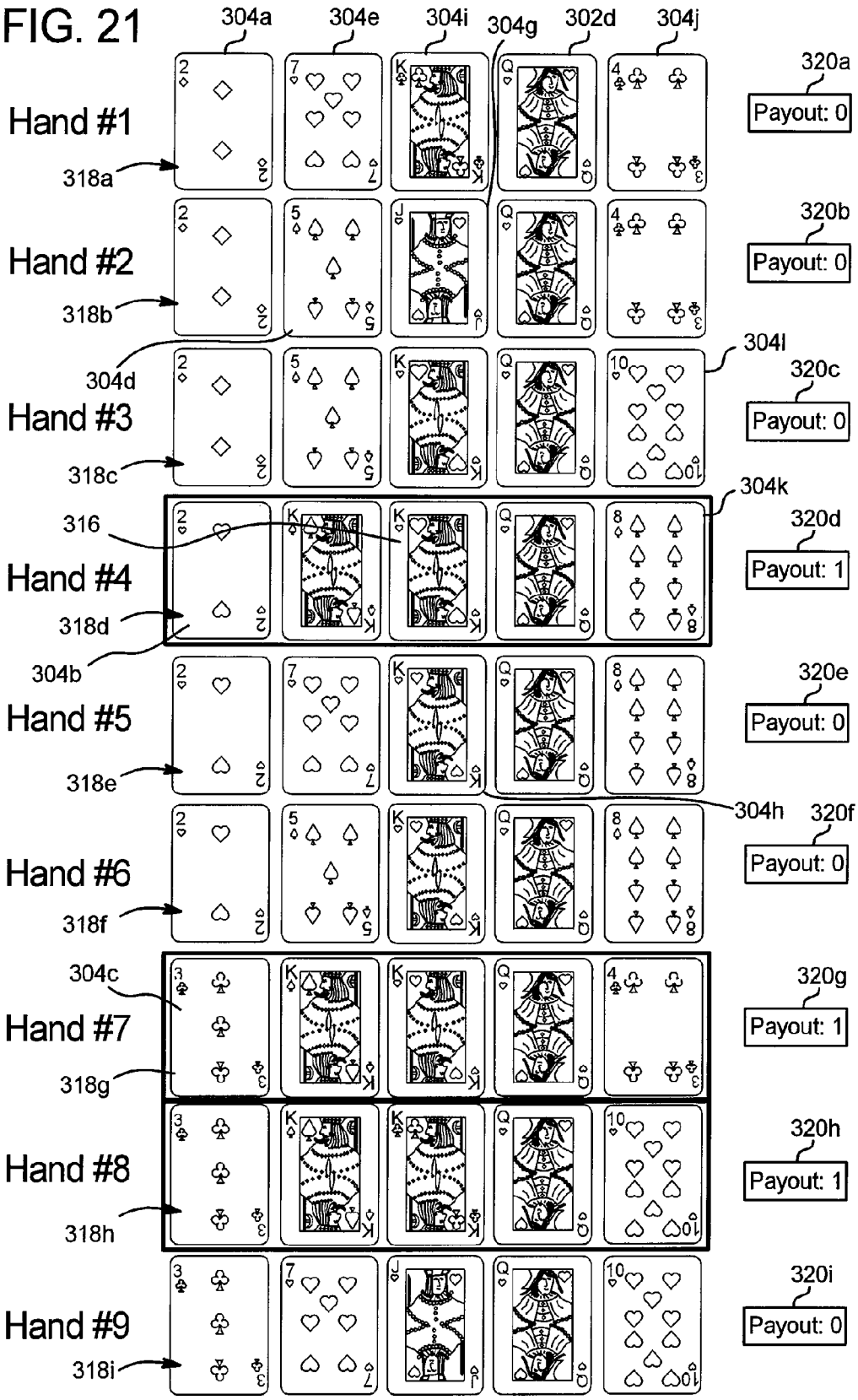

In this example, the gaming system analyzes the nine formed poker hands to determine if any are associated with a winning playing card combination. According to an applicable paytable, the gaming system determines that if nine paylines are each equally wagered on these nine poker hands are associated with a total combined payout of $3. That is, as illustrated in FIGS. 20 and 21, a payout of one credit 320*d* is associated with the pair of kings poker hand generated along payline #4 318*d*; a payout of one credit 320*g* is associated with the pair of kings poker hand generated along payline #7 318*g*; and a payout of one credit 320*h* is associated with the pair of kings poker hand generated along payline #8 318*h*.

Accordingly, since the alternative holding strategy of holding the queen of hearts, when modified, results in the same payout of $3 as was previously associated with the selected poker hand seed of 1,028,113, the solution for this modified alternative holding strategy is stored in association with the selected poker hand seed.

After determining at least one solution for each alternative holding strategy for the selected poker hand seed, the gaming system attempts to find a suitable solution for every other hold strategy the player may employ. In one embodiment, one or more of the these solution are stored for each alternative hold strategy the player may employ. That is, for every possible hold strategy the player may play for the selected poker hand seed, the gaming system attempts to find and store a solution which includes the playing cards held and any subsequent dealt playing cards, wherein the displayed playing cards in their displayed playing card positions form a plurality of poker hands with a total payout equal to the payout previously associated with the selected poker hand seed. In one embodiment, as described below, if the gaming system determines an applicable solution within a set amount of time, the gaming system does not store the determined solution in association with the hold strategy for the selected poker hand seed. On the other hand, if the gaming system does not determine the applicable solution in the set amount of time, the solution is stored.

In the example described above, after determining the solutions for the two alternative holding strategies, the gaming system attempts to find a suitable solution for any of the twenty-nine remaining ways to play the initial poker hand. It should be appreciated that the twenty-nine remaining ways to play the initial poker hand are the thirty-two original ways to play the five card poker hand minus the auto-hold strategy way to play and the two alternative hold strategies discussed above.

In one embodiment, the gaming system attempts to find a suitable solution for each remaining way to play by utilizing one or more custom algorithms. That is, taking into account the fact that at least one playing card generated in at least one playing card position is included in a plurality of individual poker hands, the gaming system utilizes one or more algorithms to attempt to find the appropriate playing cards to generate in the appropriate playing card positions to form a plurality of poker hands (along a plurality of wagered on paylines) which result in a total payout equal to the selected predetermined game outcome value. It should be appreciated that it is most advantageous to utilize such algorithms for the small payouts scenarios that will be provided to players most frequently, such as a payout of $3. For example, the algorithm may specify to generate a plurality of Jacks, a plurality of Queens, a plurality of Kings or a plurality of Aces (i.e., Jacks or Better playing cards) in the following playing card positions:

| | | | | |
|---|---|---|---|---|
| X | X | | | |
| X | | | | |
| X | | | | |
| X | X | | | |
| X | | | | |
| | X | | X | |
| | X | | | |
| | X | | | |
| | X | | | |
| | X | | X | |
| | X | | | |
| | X | | | X |

-continued

| | | | | |
|---|---|---|---|---|
| | X | | | |
| | X | | | |
| | X | | | |
| | X | | | X |
| | X | | | |
| | | X | | |
| | X | X | | |

In addition to generating Jacks or Better playing cards in each of the designated playing card positions, the algorithm directs the gaming system not to generate playing cards that can lead to any other winning combination in the remaining playing card positions. It should be appreciated that these displayed solutions are not all the possible solutions. It should be further appreciated that in the case where all nine paylines are played with equal bet amounts, each of these solutions can be flipped horizontally and or vertically and still work, due to the symmetry of the payline arrangements. That is, the symmetry with the plurality of paylines enables the poker game disclosed herein to be presented as a horizontal or vertical mirror image.

In one embodiment, each determined solution is stored in associated with the selected poker hand seed. In another embodiment, the gaming system stores one or more, but not all of the determined solutions associated with the selected poker hand seed. In one embodiment, the solution associated with the auto-hold strategy is not stored because the gaming system can redetermine this solution within a set amount of time during actual game play (i.e., by dealing the playing cards from the shuffled deck into the unoccupied playing card positions). In another embodiment, any other determined solutions which the gaming system can redetermine within a set amount of time during actual game play are not stored in associated with the selected poker hand seed. That is, if based on the playing cards held and the remaining playing cards in the deck, the gaming system determines in a set amount of time (or in a set number of attempts) which playing cards to generate in which playing card positions such that the total payout of the formed poker hands equals (or is substantially equal to) the payout associated with the selected poker hand seed, the gaming system can reproduce this determination during actual game play and the gaming system does not need to store the solution of which playing cards to generate in which playing card positions.

In one embodiment, not storing one or more solutions with each poker hand seed enables the table of solutions to be significantly compressed. Such compression enables the processor to search through the compressed tables quicker which requires less processing power and provides for a quicker game play. In another embodiment, when storing solutions, the gaming system does not specify suits (or enables one suit to be replaced with another suit). In this embodiment, by not storing information regarding which suits are associated with which playing cards for a given solution, the gaming system allows for up to 24:1 compression of the database or look-up table of different solutions for different poker hand seeds.

After determining the payout associated with the selected poker hand seed, the gaming system determines if each of the poker hand seeds in the generated set are associated with a payout and zero, one or more solutions. If not all of the poker hands seeds are each associated with a payout, the gaming system selects another poker hand seed, shuffles a deck based on the selected poker hand seed and proceeds as described above. If each of the poker hand seeds in the generated set are associated with a payout amount, the second database or look-up table is complete with a plurality of different poker hand seeds and zero, one or more solution which are associated with each poker hand seed.

In one alternative embodiment, to generate the second database or look-up table of solutions, the gaming system:

A) Runs simulated plays of the game collecting pay amounts for corresponding hand-sets;

B) Repeats the following steps for some number of iterations:

a. Starting with a different random seed for each iteration, shuffles the deck, takes the first 5 cards, applies auto-hold, and fills the screen with the remaining cards, b. Evaluates the screen and determines which hands are hit, and what the pay amount (P) is, c. Generates a list of the most intelligent hold strategies for the first five cards, d. Attempts to achieve the pay P for the given initial draw and each of the intelligent hold strategies using a poker hand building algorithm, and e. If the poker hand building algorithm produces a solution screen for every intelligent hold strategy, adds the seed and solution screens to the table;

C) Attempts to find solution screens for every hold strategy;

D) Stores any found solution screen from C) into a table;

E) Saves a compressed version of the table which only contains solution screens which required more than M iterations to find; and F) Removes the solution screens corresponding to the auto-hold.

Game Play

After determining the payout amount to associate with each poker hand seed, the gaming system is adapted for game play of a multi-play spin poker game. In one embodiment, a player selects a number of paylines to wager on (i.e., simultaneous poker hands to play) from one payline (or poker hand) to a designated number of paylines (or poker hands) and an amount to wager on each payline (i.e., each simultaneously played poker hand). In this embodiment, upon a player making such a wager, a predetermined game outcome or predetermined game outcome value is selected. The selected predetermined game outcome represents the outcome which will ultimately be provided to the player. It should be appreciated that the selected predetermined game outcome value must be provided to the player over the selected number of simultaneously played poker hands while taking into account the amount wagered on each of the paylines or simultaneously played poker hands.

Each predetermined game outcome includes an outcome component, such as a win, a loss, a secondary game triggering or other suitable outcome, with an associated payout amount. In one embodiment, the gaming system associates each predetermined game outcome value with a poker hand seed. In this embodiment, the gaming system selects a poker hand seed with a payout amount which corresponds with the payout amount of the predetermined game outcome value.

In one embodiment, the predetermined game outcome is selected by the central server or controller 12 and provided to the player at the gaming device 14. In this embodiment, each of a plurality of such gaming devices are in communication with the central server or controller. Upon a player initiating game play at one of the gaming devices, the initiated gaming device communicates a game outcome request to the central server or controller. Upon receiving the game outcome request, the central controller independently selects a predetermined game outcome value (or game outcome seed deterministic of a predetermined game outcome value) from a set or pool of predetermined game outcome values (or game outcome seeds) and flags or marks the selected predetermined game outcome value (or game outcome seed) as used. Once a predetermined game outcome value (or game outcome seed) is flagged as used, it is prevented from further selection from the set or pool and cannot be selected by the central controller upon another wager. The selected predetermined game outcome value (or game outcome seed) is communicated to the individual gaming device to be utilized in the poker game. In another embodiment, the gaming device selects one of the predetermined game outcome values (or game outcome seeds) stored in a memory device of the gaming device. In another embodiment, the gaming device generates a predetermined game outcome value and sends the generated predetermined game outcome value to a central controller for verification. If the central controller does not verify that the generated predetermined game outcome value may be used, the gaming device generates another predetermined game outcome value for verification.

In one embodiment, the central controller maintains at least one predetermined set or pool of predetermined game outcome values or game outcome seeds for each type of game provided on the gaming terminals. In an alternative embodiment, the central controller maintains a plurality of predetermined sets or pools of predetermined game outcome values for each type of provided game. In another embodiment, the central controller maintains a predetermined set or pool of predetermined game outcome values for each denomination of each type of game provided on the gaming terminals. In another embodiment, the central controller maintains at least one predetermined set or pool of predetermined game outcome seeds. Each game outcome seed is deterministic of a predetermined game outcome value. Other methods for storing the pool or set of predetermined game outcome values may be employed.

In one embodiment, each set or pool of predetermined game outcome values may include a plurality of each type of predetermined game outcome values. For example, a pool of one thousand game outcome values may include hundreds or thousands of a lower range payout (i.e., a win $1 game outcome) and one or few of the highest payout (i.e., a win $2250 game outcome). In one embodiment, a plurality of the game outcome value in the predetermined set or pool are different. In another embodiment, all of the predetermined game outcome values in the set or pool are different.

In one embodiment, after a predetermined game outcome value is selected, the gaming device selects one of the poker hand seeds associated with a payout amount equal to the predetermined game outcome value. In this embodiment, the gaming device accesses the table or database of which poker hand seeds are associated with which payouts to select one of the poker hand seeds which is associated with a payout amount equal to the selected predetermined game outcome value. It should be appreciated that if a plurality of poker hand seeds each yield payout amounts equal to the selected predetermined game outcome value, the gaming device randomly or otherwise selects one of the poker hand seeds.

In another embodiment, a predetermined game outcome value is determined for each of a plurality of linked or networked gaming devices based on the results of a Bingo or Keno game. In this embodiment, each individual gaming device utilizes one or more Bingo or Keno games to determine the predetermined game outcome value provided to the player for the interactive game played at that gaming device. In one embodiment, the Bingo or Keno game is displayed to the player. In another embodiment, the Bingo or Keno game is not displayed to the player, but the results of the Bingo or Keno game determine the predetermined game outcome value for the interactive game.

In these embodiments, as each gaming device is enrolled in a Bingo (or Keno) game, such as upon an appropriate wager or engaging an input device, the enrolled gaming device is provided a different Bingo card. Each Bingo card consists of a matrix or array of elements, wherein each element is designated with a separate indicia, such as a number. It should be appreciated that each different Bingo card includes a different combination of elements. For example, if four Bingo cards are provided to four enrolled gaming devices, the same element may be present on all four of the Bingo cards while another element may solely be present on one of the Bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a "daub" button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment insures that at least one bingo card will win the bingo game and thus at least one enrolled gaming device will provide a predetermined winning game outcome to a player. It should be appreciated that other suitable methods for selecting or determining one or more predetermined game outcome values may be employed.

In one example of the above-described embodiment, the predetermined game outcome value may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, the wagered on gaming device enrolls in a bingo game. In this embodiment, a bingo server calls the bingo balls that result in a specific outcome and a specific pay amount for the gaming machine. The gaming device contains a list of seeds and win amounts, very similar to the pool of predetermined game outcomes described above. Given the Bingo game's pay amount, the gaming device finds a seed which is associated with the pay amount. It should be appreciated that any suitable manner of selecting or generating a predetermined game outcome may be implemented with the gaming system disclosed herein.

Figure 22:
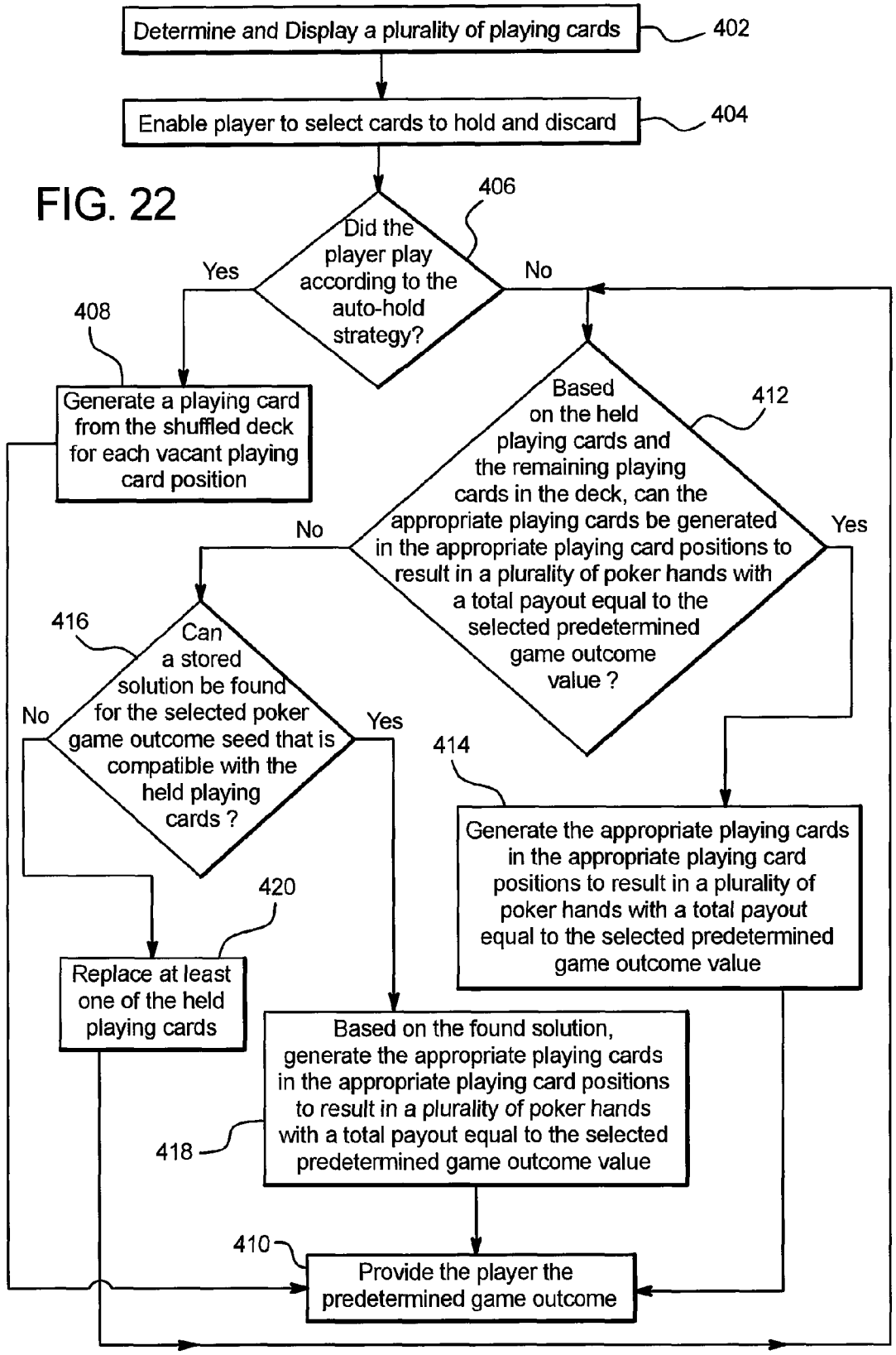
FIG. 22 is a flowchart of one embodiment disclosed herein illustrating a play of the multi-hand spin poker game wherein the gaming device determines, based on any playing cards held by a player, how to provide the predetermined game outcome to the player.

Referring to FIG. 22, in one embodiment, after selecting, determining or receiving the predetermined game outcome (and either determining an associated poker game seed or selecting a poker game seed which is associated with the same payout as the predetermined game outcome value), the gaming device determines and displays a plurality of playing cards as indicated in block 402. The displayed playing cards are based on the poker game seed for the predetermined game outcome value. In this embodiment, the gaming device applies the selected poker game seed through one or more selected deterministic random number generating algorithms to determine and display the plurality of playing cards determined by or otherwise associated with the selected poker game seed. As described above, the selected poker hand seed is deterministic of a plurality of playing cards.

Figure 23:
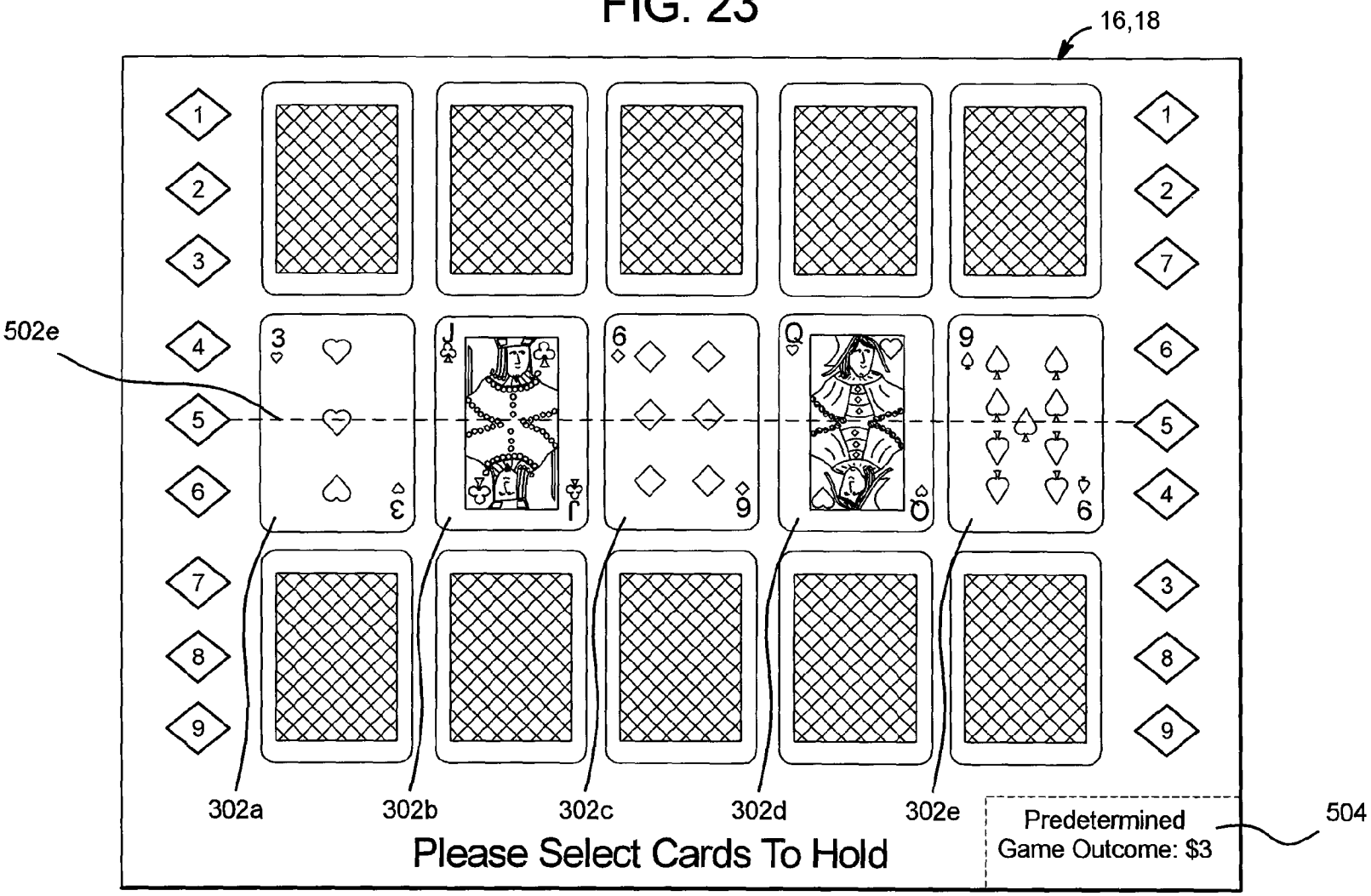
FIGS. 23, 24, 25, 26, 27, 28 and 29 are top plan views of one embodiment disclosed herein illustrating different multi-hand spin poker game sequences based on which playing cards the player designated to hold and which playing cards the player designated to discard.

For example, if the selected predetermined game outcome is associated with a payout of $3 and the poker hand seed of 1,028,113 (which is associated with a payout of $3) is selected, the gaming device utilizes the selected poker hand seed of 1,028,113 to shuffle a deck of playing cards. After shuffling the deck of playing cards according to the selected poker hand seed, the gaming device draws, generates or deals a designated number of playing cards of the shuffled deck along a designated payline. In this example, as illustrated in FIG. 23, the first five playing cards of the shuffled deck (i.e., the three of hearts 302*a*, the jack of clubs 302*b*, the six of diamonds 302*c*, the queen of hearts 302*d*, and the nine of spades 302*e*) are generated or displayed to the player along payline #5 502*e* as the initial poker hand for the selected poker hand seed. It should be appreciated that the initial poker hand may be generated along any of the paylines. It should be further appreciated that the selected predetermined game outcome 504 is displayed for illustration purposes and is not displayed to the player.

In one embodiment, the plurality of provided playing cards form an initial primary poker hand. In addition to the initial primary poker hand, the gaming device simultaneously displays at least one and preferably a plurality of poker hands along zero, one or more of the paylines. In one embodiment, the simultaneously displayed poker hands each include the same playing cards as the initial primary poker hand. In another embodiment, the simultaneously displayed poker hands do not initially include any playing cards. In this embodiment, the gaming device enables the player to simultaneously play a plurality of poker hands wherein the held cards from the primary poker hand are held or carried over into each of the other simultaneously played poker hands as described below. For example, in the nine-hand poker game (i.e., the player wagered on nine paylines to play nine poker hands) illustrated in FIG. 23, the gaming device enables the player to simultaneously play nine poker hands wherein the held cards from the primary poker hand are held, carried over or replicated into each of the eight other simultaneously played poker hands. It should be appreciated that even though zero, one or more cards may be carried over from one or more simultaneously played poker hands, each simultaneously played poker hand is evaluated independent of the remaining simultaneously played poker hands.

In one embodiment, the simultaneously displayed secondary poker hands each include the same playing cards as or equivalent playing cards to the initial primary poker hand. For example, if the initial primary poker hand includes the five of hearts playing card and five of clubs playing cards, a first secondary poker hand may include the five of diamonds playing card and the five of hearts playing card. In this example, another secondary poker hand may includes the seven of spades playing card and the seven of clubs playing card. It should be appreciated that in this embodiment, as long as the same poker game outcomes are possible on the draw for each secondary poker hand, the actual playing cards displayed in each of the secondary poker hands does not matter. In another embodiment, the simultaneously displayed poker hands do not initially include any playing cards.

In one embodiment, the playing cards are dealt from a single fifty-two card deck. In another embodiment, the playing cards are dealt from a plurality of fifty-two card decks. In another embodiment, the playing cards are selected from a predetermined set of cards. In another embodiment, the playing cards are selected from a deck of more than fifty-two playing cards, such as a deck including one or more "joker" or wild playing cards. In this embodiment, a joker or wild playing card may substitute for any other playing card or a limited number of playing cards.

In one embodiment, the number of playing cards in each initial poker hand and each second or final poker hand (i.e., the poker hands after the draw) is the same. In another embodiment, the number of playing cards in each of the initial poker hands and in each of the second poker hands are different. In one embodiment, the second or final poker hands have fewer cards than the initial poker hands. In another embodiment, the second or final poker hands have more cards than the initial poker hands. For example, each initial poker hand may include four playing cards and each of the second poker hands may include five playing cards. In this embodiment, the player is enabled to hold or discard zero to four of the initially dealt playing cards and the gaming device replaces/draws the number of cards that the player requested plus one additional card. This additional card provides that the player's second poker hand is provided an outcome based on the player's five-card second poker hand.

In another embodiment, the set of playing cards to draw from is the initial set of playing cards with the previously dealt playing cards removed. For example, if the poker game is played with a fifty-two card deck, then the set of playing cards to draw from is the forty-seven cards remaining after the five initial playing cards are provided to the player. In another embodiment, the set of playing cards to draw from is the entire initial set of playing cards from which the initial poker hand was selected from (i.e., a full fifty-two card deck). In another embodiment, the set of playing cards is a randomly chosen subset of playing cards. In another embodiment, the set of cards to draw from may be merged with other sets of playing cards, such as the playing cards the player designated to hold, the playing cards the player designated to discard, a randomly selected subset of playing cards held cards or any other suitable set of cards.

After the player is provided an initial poker hand along a designated payline, the gaming device enables the player, using one or more input devices, to select one or more of the initially dealt playing cards in the primary poker hand to hold or to discard as indicted in block 404 of FIG. 22. As described above, the held playing cards in the primary hand are also held in one, more or each of the other simultaneously displayed hands of playing cards. It should be appreciated that even though zero, one or more cards may be carried over from one or more simultaneously played poker hands, each simultaneously played poker hand is played apparently independent of the remaining simultaneously played poker hands. Appropriate messages such as "PLEASE SELECT CARDS TO HOLD" may be provided to the player visually, or through suitable audio or audiovisual displays.

Figure 24:
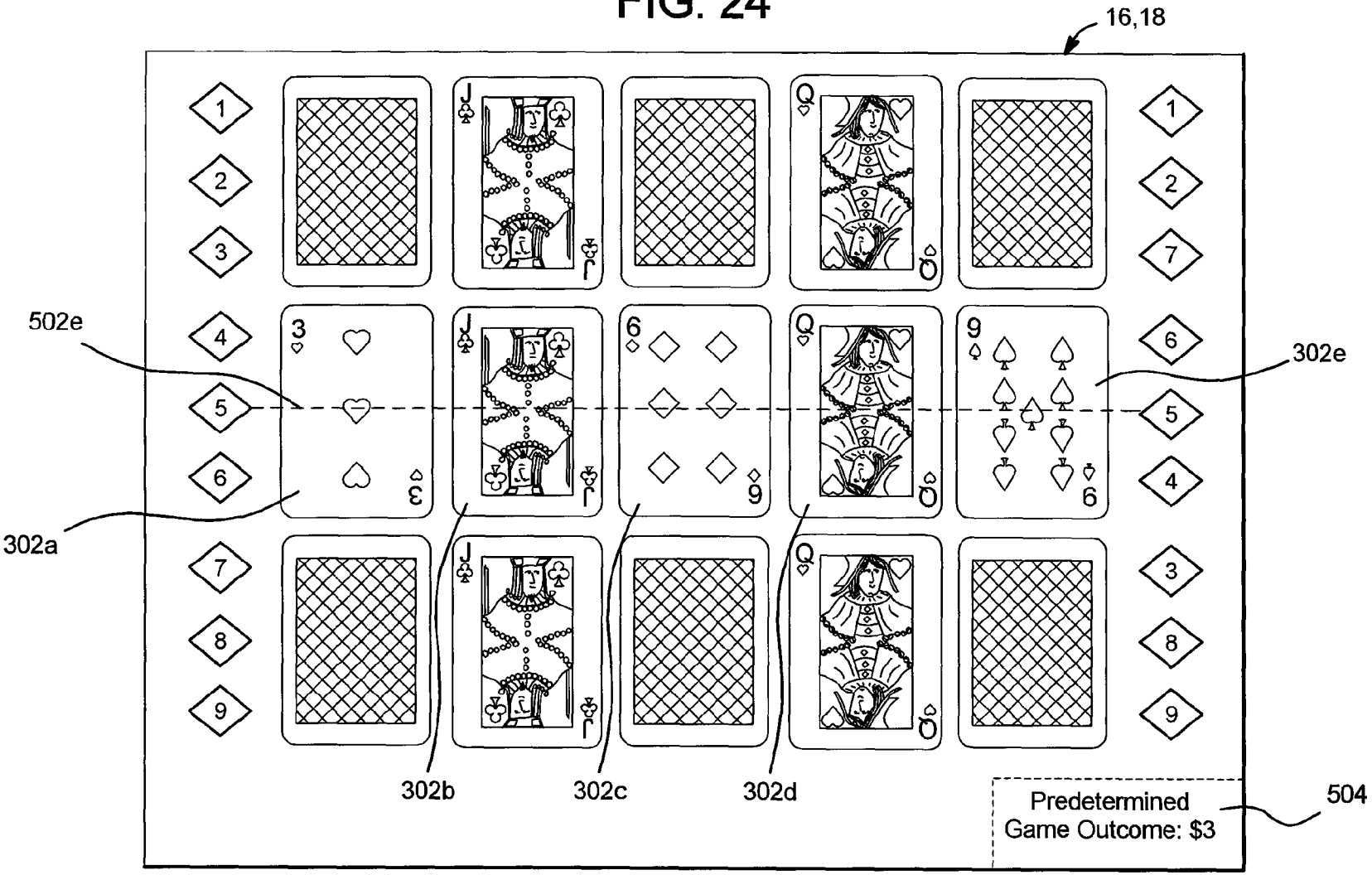
Figure 25:
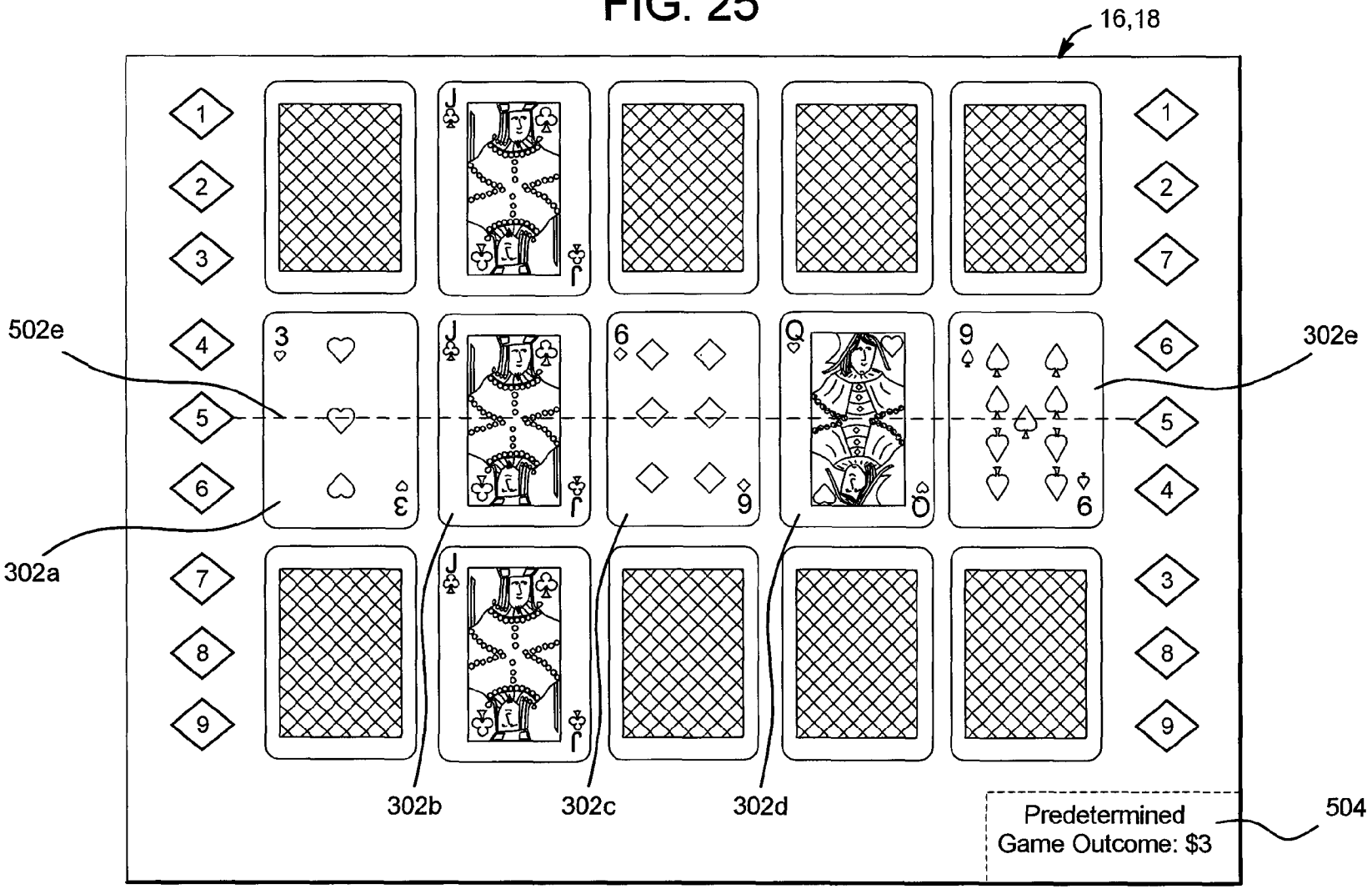
Figure 26:
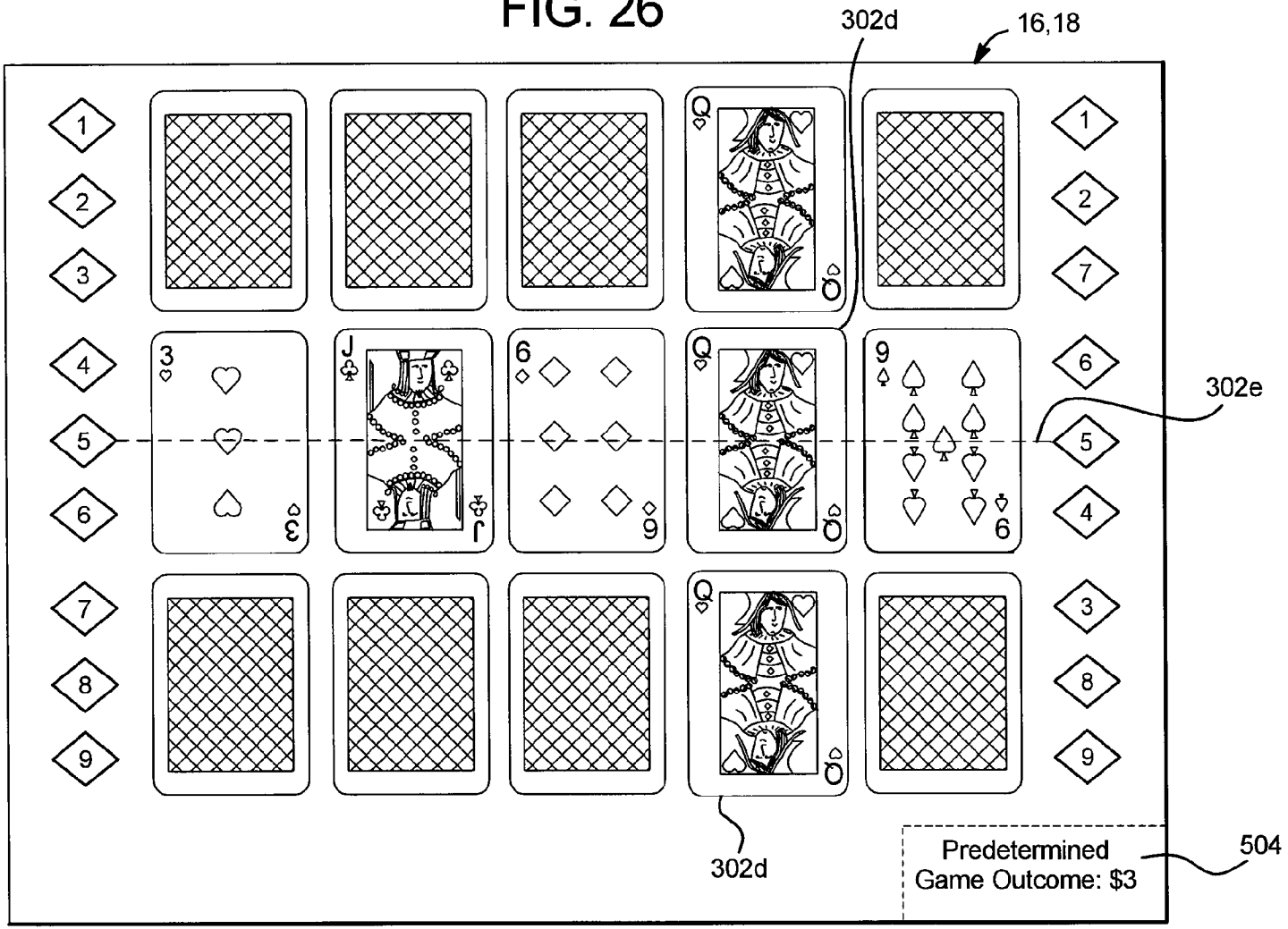

As seen in FIGS. 23 and 24, if the player selects to hold the jack of clubs 302*b* and the queen of hearts 302*d*, the jack of clubs is replicated in each playing card position of the second reel column, the queen of hearts is replicated in each playing card position of the fourth reel column and thus these two held cards are replicated, carried over or otherwise displayed in each of the other simultaneously displayed poker hands. Alternatively, as seen in FIGS. 23 and 25, if the player selects to hold the jack of clubs 302*b*, the jack of clubs is replicated in each playing card position of the second reel column, and the jack of clubs is replicated, carried over or otherwise displayed in each of the other simultaneously displayed poker hands. Alternatively, as seen in FIGS. 23 and 26, if the player selects to the queen of hearts 302*d*, the queen of hearts is replicated in each playing card position of the fourth reel column and thus the queen of hearts is replicated, carried over or otherwise displayed in each of the other simultaneously displayed poker hands.

In addition to enabling the player to designate which playing cards to hold and which playing cards to discard, in one embodiment, the gaming device utilizes the stored table of different distributions of poker game outcomes which would result in each payout amount (FIG. 8) to determine which distributions of poker game outcomes would result in a total payout equal to or substantially equal to the selected predetermined game outcome value. In this embodiment, the gaming devices utilizes the stored distribution table which corresponds to the applicable pay table, the number of simultaneously played poker hands and the amount wagered on each of the simultaneously played poker hands. For example, for the selected predetermined game outcome value of $3 the gaming device utilizes the stored table of poker game outcome distributions to determine that a first entry for a payout of $3 requires one three-of-a-kind poker hand and eight losing poker hands; a second entry for a payout of $3 requires three two-pair poker hands and six losing poker hands; a third entry for a payout of $3 requires two two-pair poker hands, one jacks or better poker hand and six losing poker hands; a fourth entry for a payout of $3 requires on two-pair poker hand, two jacks or better poker hands and a six losing poker hands; and a fifth entry for a payout of $3 requires three jacks or better poker hands and six losing poker hands.

In one embodiment, after the player designates which playing cards to hold and which playing cards to discard, the gaming device determines if the player followed the auto-hold strategy for the initial poker hand as indicated in diamond 406. If the player followed the auto-hold strategy for the initial poker hand as indicated in block 408, the gaming device proceeds in dealing, generating or drawing a playing card from the shuffled deck for each discarded playing card and for each vacant playing card position in each of the secondary poker hands to form a plurality of final poker hands. The gaming device analyzes each of the final poker hands generated along each wagered on payline to determine the payout associated with that poker hand. The gaming device determines a total combined payout of each of the analyzed poker hands. As indicated in block 410, the gaming device provides the determined total payout to the player. It should be appreciated that since the payout of the selected poker hand seed (which is equal to the payout associated with the selected predetermined game outcome value) was previously determined based on following an auto-hold strategy, if the player follows the auto-hold strategy during game play, the payouts associated with each of the provided final poker hands for the wagered on paylines will add up to the selected predetermined game outcome value.

Figure 27:
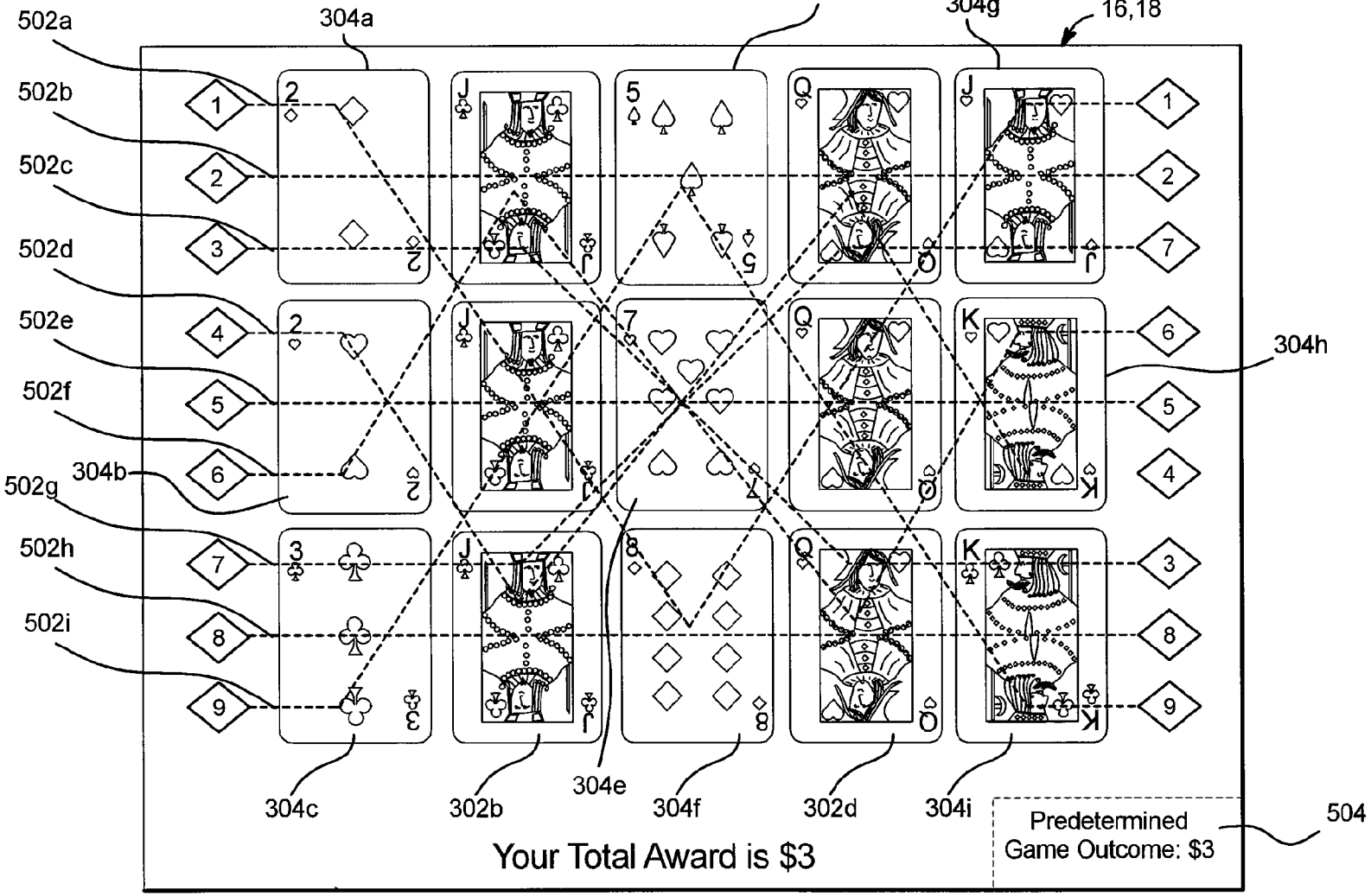

For example, as seen in FIGS. 24 and 27, if the player followed the auto-hold strategy and held the jack of clubs 302*b* and the queen of hearts 302*d* (and discarded the three of hearts 302*a*, the six of diamonds 302*c* and the nine of spades 302*e*), the gaming device deals the next nine cards from the shuffled deck into the remaining unoccupied playing card positions. That is, the gaming system deals playing cards 304*a* to 304*i*, in order from the shuffled deck, to the three playing card positions left vacant from the three non-held discarded playing cards of the initial poker hand and the six unoccupied playing card positions from the secondary poker hands to form a plurality of final poker hands. Since in this example the player wagered equally on all nine paylines, gaming device analyzes each of the final poker hands to determine a payout associated with each poker hand. As described above, FIG. 13 illustrates each individual final poker hand and the individual payouts associated with these final poker hands. The total combined payout or sum of each of the analyzed poker hands which is equal to the selected predetermined game outcome value, in this case $3, is provided to the player. Appropriate messages such as "YOUR TOTAL AWARD IS 3" may be provided to the player visually, or through suitable audio or audiovisual displays.

In one embodiment, if the player did not follow the auto-hold strategy for the initial poker hand, as indicated in diamond 412, the gaming device evaluates the set of playing cards selected by the player to hold and determines if, based on the held playing cards and the remaining playing cards in the deck, the appropriate playing cards can be dealt, generated or drawn in the appropriate playing card positions to result in a plurality of poker hands (generated along the wagered on paylines) with a total payout equal to the selected predetermined game outcome value. In one embodiment, the gaming device attempts to determine, for a set or limited amount of time, the appropriate playing cards to generate in the appropriate playing card positions to result in a plurality of poker hands with a total payout equal to the selected predetermined game outcome value. In another embodiment, the gaming device attempts to determine, in a set or limited number of attempts, the appropriate playing cards to be generated in the appropriate playing card positions to result in a plurality of poker hands with a total payout equal to the selected predetermined game outcome value.

In this embodiment, random permutations of payline and reel ordering are necessary because it is not expected that the gaming device will determine a solution of which playing cards to generate in which playing card positions (to result in a plurality of poker hands with a total payout equal to the selected predetermined game outcome value) on the first attempt. That is, many attempts to determine which playing cards to generate in which playing card positions will be made as the gaming device explores as many different playing card layouts as possible. It should be appreciated that it is unlikely that the gaming device running a deterministic algorithm will successfully determine which playing cards to generate in which playing card positions (to result in a plurality of poker hands with a total payout equal to the selected predetermined game outcome value) on a nine-payline poker game with winning poker hands on a majority of the paylines because after the gaming device generates playing cards for only three paylines (i.e., only three individual poker hands), the majority of the playing cards in a majority of the playing card positions (and thus the remaining paylines and remaining poker hands) are already determined.

In one embodiment, if the gaming device determines, in the set or limited amount of time (or in the set number of attempts) the appropriate playing cards to generate in the appropriate playing card positions to result in a plurality of poker hands with a total payout equal to the selected predetermined game outcome value, as indicated in blocks 414 and 410 of FIG. 22, the gaming device displays such determined playing cards and provides the player the selected predetermined game outcome value.

In one embodiment, for each vacant playing card position, the gaming device generates a playing card from the previously shuffled deck of playing cards, wherein each generated playing card is generated in order. For example, if the gaming device must generate playing cards for twelve vacant playing card positions, the gaming device generates the next twelve playing cards from the shuffled deck of playing cards. In this embodiment, the gaming device determines if the generated playing cards form a plurality of poker hands associated with a total payout equal to the selected predetermined game outcome value. If the generated playing cards form a plurality of poker hands associated with a total payout equal to the selected predetermined game outcome value, the gaming device generates the determined playing cards in the determined playing card positions and provides the player the selected predetermined game outcome value.

Figure 28:
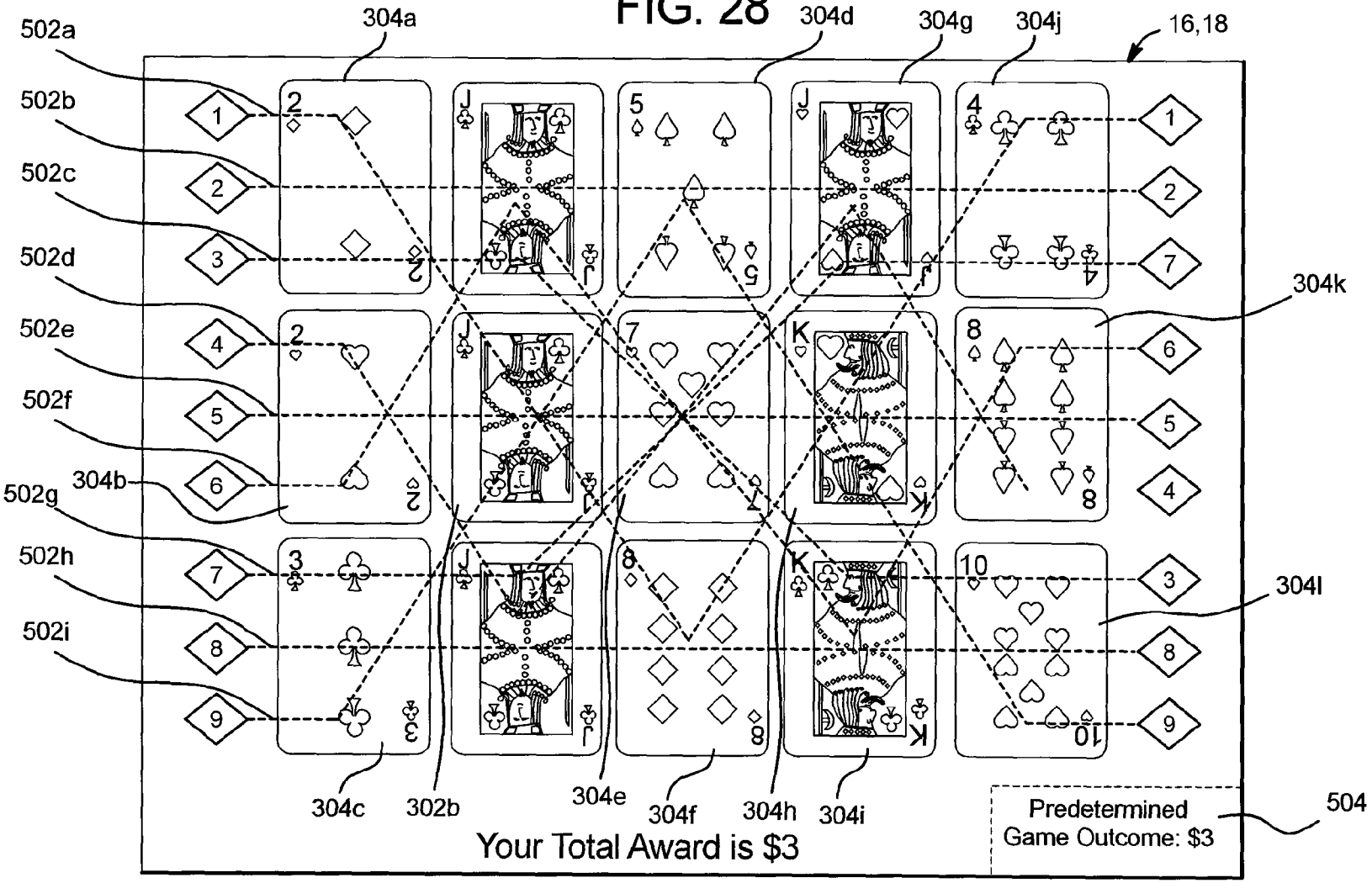

For example, as seen in FIGS. 25 and 28, if the player held the jack of clubs 302*b* (and discarded the three of hearts 302*a*, the six of diamonds 302*c*, the queen of hearts 302*d* and the nine of spades 302*e*), the gaming device determines that based on the held jack of clubs, the appropriate playing cards can be generated in the appropriate playing card positions to result in a plurality of poker hands (along each wagered on payline) with a total payout equal to the selected predetermined game outcome value of $3. In this case, the gaming device determines that generating playing cards 304*a* to 304*l* in the appropriate playing card positions results in a plurality of poker hands with a total payout of $3 (which is equal to the selected predetermined game outcome value). As described above, FIG. 17 illustrates each individual final poker hand and the individual payouts associated with these final poker hands. Accordingly, the gaming device displays the determined playing cards 304*a* to 304*l* and provides the player the selected predetermined game outcome value. Appropriate messages such as "YOUR TOTAL AWARD IS 3" may be provided to the player visually, or through suitable audio or audiovisual displays.

In one embodiment, for each vacant playing card position, the gaming system generates any playing card from the previously shuffled deck of playing cards regardless of the order of the shuffled deck. In this embodiment, the gaming system utilizes each of the remaining playing cards in the deck and attempts to find the appropriate playing cards to generate in the appropriate playing card positions to form a plurality of poker hands with a total payout equal to the selected predetermined game outcome value.

In another embodiment, the gaming device utilizes the stored table of different distributions of poker game outcomes which would result in each payout amount (as seen in FIG. 8) to determine which distributions of poker game outcomes would result in a total payout equal to or substantially equal to the payout associated with the selected predetermined game outcome. In this embodiment, the gaming device utilizes the stored distribution table which corresponds to the applicable pay table, the number of simultaneously played poker hands and the amount wagered on each of the simultaneously played poker hands. For example, for the payout of $3 associated with the selected predetermined game outcome, the gaming device utilizes the stored table of poker game outcome distributions to determine that a first entry for a payout of $3 requires one three-of-a-kind poker hand and eight losing poker hands; a second entry for a payout of $3 requires three two-pair poker hands and six losing poker hands; a third entry for a payout of $3 requires two two-pair poker hands, one jacks or better poker hand and six losing poker hands; a fourth entry for a payout of $3 requires one two-pair poker hand, two jacks or better poker hands and six losing poker hands; and a fifth entry for a payout of $3 requires three jacks or better poker hands and six losing poker hands.

In this embodiment, to determine which playing cards to generate in which playing card positions, the gaming device evaluates the set of playing cards the player designated to hold and determines which poker game outcomes are possible based on the held playing cards and the remaining playing cards in the deck. The gaming device accesses the stored table of different distributions of poker game outcomes which result in each payout amount and the previous determination regarding which poker game outcomes are possible based on the held playing cards. In this embodiment, the gaming device determines a distribution of outcomes that provides a total payout equal to selected predetermined game outcome value. That is, the distribution table is sorted by payout amount and by win categories used within each payout amount. Accordingly, given a payout amount and a set of win categories possible (as determined by the player's held playing cards), the gaming device first searches the table for the entries with the matching payout amount and then searches those entries for win categories used that are compatible with the given win categories possible. If a compatible distribution is determined (utilizing the stored table of different distributions of poker game outcomes which would result in each payout amount and the previous determination regarding which poker game outcomes are possible based on the held playing cards), the gaming device selects one of the compatible distributions and attempts to utilize the selected distribution to determine which playing cards need to be generated in which playing card positions to generate a plurality of poker hands with a total payout equal to the selected predetermined game outcome value. If the gaming device determines the appropriate playing cards for the selected compatible distribution, the gaming device generates these determined playing cards in the determined playing card positions and provides the player the selected predetermined game outcome value. If the gaming device does not determine the appropriate playing cards for the selected compatible distribution, the gaming device selects another compatible distribution, if any, and repeats this process.

In one embodiment, if the gaming device is unable to determine the appropriate playing cards to generate in the appropriate playing card positions to result in a plurality of poker hands with a total payout equal to the selected predetermined game outcome value in the set amount of time (or in the set number of attempts), as indicated in diamond 416, the gaming device attempts to find or determine a stored solution for the selected poker game outcome seed that is compatible with the playing cards the player designated to hold and the playing cards the player designated to discard. In this embodiment, the gaming device accesses the previously stored set of solutions associated with the selected poker hand seed and tries to find a solution which includes the same playing cards previously held by the player. That is, if the player designated to hold two of the five playing cards in the initial poker hand, the gaming device determines if a stored solution (previously associated with the selected poker game) exists which includes the two playing cards the player designated to hold and results in a distribution of poker game outcomes which matches at least one of the poker game outcome distributions associated with selected predetermined game outcome. If the gaming device determines a stored solution associated with the selected poker hand seed which includes the playing cards held by the player, based on the determined solution, as indicated in blocks 418 and 410, the gaming device displays the appropriate playing cards in the appropriate playing card positions and provides the player the selected predetermined game outcome value. That is, the gaming system disclosed herein also provides that an algorithm searches for a solution using a deterministic random number generator, but only searches for a set length of time. If the algorithm fails to find a solution in the set length of time, the gaming system utilizes a table of solutions to look up an applicable solution.

Figure 29:
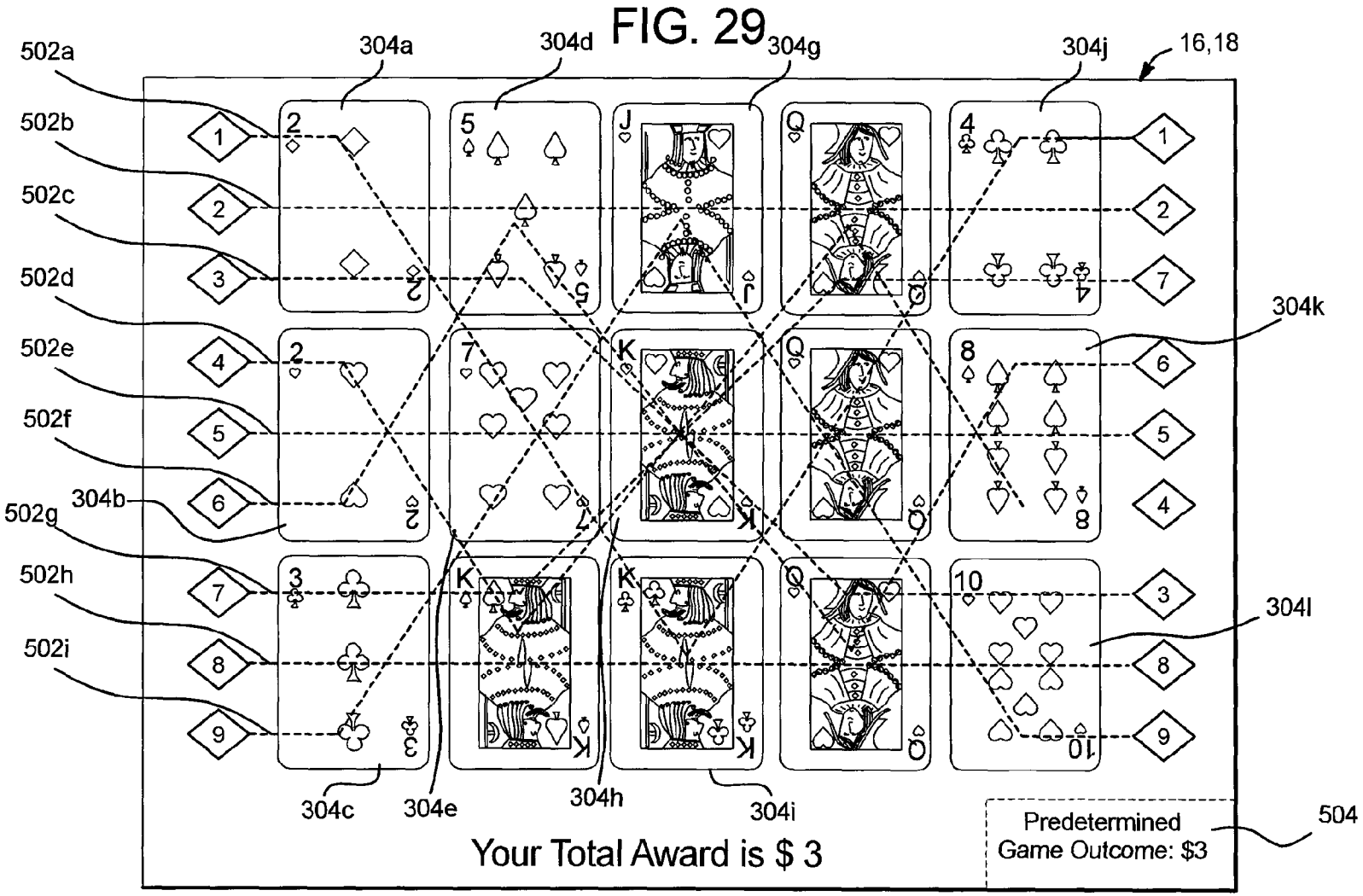

For example, as seen in FIGS. 26 and 29, if the player held the queen of hearts 302*d* and discarded the remaining playing cards, the gaming device determines that, after a suitable amount of time trying, a plurality of poker hands (which each include the held queen of hearts) cannot be formed with a total payout equal to the selected predetermined game outcome value of $3. Accordingly, in this example, the gaming device finds the stored solution which includes the held queen of clubs and is associated with a payout of $3. As seen in FIGS. 21 and 29, based on the found solution, the gaming device generates a plurality of playing cards in a plurality of playing card positions to form a plurality of poker hands with a total payout equal to the selected predetermined game outcome value of $3. The gaming device thus provides the player the selected predetermined game outcome value of $3. Appropriate messages such as "YOUR TOTAL AWARD IS 3" may be provided to the player visually, or through suitable audio or audiovisual displays.

In one embodiment, if the gaming device is unable to determine the appropriate playing cards to place in the appropriate playing card positions to yield a plurality of poker hands with a total payout equal to the selected predetermined game outcome value, the gaming device modifies at least one aspect of the poker game. In one embodiment, as indicated in block 420 of FIG. 22, the gaming device replaces one or more of the player's held playing cards with different playing cards. In different embodiments, the replaced playing cards are predetermined, randomly determined, determined based on the player's wager, determined based on the player's status (e.g., determined through a player tracking system), determined from the occurrence of one or more symbols or determined based on any other suitable method. In another embodiment, the gaming device overrides the player's designation regarding which playing cards to hold and which playing cards to discard and forces the player to follow an alternative holding strategy. In these embodiments, after modifying one or more aspects of the played poker game, the gaming device returns to diamond 412 and determines if, based on the modified held playing cards and the remaining playing cards in the deck, the appropriate playing cards can be dealt, generated or drawn in the appropriate playing card positions to result in a plurality of poker hands (generated along the wagered on paylines) with a total payout equal to the selected predetermined game outcome value. It should be appreciated that even if the gaming device must modify one or more aspects of the played poker game, when the appropriate playing cards are ultimately displayed in the appropriate playing card positions, the gaming device provides the player the selected predetermined game outcome value.

In one embodiment, if the gaming device is unable to determine the appropriate playing cards to generate in the appropriate playing card positions to result in a plurality of poker hands (generated along the wagered on paylines) with a total payout equal to the selected predetermined game outcome value and the gaming device is further unable to find a stored solution for the selected poker game outcome seed that is compatible with the playing cards the player designated to hold and the playing cards the player designated to discard, the gaming device overrides the player's designation regarding which playing cards to hold and which playing cards to discard and forces the player to follow the auto-hold strategy. In this embodiment, the gaming device proceeds as described above (i.e., returns to block 408 of FIG. 22) regarding the player following the auto-hold strategy.

In another embodiment, if the gaming device is unable to determine the appropriate playing cards to generate in the appropriate playing card positions to result in a plurality of poker hands (generated along the wagered on paylines) with a total payout equal to the selected predetermined game outcome value and the gaming device is further unable to find a stored solution for the selected poker game outcome seed that is compatible with the playing cards the player designated to hold and the playing cards the player designated to discard, the gaming device overrides the player's designation regarding which playing cards to hold and which playing cards to discard and forces the player to follow one of the alternative hold strategies for the selected poker hand seed. In this embodiment, the gaming device proceeds as described above regarding the player following the alternative hold strategy.

It should be appreciated that since one or more playing cards generated in one or more playing card positions are included in a plurality of poker hands, the appropriate placement of each playing card in the appropriate playing card position is necessary to insure that a plurality of poker hands are formed with a total payout equal to the payout of the predetermined game outcome. That is, in addition to determining, based on the held playing cards and the remaining playing cards in the deck, which playing cards must be generated to form a plurality of poker hands with a total payout equal to selected predetermined game outcome value, the gaming device must determine if these determined playing cards can each be generated in the appropriate playing card position such that a plurality of poker hands are formed with a total payout equal to the predetermined game outcome value. For example, even if the gaming device determines, based on the held playing cards and the remaining playing cards in the deck, which playing cards to generate to form a plurality of poker hands (along a plurality of wagered on paylines) with a total payout equal to the predetermined game outcome value, if the gaming device is unable to place such playing cards in the appropriate playing card positions, the gaming device must either determine another plurality of playing cards to place in the appropriate playing card positions or the gaming device must utilize one of the stored solution associated with the selected poker hand seed. In other words, the gaming system disclosed herein utilizes an algorithm and/or a look-up table of solutions to determine which playing cards to generate in which playing card positions to provide a player a predetermined game outcome value.

Accordingly, in one embodiment, the gaming device disclosed herein executes a game play of the spin poker game by:

A) Loading the compressed table and hand-set lists;
B) Receiving a seed;
C) Shuffling the deck according to received seed;
D) If the player plays according to the auto-hold strategy, using the shuffled deck to determine which cards are placed on the screen; and
E) If the player does not play according to the auto-hold strategy,
  a. Retrieving the list of hand-sets corresponding to the received seed,
  b. Applying a algorithm with the retrieved list, wherein it is required to find a solution within a small number of failed attempts or else move on to the next hand-set in the list,
  c. If a solution was not found for any hand-set in the list by the algorithm, retrieving the element of the compressed table corresponding to received seed, and
  d. If the element of the table contains no solution screen for the hold strategy used by the player, forcing the player to take a different hold strategy for which a solution exists.]

In another embodiment, the gaming system disclosed herein:

A. Determines, through simulation, the combinations of paying hands on N lines that are possible for each pay P;
B. Builds a list of "hand-sets" whose pays sum up to P and are known to be possible from step (A);
C. Given a pay P, retrieves the corresponding list of "hand-sets" L_p;
D. For each element V in L_p:
  1. Sorts the hands in V by restrictiveness (i.e., a royal flush is more restricted than a flush, which is more restrictive than one-pair),
  2. Makes a backup copy of the screen,
  3. Initializes the random seed to a number based on a hash of the hand set V, the initial deal D, and the hold strategy h,
  4. For each hand V_i in V:
    i. Permutes the order in which the lines are looked at,
    ii. Permutes the order in which the spots on a line are looked at,
    iii. Finds the first line in the permuted order for which the hand V_i is not impossible,
    iv. If no line is found, reverts to backup copy of screen made in step B, and returns to step (C) starting over with the first hand,
    v. Attempts to build hand V_i on the given line but putting down only the necessary number of cards, wherein:
      I. When cards are placed on a previously open spot of the screen they are placed in the first open spot determined by the permutation created in step (ii),
      II. When there are multiple choices for building a hand (say which face to create a three-of-a-kind out of), the suit or face is chosen randomly from among the candidates, and
      III. If wild cards are available, one is used in favor of an alternate non-wild card if a random number between 0 and 1 falls below a user defined level or if the hand cannot be completed without using a wild, vi. If the attempt to build the poker hand failed, returns to step (i) and tries again, vii. If the attempt to build the poker hand was successful, continues on to the next hand, V_(i+1) in V;

5. If every poker hand in V is created successfully, exits loop and moves on to step (E);

E) If failure to complete any hand set in L_p within the maximum number of attempts, exits the process in failure;

F) Fills any remaining open spots on the game screen with unused cards, wherein the gaming system:

a. Saves the current state of the screen in a backup copy, b. Permutes unused cards in deck, c. Quits successfully If no combos are completed on played lines by adding the playing cards, and d. Reverts to the backup copy created in step (1) and goes back to step (2).

In an alternative embodiment, if after replacing one playing card the player designated to hold, the gaming device has not determined or found a suitable solution which would generate a plurality of playing cards in the appropriate playing card positions to form a plurality of poker hands with a total payout equal to the selected predetermined game outcome, the gaming device replaces two playing cards the player designated to hold and again searches for a suitable solution screen. If replacing two playing cards does not result in the gaming device finding a suitable solution, the gaming device replaces three playing cards the player designated to hold. This process is repeated until a suitable solution is found and the appropriate playing cards are generated in the appropriate playing card positions.

It should be appreciated that in the embodiments described above, the poker hands provided after the first draw are the final poker hands for the poker game. In another embodiment, at least one additional draw will occur and the poker hands after the first draw are not final poker hands but rather are intermediate poker hands.

In one alternative embodiment, the gaming system disclosed herein does not utilize a look-up table of solutions for one or more poker hand seeds. In this embodiment, the gaming system screens out any poker hand seeds that are associated with solutions (as described above). That is, in this embodiment, the gaming system only utilizes poker hand seeds which the gaming device/gaming system is operable to determine which playing cards to generate in which playing card positions in the set amount of time. In another embodiment, rather than utilizing the look-up table of solutions, if the gaming system is unable to determine which playing cards to generate in which playing card positions in the set amount of time, the gaming system modifies one or more aspects of the poker game, such as forcing the player to follow the auto-hold strategy, to provide the predetermined game outcome to the player.

In another embodiment, the gaming system stores a solution for each possible way a player may play the initial poker hands associated with each initial poker hand. That is, for a five-card poker hand, the gaming system stores all thirty-two ways to play the initial poker hands associated with each initial poker hand. In this embodiment, rather than attempting to determine which playing cards to generate in which playing card positions to form a plurality of poker hands with a total payout equal to a selected predetermined game outcome value, the gaming system looks-up the appropriate solution for how the player decided to play the initial poker hand for the selected poker hand seed, generates (based on the looked-up solution) the appropriate playing cards in the appropriate playing card positions, and provides the player the selected predetermined game outcome.

In another embodiment, the gaming system disclosed herein incorporates distributed computing to determine which playing cards to generate in which playing card positions to form a plurality of poker hands with a total payout equal to a selected predetermined game outcome value for each poker game played. In this embodiment, the gaming system utilizes multiple processors or a peer-to-peer computer network to find an applicable solution for how a player decides to play a game. In one embodiment, the gaming system utilizes idle gaming devices on the network (or gaming devices currently with a low processing load) to find such applicable solutions.

In another embodiment, in addition to communicating a predetermined game outcome value (and a selected poker hand seed for the predetermined game outcome value), the central server communicates to a gaming device any applicable solutions for the selected poker hand seed. In one embodiment, as each set of solutions for each way a player may play an initial poker hand are communicated to the gaming device, the need for the gaming device to store any look-up tables of solutions is eliminated. In another embodiment, as each set of solutions for each way a player may play an initial poker hand are communicated to the gaming device, the need for the gaming device to determine which playing cards to generate in which playing card positions to form a plurality of poker hands with a total payout equal to a selected predetermined game outcome value is also eliminated.

In another embodiment, if the gaming device is unable to determine, in a set amount of time, which playing cards to generate in which playing card positions to form a plurality of poker hands with a total payout equal to a selected predetermined game outcome value, the gaming device communicates a request for an applicable solution to the central server. In this embodiment, the central server stores gigabytes worth of solution tables and utilizes a more powerful processor than a gaming device wherein upon a request for a gaming device, the central server instantly looks up the appropriate solution and communicates the appropriate solution to the gaming device.

Moreover, while the disclosed gaming device has been illustrated as a five card draw poker game, it should be appreciated that any type of poker game may be employed. As long as one or more predetermined game outcomes are provided to the player, the disclosed gaming device may be employed with other suitable types of poker games, such as Texas Hold'em, as well as other suitable multi-player non-poker cards games, such as blackjack.

In different alternative embodiments, the multi-spin poker game disclosed herein may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 30A:
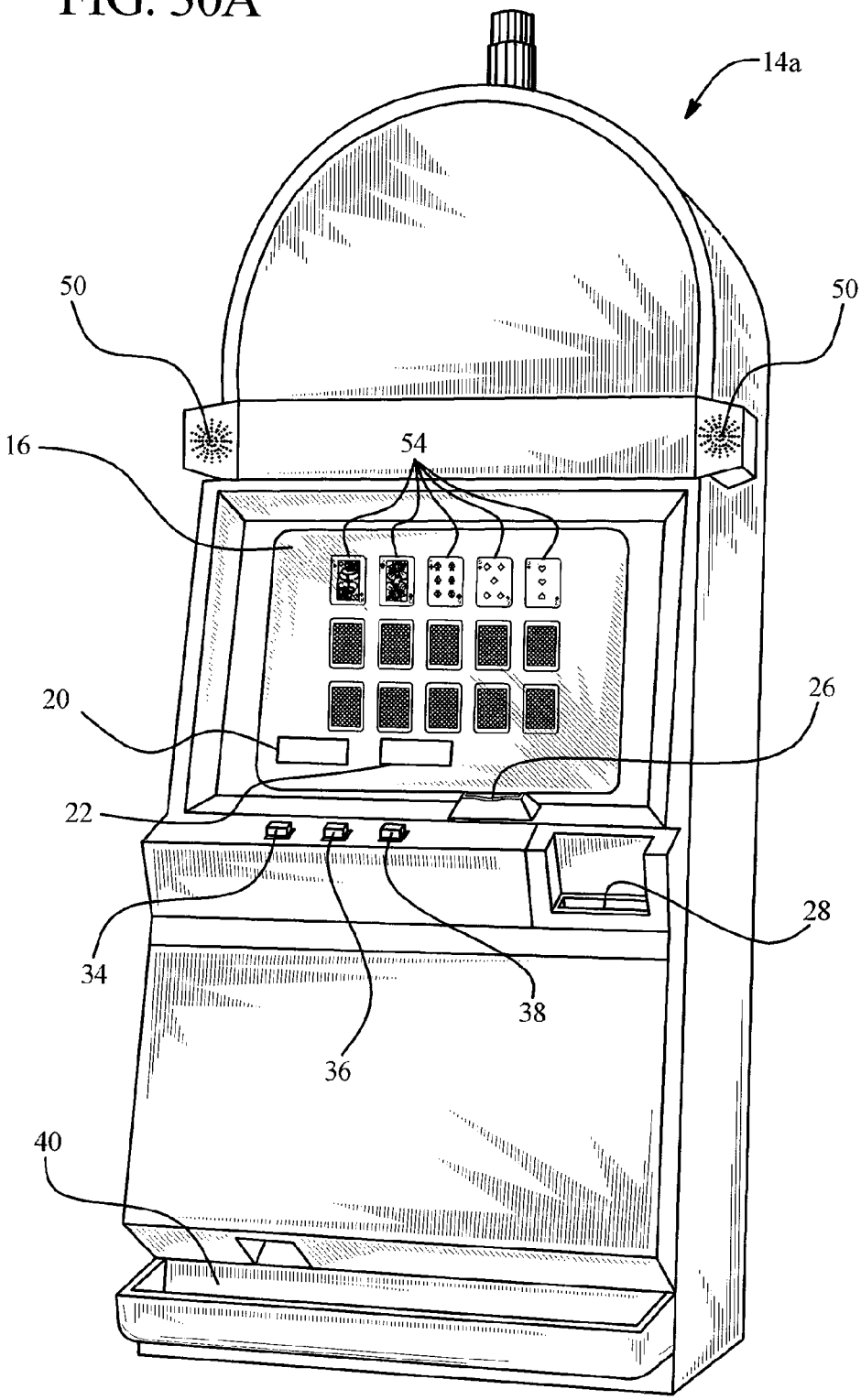
FIGS. 30A and 30B are perspective views of alternative embodiments of the gaming device disclosed herein.
Figure 30B:
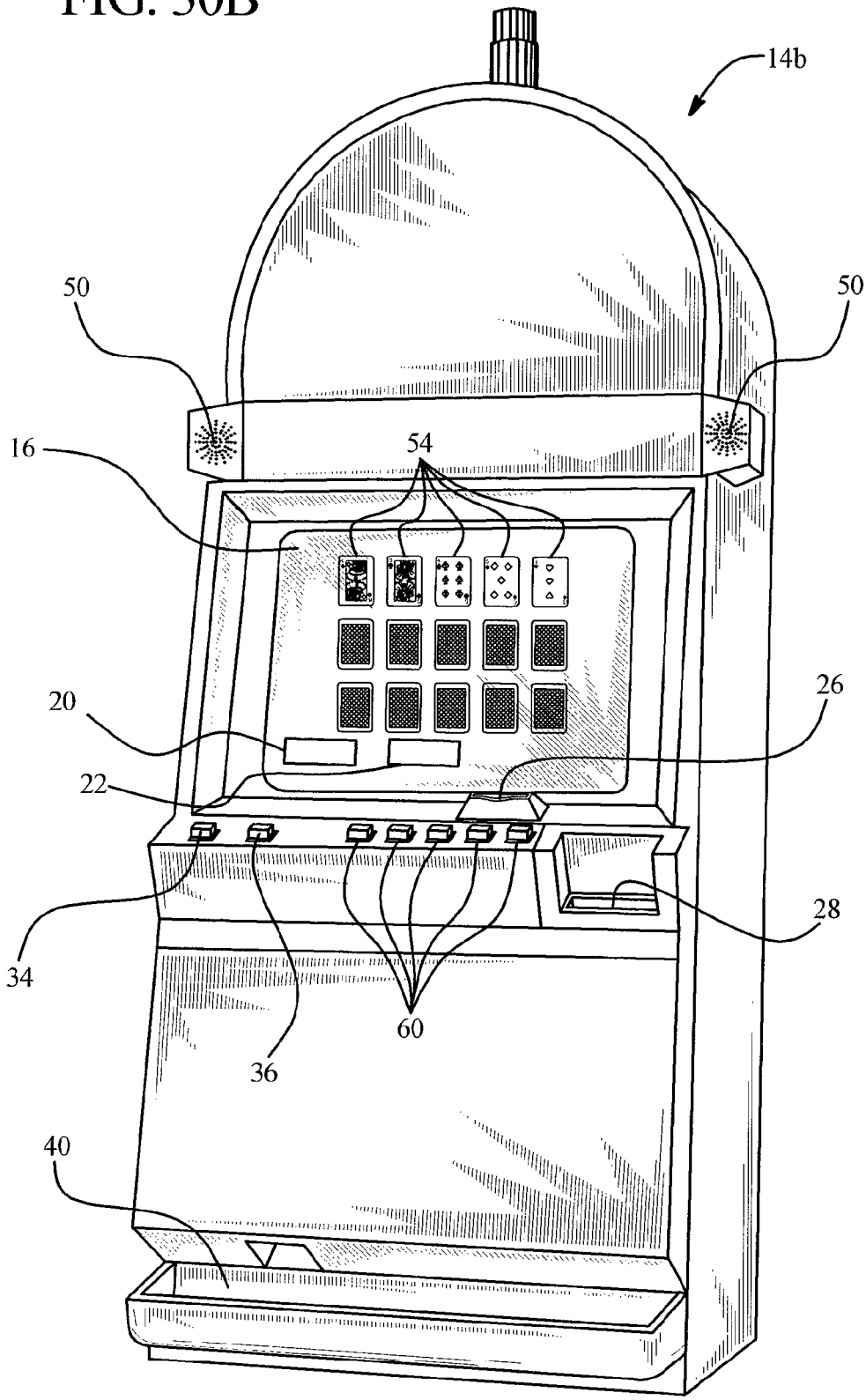

Two alternative embodiments of the gaming device are illustrated in FIGS. 30A and 30B as gaming device 14*a* and gaming device 14*b*, respectively. Gaming device 14*a* and/or gaming device 14*b* are generally referred to herein as gaming device 14.

In one embodiment, as illustrated in FIGS. 30A and 30B, gaming device 14 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 30A and 30B, the gaming device can be constructed with varying cabinet and display configurations.

Figure 31:
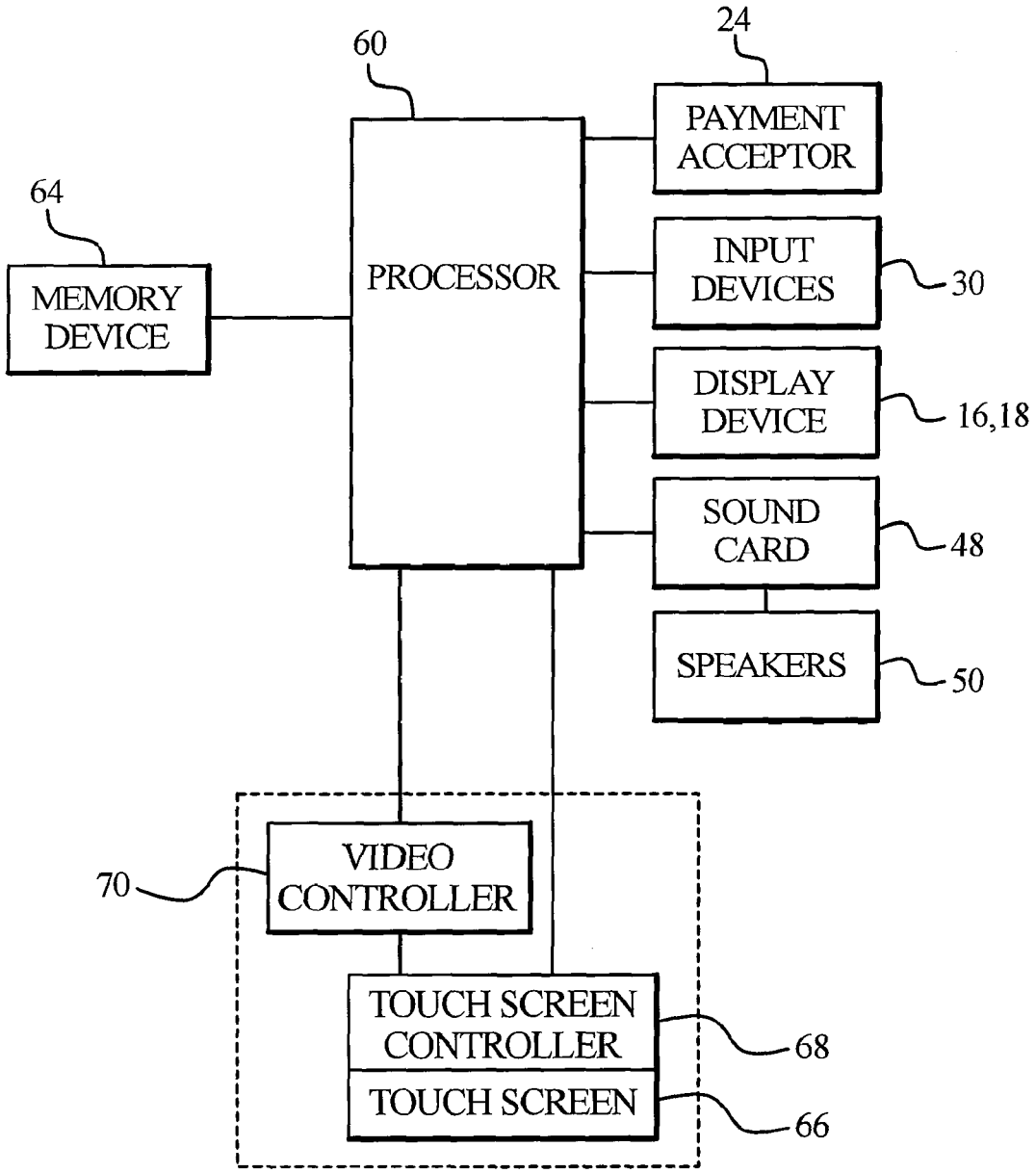
FIG. 31 is a schematic block diagram of an electronic configuration of one embodiment of the gaming device disclosed herein.

In one embodiment, as illustrated in FIG. 31, the gaming device preferably includes at least one processor 60, such as a microprocessor, a microcontroller-based platform, a suitable integrated circuit or one or more application-specific integrated circuits (ASIC's). The processor is in communication with or operable to access or to exchange signals with at least one data storage or memory device 64. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device stores a pool of predetermined outcomes which will be provided to the players during the play of the interactive poker game.

In one embodiment, the memory device includes random access memory (RAM), which can include non-volatile RAM (NVRAM), magnetic RAM (MRAM), ferroelectric RAM (FeRAM) and other forms as commonly understood in the art. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer."

In one embodiment, as discussed in more detail above, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

In one embodiment, as illustrated in FIG. 31, the gaming device includes one or more display devices controlled by the processor. The display devices are preferably connected to or mounted to the cabinet of the gaming device. The embodiment shown in FIG. 30A includes a central display device 16 which displays a primary game. This display device may also display any secondary game associated with the primary game as well as information relating to the primary or secondary game. The alternative embodiment shown in FIG. 30B includes a central display device 16 and an upper display device 18. The upper display device may display the primary game, any suitable secondary game associated with the primary game and/or information relating to the primary or secondary game.

In another embodiment, at least one display device may be a mobile display device, such as a PDA or tablet PC, that enables at least a portion of the primary or secondary game to be played at a location remote from the gaming device. As seen in FIGS. 30A and 30B, in one embodiment, the gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable configuration, such as a square, a rectangle or an elongated rectangle.

The display devices of the gaming device are configured to display at least one and preferably a plurality of game or other suitable images 54, symbols, playing cards and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 31, in one embodiment, the gaming device includes at least one payment acceptor 24 in communication with the processor. As seen in FIGS. 30A and 30B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 30A, 30B and 31, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 30A and 30B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, shown in FIG. 30B, the gaming device also includes a plurality of hold/discard buttons 60. The player may designate each of the plurality of playing cards dealt to the player as either a hold or discard by using the hold/discard buttons. In one embodiment, the gaming device includes one hold/discard button for all of the playing cards. In another embodiment, the gaming device includes an individual hold/discard button for each of the dealt playing cards.

In one embodiment, as mentioned above and seen in FIG. 31, one input device is a touch-screen 66 coupled with a touch-screen controller 68 or some other touch-sensitive display overlay to allow for player interaction with the images on the display. The touch-screen and the touch-screen controller are connected to a video controller 70. A player can make decisions, such as which playing cards to hold or discard and input signals into the gaming device by touching touch-screen at the appropriate places. One such input device is a touch-screen button panel. It should be appreciated that the utilization of touch-screens is widespread in the gaming industry.

The gaming device may further include a plurality of communication ports for enabling communication of the processor with external peripherals, such as external video sources, expansion buses, game or other displays, an SCSI port or a key pad.

In one embodiment, as seen in FIG. 31, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

In one embodiment, one or more of the gaming devices are in communication with each other and/or at least one central server, central controller or remote host through a data network or remote communication link. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, all of the gaming terminals which are coupled to the central processor are configured to play the same type of game. In an alternative embodiment, a plurality of the gaming terminals are configured so that different gaming terminals may be used to play different types of games. That is, some gaming terminals may be used for playing a slot machine style game, others may be used for playing a poker style game, others may be used for playing a blackjack style game, and the like. In another embodiment, a plurality of gaming terminals may each be configured for playing a plurality of different games.

In another embodiment, one or more of the gaming devices are in communication with a central server or controller for monitoring purposes only. In this embodiment, each gaming device stores a pool of predetermined outcomes to be provided to the player in a memory and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group.

In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

In one embodiment, a plurality of the gaming devices are connected together and to a central controller through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital signal line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In another embodiment, the memory device of the central server or central controller stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a "chip" to be inserted in a gaming device), writing the game program on a disc or other media, downloading or streaming the game program over a dedicated data network, Internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In one embodiment, the multi-play spin poker game may be employed as either a primary game or a base game. The primary or base game may comprise any suitable reel-type game, card game, number game or other game of chance susceptible to representation in an electronic or electromechanical form which produces a predetermined outcome upon activation from a wager. That is, different primary wagering games, such as video poker games, video blackjack games, video Keno, video bingo or any other suitable primary or base game may be implemented.

In another embodiment, if the multi-play spin poker game is implemented as a primary game, then in addition to winning credits in the primary multi-play spin poker game, the gaming device may also give players the opportunity to win credits in a bonus or secondary game or bonus or secondary round. The bonus or secondary game enables the player to obtain a prize or payout in addition to the prize or payout, if any, obtained from the base or primary game.

In one embodiment, if the multi-play spin poker game is implemented as a secondary game, then the gaming device can incorporate any suitable wagering primary or base game. The gaming machine or device may include some or all of the features of conventional gaming machines or devices. In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game. In other embodiments, the triggering event or qualifying condition may be by exceeding a certain amount of game play (such as number of games, number of credits, amount of time), or reaching a specified number of points earned during game play.

In another embodiment, the gaming device processor or central server randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

It should be appreciated that if the gaming device enables the player to play a secondary game in addition to the multi-play spin poker game, then regardless of how the game outcome is ultimately provided to the player, either as a value or payout from the primary or base game, as a value or payout from the secondary or bonus game, as a lose from the primary or base game or as a lose from the secondary or bonus game, the game outcome is predetermined. For example, if the game outcome is a win outcome with an associated value or payout of $10, the outcome may be presented to the player as a $10 win outcome in the primary or base game, a $10 secondary or bonus game win outcome or any combination of payouts in the primary or base game and secondary or bonus game that result in a total payout of $10. Either way, the player is provided $10 and that particular game outcome is removed from the set of game outcomes.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device operable under control of at least one processor, said gaming device comprising:

at least one display device configured to display a multi-hand spin poker game, said multi-hand spin poker game including:

(i) a plurality of playing cards, wherein different pluralities of said playing cards form a plurality of different poker hands that are each associated with a payout;

(ii) a plurality of playing card positions; and (iii) a plurality of paylines;

at least one memory device operable to store data representing a predefined table which includes a plurality of poker hand seeds, wherein each poker hand seed is associated with a payout, each poker hand seed is associated with zero, one or more predefined solutions and at least one poker hand seed is associated with at least one predefined solution, at least one input device; and said at least one processor programmed to operate with said at least one display device, said at least one memory device and said at least one input device to control a play of the multi-hand spin poker game by:

(a) determining a predetermined game outcome value;

(b) accessing the predefined table of poker hand seeds to select one of the poker hand seeds based on the predetermined game outcome value, wherein the payout associated with the selected poker hand seed is equal to or substantially equal to the predetermined game outcome value;

(c) generating and displaying a plurality of playing cards in a plurality of said playing card positions to form a primary poker hand along one of the paylines, wherein said generated playing cards are based on said selected poker hand seed;

(d) enabling the player to select at least one of said generated and displayed playing cards in the primary poker hand to hold or to discard, wherein said selected playing cards are respectively held or discarded in each of the secondary poker hands;

(e) determining if, based on the held playing cards, a plurality of said playing cards can be generated in a plurality of said non-held playing card positions to cause said primary poker hand and each of said secondary poker hands to be associated with payouts which form a total payout equal to the predetermined game outcome value;

(f) if the plurality of playing cards can be generated in the plurality of non-held playing card positions to cause the primary poker hand and each of said secondary poker hands to be associated with payouts which form the total payout equal to the predetermined game outcome value:

(i) for each non-held playing card position, generating and displaying said determined playing card in said determined playing card position, and (ii) providing the predetermined game outcome value to the player; and (g) if the plurality of playing cards cannot be generated in the plurality of non-held playing card positions to cause the primary poker hand and each of said secondary poker hands to be associated with payouts which form the total payout equal to the predetermined game outcome value:

(i) selecting one of the solutions associated with the poker hand seed of the predetermined game outcome value, wherein said solution is based on the held playing cards, (ii) generating and displaying a plurality of the playing cards in the plurality of playing card positions, wherein which of said playing cards are generated in which of said playing card positions is based on the selected solution, and (iii) providing the predetermined game outcome value to the player.

2. The gaming device of claim 1, wherein the at least one processor is programmed to control the play of the multi-hand spin poker game by determining if, in a set amount of time and based on the held playing cards, a plurality of said playing cards can be generated in a plurality of said non-held playing card positions to cause said primary poker hand and each of said secondary poker hands to be associated with payouts which form a total payout equal to the predetermined game outcome value.

3. The gaming device of claim 1, wherein the at least one processor is programmed to control the play of the multi-hand spin poker game by determining if, in a set number of attempts and based on the held playing cards, a plurality of said playing cards can be generated in a plurality of said non-held playing card positions to cause said primary poker hand and each of said secondary poker hands to be associated with payouts which form a total payout equal to the predetermined game outcome value.

4. The gaming device of claim 1, wherein the at least one processor is programmed to control the play of the multi-hand spin poker game by replacing at least one of the playing cards the player designated to hold.

5. The gaming device of claim 1, wherein the at least one processor is programmed to control the play of the multi-hand spin poker game by enabling the player to select a plurality of said generated and displayed playing cards to hold or to discard.

6. The gaming device of claim 1, wherein the at least one processor is programmed to control the play of the multi-hand spin poker game by enabling the player to select each of said generated and displayed playing cards to hold or to discard.

7. The gaming device of claim 1, wherein the predetermined game outcome value is associated with a value of zero for the play of the multi-hand spin poker game.

8. The gaming device of claim 1, wherein said predetermined game outcome value is selected from a plurality of different predetermined game outcome values.

9. The gaming device of claim 1, wherein said predetermined game outcome value is stored in said at least one memory device of the gaming device.

10. The gaming device of claim 1, wherein said predetermined game outcome value is received from a central controller.

11. The gaming device of claim 1, wherein the predefined table is received from a central controller.

12. The gaming device of claim 1, wherein each playing card position includes a reel.

13. A gaming system comprising:

at least one database including:

(i) data representing a plurality of different poker hand seeds, wherein each poker hand seed is associated with a payout, each poker hand seed is associated with zero, one or more predefined solutions and at least one poker hand seed is associated with at least one predefined solution, (ii) data representing a plurality of payout amounts and at least one distribution of poker game outcomes, if any, which would result in each of said payout amounts, and (iii) data representing a set of predetermined game outcome values;

at least one central controller programmed to select at least one of said predetermined game outcome values from the set of predetermined game outcome values; and a plurality of gaming machines, each gaming machine operable under control of at least one gaming machine processor and configured to communicate with the at least one central controller, each gaming machine including:

at least one display device configured to display a multi-hand spin poker game operable upon a wager, said multi-hand spin poker game including:

(i) a plurality of playing cards, wherein different pluralities of said playing cards form a plurality of different poker hands that are each associated with a payout, (ii) a plurality of playing card positions in said multi-hand spin poker game, and (iii) a plurality of paylines;

at least one memory device; and at least one input device;

said at least one gaming machine processor programmed to operate with said at least one input device, said at least one display device and said at least one memory device to control a play of the multi-hand spin poker game by:

(a) accessing the at least one database to select one of the poker hand seeds based on the central controller selected predetermined game outcome value;

(b) generating and displaying a plurality of playing cards in a plurality of said playing card positions to form a primary poker hand along one of the paylines, wherein said generated playing cards are based on said selected poker hand seed;

(c) enabling the player to select at least one of said generated and displayed playing cards in the primary poker hand to hold or to discard, wherein said selected playing cards are respectively held or discarded in each of the secondary poker hands;

(d) determining if, based on the held playing cards, a plurality of said playing cards can be generated in a plurality of said non-held playing card positions to cause said primary poker hand and each of said secondary poker hands to be associated with payouts which form a total payout equal to the predetermined game outcome value, wherein said determination is based, at least in part, on the data of said at least one database;

(e) if the plurality of playing cards can be generated in the plurality of non-held playing card positions to cause the primary poker hand and each of said secondary poker hands to be associated with payouts which form the total payout equal to the predetermined game outcome value:

(i) for each non-held playing card position, generating and displaying said determined playing card in said determined playing card position, and (ii) providing the predetermined game outcome value to the player; and (f) if the plurality of playing cards cannot be generated in the plurality of non-held playing card positions to cause the primary poker hand and each of said secondary poker hands to be associated with payouts which form the total payout equal to the predetermined game outcome value:

(i) selecting one of the solutions associated with the poker hand seed of the predetermined game outcome value, wherein said solution is based on the held playing cards, (ii) generating and displaying a plurality of the playing cards in the plurality of playing card positions, wherein which of said playing cards are generated in which of said playing card positions is based on the selected solution, and (iii) providing the predetermined game outcome value to the player.

14. The gaming system of claim 13, wherein each gaming machine processor is programmed to control the play of the multi-hand spin poker game by determining if, in a set amount of time and based on the held playing cards, a plurality of said playing cards can be generated in a plurality of said non-held playing card positions to cause said primary poker hand and each of said secondary poker hands to be associated with payouts which form a total payout equal to the predetermined game outcome value.

15. The gaming system of claim 13, wherein each gaming machine processor is programmed to control the play of the multi-hand spin poker game by determining if, in a set number of attempts and based on the held playing cards, a plurality of said playing cards can be generated in a plurality of said non-held playing card positions to cause said primary poker hand and each of said secondary poker hands to be associated with payouts which form a total payout equal to the predetermined game outcome value.

16. The gaming system of claim 13, wherein each gaming machine processor is programmed to control the play of the multi-hand spin poker game by replacing at least one of the playing cards the player designated to hold.

17. The gaming system of claim 13, wherein each gaming machine processor is programmed to control the play of the multi-hand spin poker game by enabling the player to select a plurality of said generated and displayed playing cards to hold or to discard.

18. The gaming system of claim 13, wherein each gaming machine processor is programmed to control the play of the multi-hand spin poker game by enabling the player to select each of said generated and displayed playing cards to hold or to discard.

19. The gaming system of claim 13, wherein the predetermined game outcome value is associated with a value of zero for the play of the multi-hand spin poker game.

20. The gaming system of claim 13, wherein the at least one memory device of each gaming machine stores said at least one database.

21. The gaming system of claim 13, wherein the central controller is operable to flag said selected predetermined game outcome value, to output the selected predetermined game outcome value and to prevent said selected game outcome value from any subsequent selections.

22. The gaming system of claim 13, wherein the central controller is operable to select at least one of said predetermined game outcome values based on the results of a game selected from the group consisting of a bingo game, a keno game and a lottery game.

23. The gaming system of claim 13, wherein each playing card position of at least one of said gaming machines includes a reel.

24. A method of operating a gaming device, said method causing the gaming device to:

(a) determine a predetermined game outcome value;

(b) access a predefined table of poker hand seeds to select one of a plurality of poker hand seeds based on the predetermined game outcome value, wherein each poker hand seed is associated with a payout, each poker hand seed is associated with zero, one or more predefined solutions, at least one poker hand seed is associated with at least one predefined solution and the payout associated with the selected poker hand seed is equal to or substantially equal to the predetermined game outcome value;

(c) generate and display a plurality of playing cards in a plurality of playing card positions to form a primary poker hand along one of a plurality of paylines, wherein different pluralities of said playing cards form a plurality of different poker hands that are each associated with a payout and said generated playing cards are based on said selected poker hand seed;

(d) enable the player to select at least one of said generated and displayed playing cards in the primary poker hand to hold or to discard, wherein said selected playing cards are respectively held or discarded in each of the secondary poker hands;

(e) determine if, based on the held playing cards, a plurality of said playing cards can be generated in a plurality of said non-held playing card positions to cause said primary poker hand and each of said secondary poker hands to be associated with payouts which form a total payout equal to the predetermined game outcome value;

(f) if the plurality of playing cards can be generated in the plurality of non-held playing card positions to cause the primary poker hand and each of said secondary poker hands to be associated with payouts which form the total payout equal to the predetermined game outcome value:

(i) for each non-held playing card position, generate and display said determined playing card in said determined playing card position, and (ii) provide the predetermined game outcome value to the player; and (g) if the plurality of playing cards cannot be generated in the plurality of non-held playing card positions to cause the primary poker hand and each of said secondary poker hands to be associated with payouts which form the total payout equal to the predetermined game outcome value:

(i) select one of the solutions associated with the poker hand seed of the predetermined game outcome value, wherein said i solution is based on the held playing cards, (ii) generate and display a plurality of the playing cards in the plurality of playing card positions, wherein which of said playing cards are generated in which of said playing card positions is based on the selected solution, and (iii) provide the predetermined game outcome value to the player.

25. The method of claim 24, which includes determining if, in a set amount of time and based on the held playing cards, a plurality of said playing cards can be generated in a plurality of said non-held playing card positions to cause said primary poker hand and each of said secondary poker hands to be associated with payouts which form a total payout equal to the predetermined game outcome value.

26. The method of claim 24, which includes determining if, in a set number of attempts and based on the held playing cards, a plurality of said playing cards can be generated in a plurality of said non-held playing card positions to cause said primary poker hand and each of said secondary poker hands to be associated with payouts which form a total payout equal to the predetermined game outcome value.

27. The method of claim 24, which includes replacing at least one of the playing cards the player designated to hold.

28. The method of claim 24, which includes enabling the player to select a plurality of said generated and displayed playing cards to hold or to discard.

29. The method of claim 24, which includes enabling the player to select each of said generated and displayed playing cards to hold or to discard.

30. The method of claim 24, wherein the predetermined game outcome value is associated with a value of zero.

31. The method of claim 24, wherein said predetermined game outcome value is selected from a plurality of different predetermined game outcome values.

32. The method of claim 24, which includes storing said predetermined game outcome value.

33. The method of claim 24, which includes receiving said predetermined game outcome value from a central controller.

34. The method of claim 24, which includes receiving the predefined table from a central controller.

35. The method of claim 24, wherein each playing card position includes a reel.

36. The method of claim 24, which is provided over a data network.

37. The method of claim 36, wherein the network is an internet.

38. A method of operating a gaming system, said method comprising:

(a) maintaining at least one database including:

(i) data representing a plurality of different poker hand seeds, wherein each poker hand seed is associated with a payout, each poker hand seed is associated with zero, one or more predefined solutions and at least one poker hand seed is associated with at least one predefined solution, (ii) data representing a plurality of payout amounts and at least one distribution of poker game outcomes, if any, which would result in each of said payout amounts, and (iii) data representing a set of predetermined game outcome values;

(b) causing at least one central controller to select at least one of said predetermined game outcome values from the set of predetermined game outcome values; and (c) causing at least one gaming machine to:

(i) access the at least one database to select one of the poker hand seeds based on the central controller selected predetermined game outcome value;

(ii) generate and display a plurality of playing cards in a plurality of playing card positions to form a primary poker hand along one of a plurality of paylines, wherein different pluralities of said playing cards form a plurality of different poker hands that are each associated with a payout and said generated playing cards are based on said selected poker hand seed;

(iii) enable the player to select at least one of said generated and displayed playing cards in the primary poker hand to hold or to discard, wherein said selected playing cards are respectively held or discarded in each of the secondary poker hands;

(iv) determine if, based on the held playing cards, a plurality of said playing cards can be generated in a plurality of said non-held playing card positions to cause said primary poker hand and each of said secondary poker hands to be associated with payouts which form a total payout equal to the predetermined game outcome value, wherein said determination is based, at least in part, on the data of said at least one database;

(v) if the plurality of playing cards can be generated in the plurality of non-held playing card positions to cause the primary poker hand and each of said secondary poker hands to be associated with payouts which form the total payout equal to the predetermined game outcome value:

(A) for each non-held playing card position, generate and display said determined playing card in said determined playing card position, and (B) provide the predetermined game outcome value to the player; and (vi) if the plurality of playing cards cannot be generated in the plurality of non-held playing card positions to cause the primary poker hand and each of said secondary poker hands to be associated with payouts which form the total payout equal to the predetermined game outcome value:

(A) select one of the solutions associated with the poker hand seed of the predetermined game outcome value, wherein said solution is based on the held playing cards, (B) generate and display a plurality of the playing cards in the plurality of playing card positions, wherein which of said playing cards are generated in which of said playing card positions is based on the selected solution, and (C) provide the predetermined game outcome value to the player.

39. The method of claim 38, which includes causing said at least one gaming machine to determine if, in a set amount of time and based on the held playing cards, a plurality of said playing cards can be generated in a plurality of said non-held playing card positions to cause said primary poker hand and each of said secondary poker hands to be associated with payouts which form a total payout equal to the predetermined game outcome value.

40. The method of claim 38, which includes causing said at least one gaming machine to determine if, in a set number of attempts and based on the held playing cards, a plurality of said playing cards can be generated in a plurality of said non-held playing card positions to cause said primary poker hand and each of said secondary poker hands to be associated with payouts which form a total payout equal to the predetermined game outcome value.

41. The method of claim 38, which includes causing said at least one gaming machine to replace at least one of the playing cards the player designated to hold.

42. The method of claim 38, which includes causing said at least one gaming machine to enable the player to select a plurality of said generated and displayed playing cards to hold or to discard.

43. The method of claim 38, which includes causing said at least one gaming machine to enable the player to select each of said generated and displayed playing cards to hold or to discard.

44. The method of claim 38, wherein the predetermined game outcome value is associated with a value of zero.

45. The method of claim 38, which includes causing the central controller to flag said selected predetermined game outcome value, to output the selected predetermined game outcome value and to prevent said selected game outcome value from any subsequent selections.

46. The method of claim 38, which includes causing the central controller to select at least one of said predetermined game outcome values based on the results of a game selected from the group consisting of a bingo game, a keno game and a lottery game.

47. The method of claim 38, wherein each playing card position of at said least one gaming machine includes a reel.

48. The method of claim 38, which is provided over a data network.

49. The method of claim 48, wherein the network is an internet.

* * * * *

UNITED STATES PATENT AND TRADEMARK OFFICE

CERTIFICATE OF CORRECTION

PATENT NO. : 7,857,693 B1
APPLICATION NO. : 11/764603
DATED : December 28, 2010
INVENTOR(S) : Johnson et al.

It is certified that error appears in the above-identified patent and that said Letters Patent is hereby corrected as shown below:

IN THE CLAIMS:

In Claim 24, Column 73, Line 22, replace “said i solution” with --said solution--.

Signed and Sealed this
First Day of March, 2011

David J. Kappos

David J. Kappos
*Director of the United States Patent and Trademark Office*